US005132904A

United States Patent [19]

Lamp

[11] Patent Number: 5,132,904

[45] Date of Patent: Jul. 21, 1992

[54] REMOTE WELL HEAD CONTROLLER WITH SECURE COMMUNICATIONS PORT

[76] Inventor: Lawrence R. Lamp, Rte. 4, Box 59B, Millersburg, Ohio 44654

[21] Appl. No.: 489,907

[22] Filed: Mar. 7, 1990

[51] Int. Cl.[5] ..... G06F 15/20; E21B 34/16

[52] U.S. Cl. ..... 364/422; 166/53

[58] Field of Search ..... 364/550, 138, 422, 551..01, 364/551.02, 509; 166/53; 73/462, 579

[56] References Cited

U.S. PATENT DOCUMENTS

| | | | |
|---|---|---|---|
| 3,921,152 | 11/1975 | Hagar et al. | 340/172.5 |
| 4,150,721 | 4/1979 | Norwood | 166/53 |
| 4,432,064 | 2/1984 | Barker | 364/550 |
| 4,573,115 | 2/1976 | Halgrimson | 364/138 |
| 4,633,954 | 1/1987 | Dixon et al. | 166/372 |
| 4,636,934 | 1/1987 | Schwendemann et al. | 364/132 |
| 4,685,522 | 8/1987 | Dixon et al. | 166/372 |
| 4,747,060 | 6/1988 | Sears, III et al. | 364/481 |
| 4,751,648 | 6/1988 | Sears, III et al. | 364/422 |
| 4,895,533 | 1/1990 | Yau et al. | 439/587 |
| 4,989,671 | 2/1991 | Lamp | 166/53 |

OTHER PUBLICATIONS

Matsubara et al. "EEPROM On-Chip Single Chip Microcomputer"; *Hitachi Review* vol. 35 No. 5 Oct. 1986, pp. 237-240.

Lofthus, "TMS 9940 High Performance Microcomputer", *Midcon 1979 Conference Record* Chicago, Ill. Nov. 6-8, 1979 vol. 3.

*Primary Examiner*—Allen R. Macdonald

*Attorney, Agent, or Firm*—Fay, Sharpe, Beall, Fagan, Minnich & McKee

[57] ABSTRACT

A gas and oil well controller includes a microcomputer control circuit which can control well production by monitoring well pressure levels, by time limitations, or any combination of the two. The controller includes a casing pressure sensor, a tubing pressure sensor for sensing casing/tubing differential pressure and tubing/-line differential (flow) pressure, a line pressure sensor for sensing pressure in the sales line, and a plunger position sensor for sensing the position of a plunger adjacent a top position in the well tubing. The microcomputer control circuit is in operative communication with the production valve, the casing pressure sensor, the tubing pressure sensor, the line pressure sensor, and the plunger to open and close the production valve for gas flow to the sales line when the casing, tubing, and line pressures bear a predetermined relationship to preselected pressure limits or when the plunger is sensed by the plunger sensor. The controller includes serial and parallel communication ports through which all communications to and from the controller pass. Any hand held device or portable computer capable of serial communication may access the controller. A telephone modem or telemetry link to a central "host" computer may be used to permit several controllers to be accessed remotely. Security and individual controller selection is provided by a specfic password code to prevent unauthorized access to the controller.

19 Claims, 36 Drawing Sheets

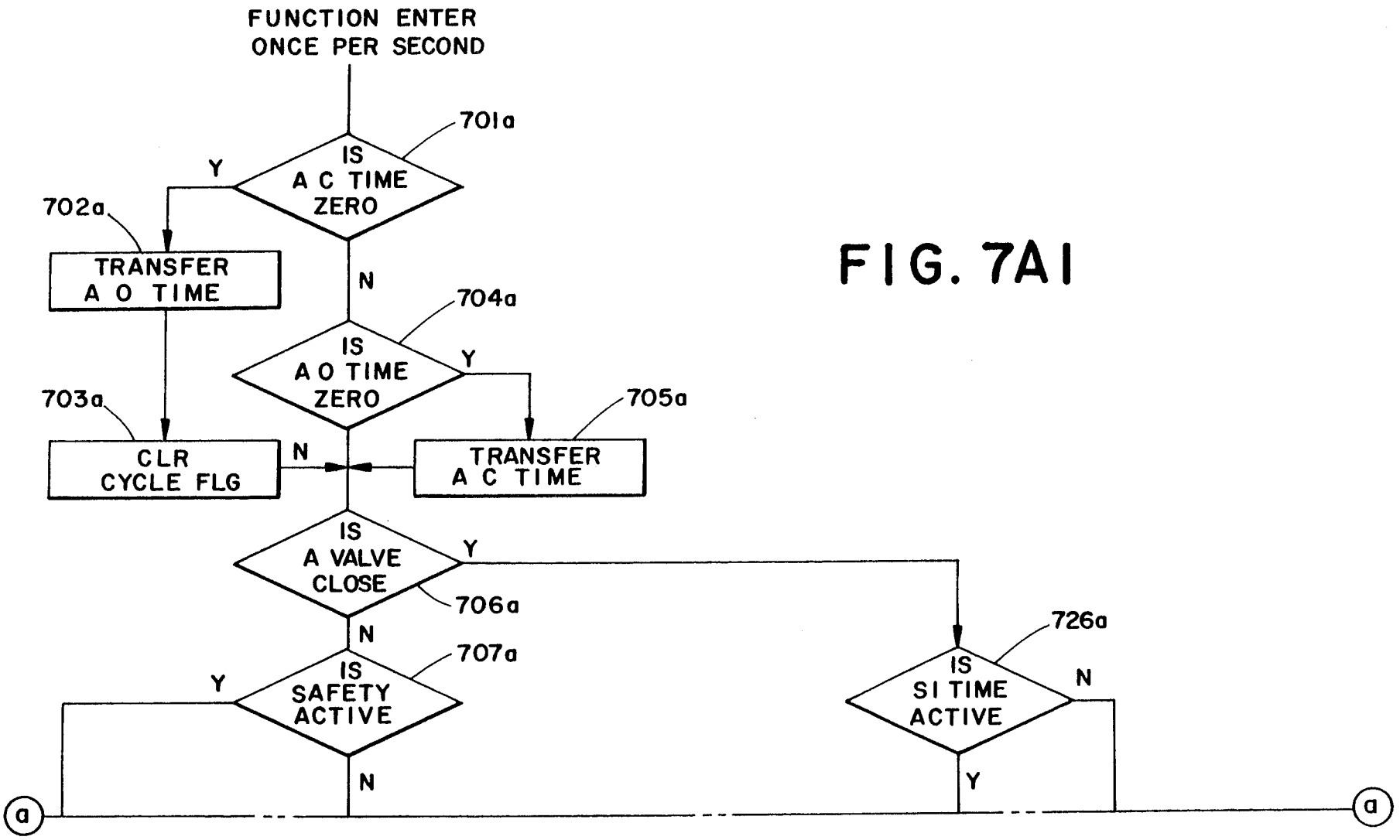
FIG. 7A1

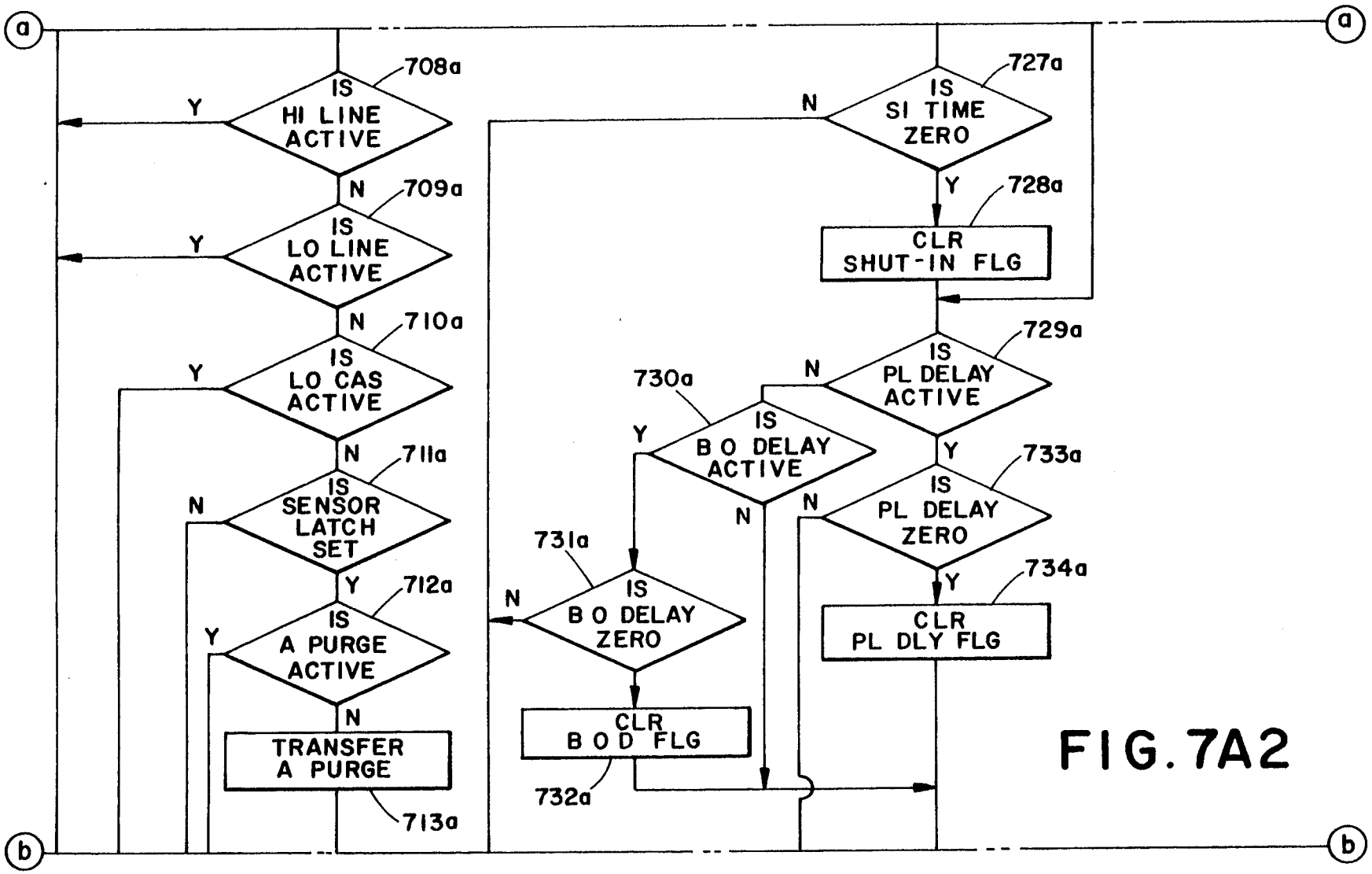
FIG. 7A2

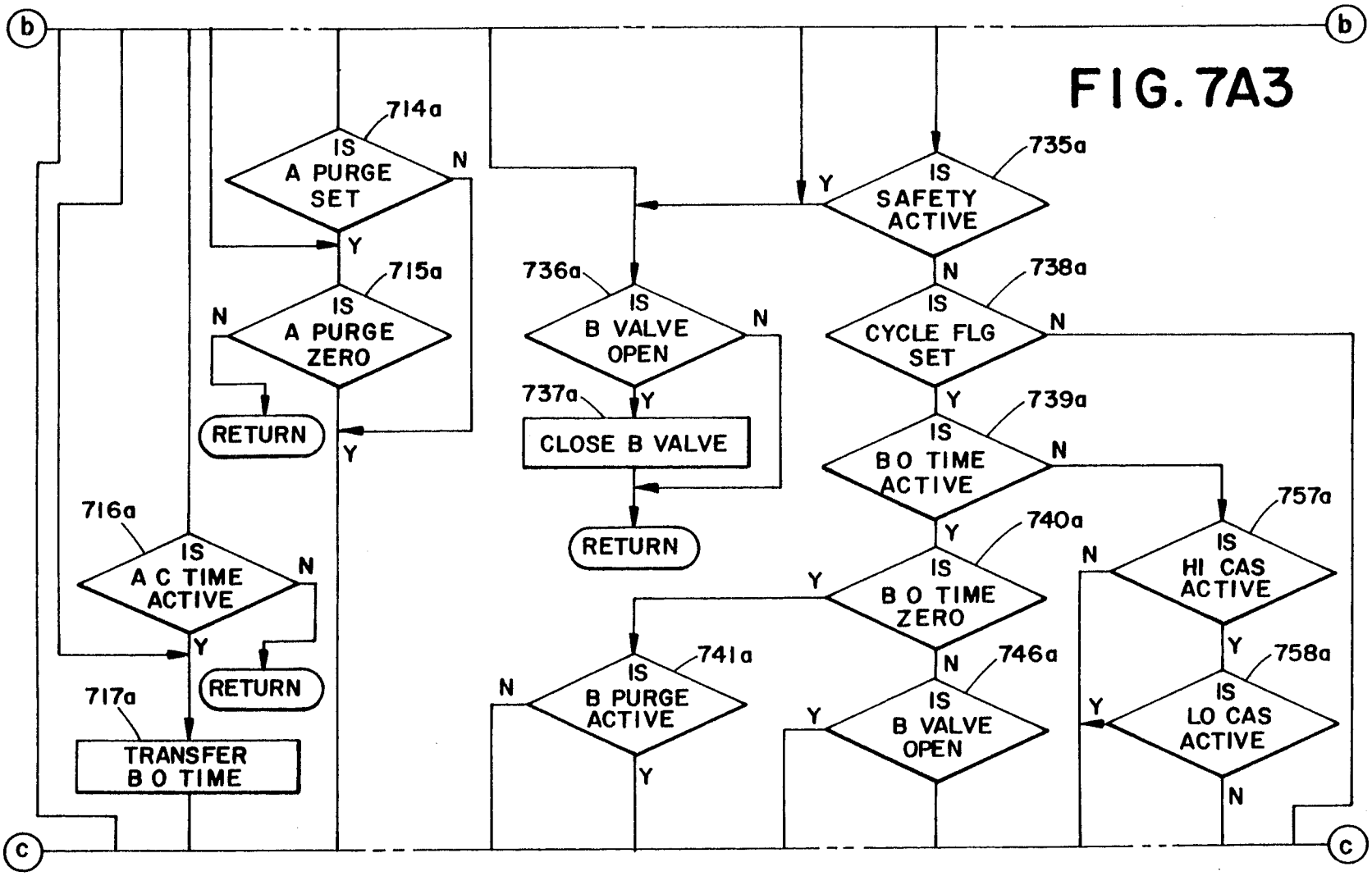
FIG. 7A3

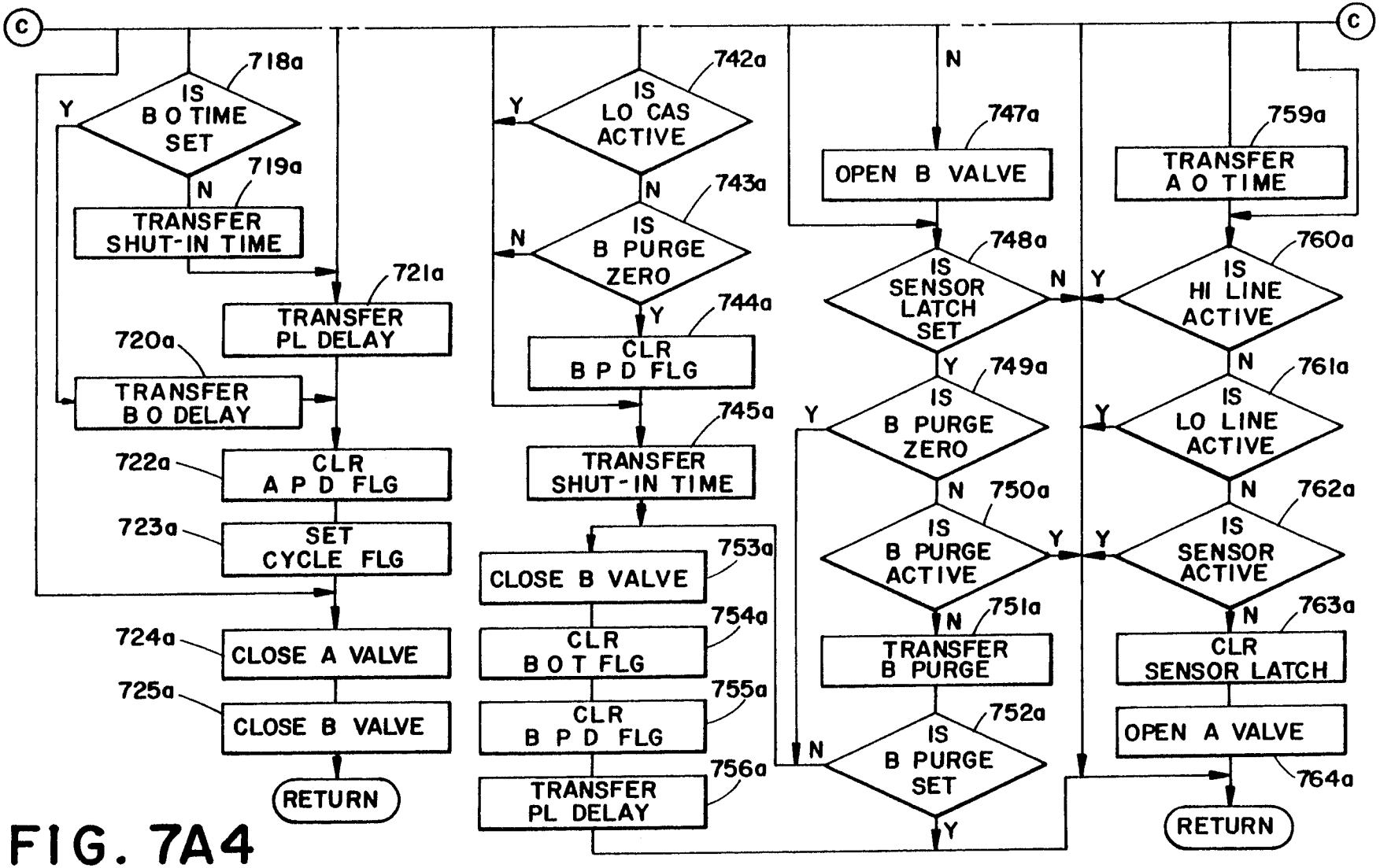
FIG. 7A4

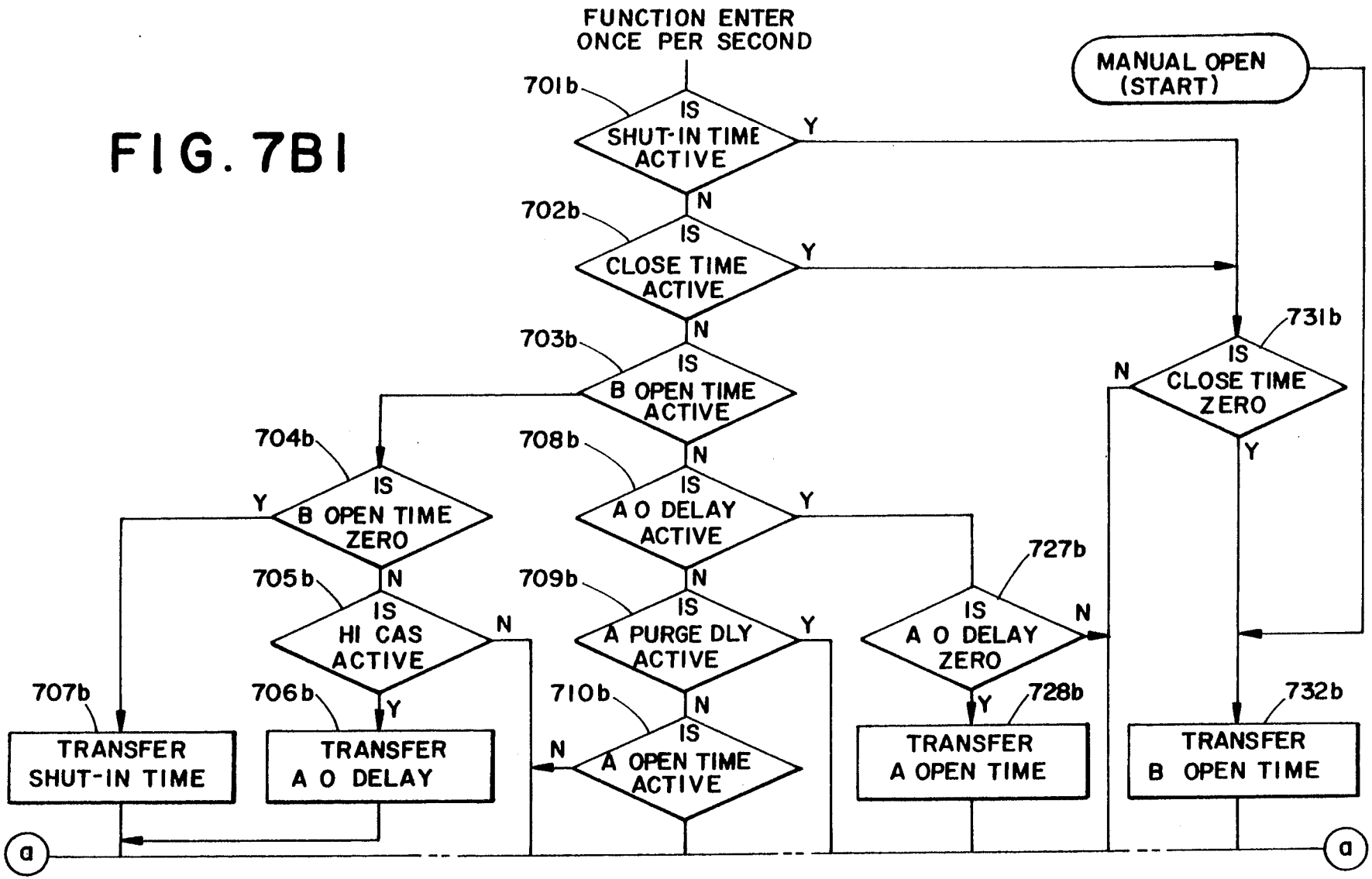
FIG. 7B1

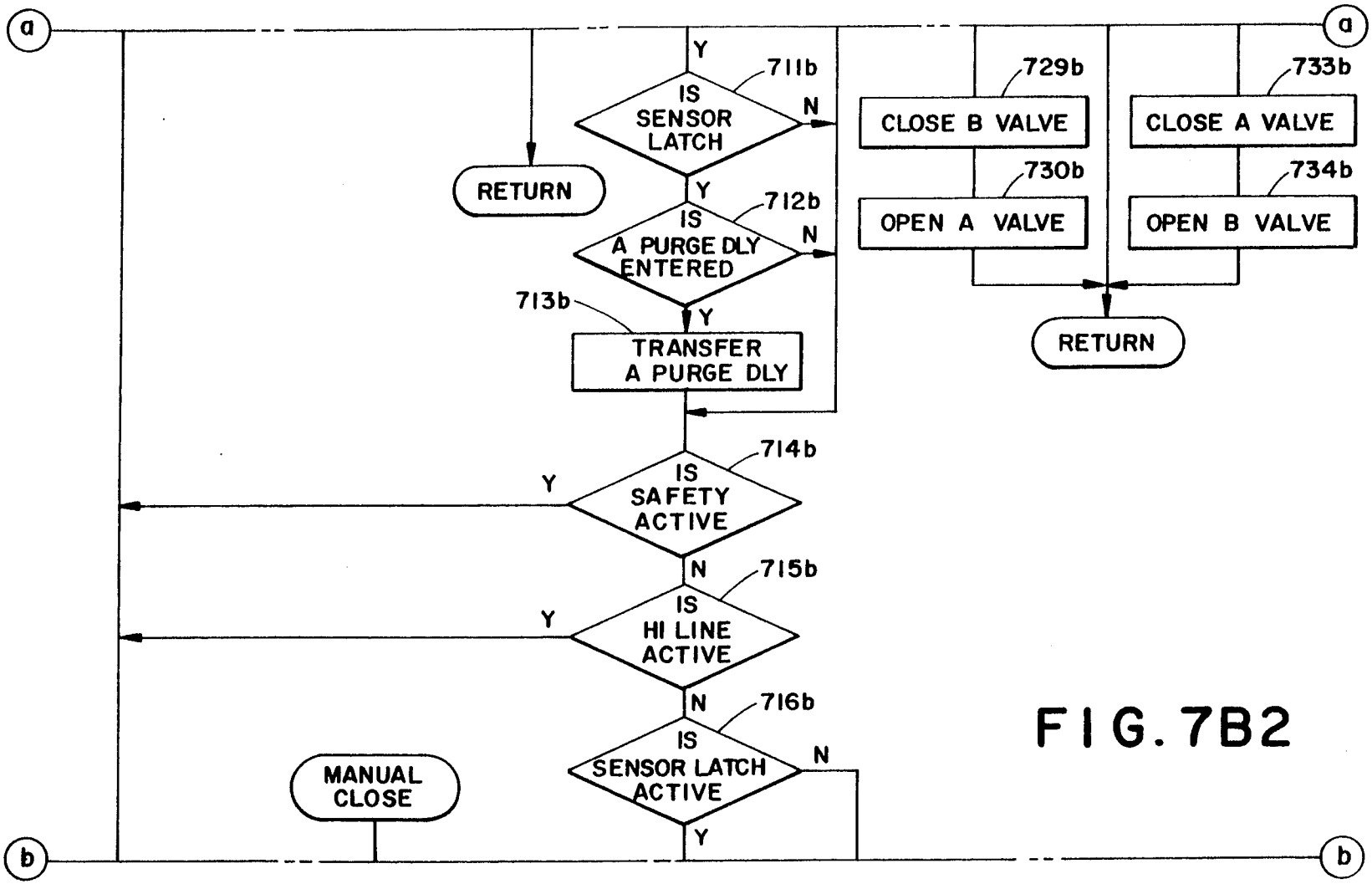
FIG. 7B2

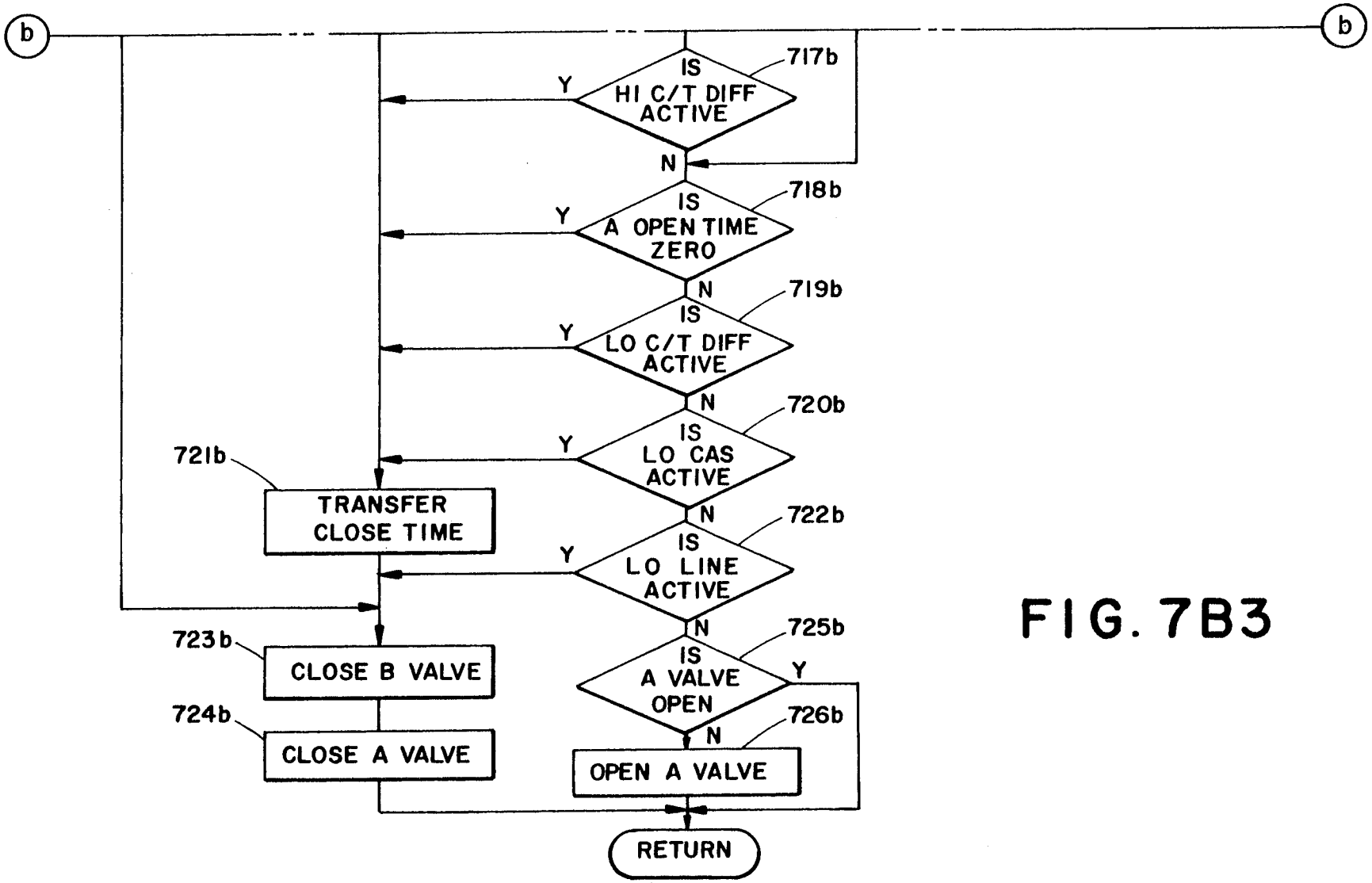
FIG. 7B3

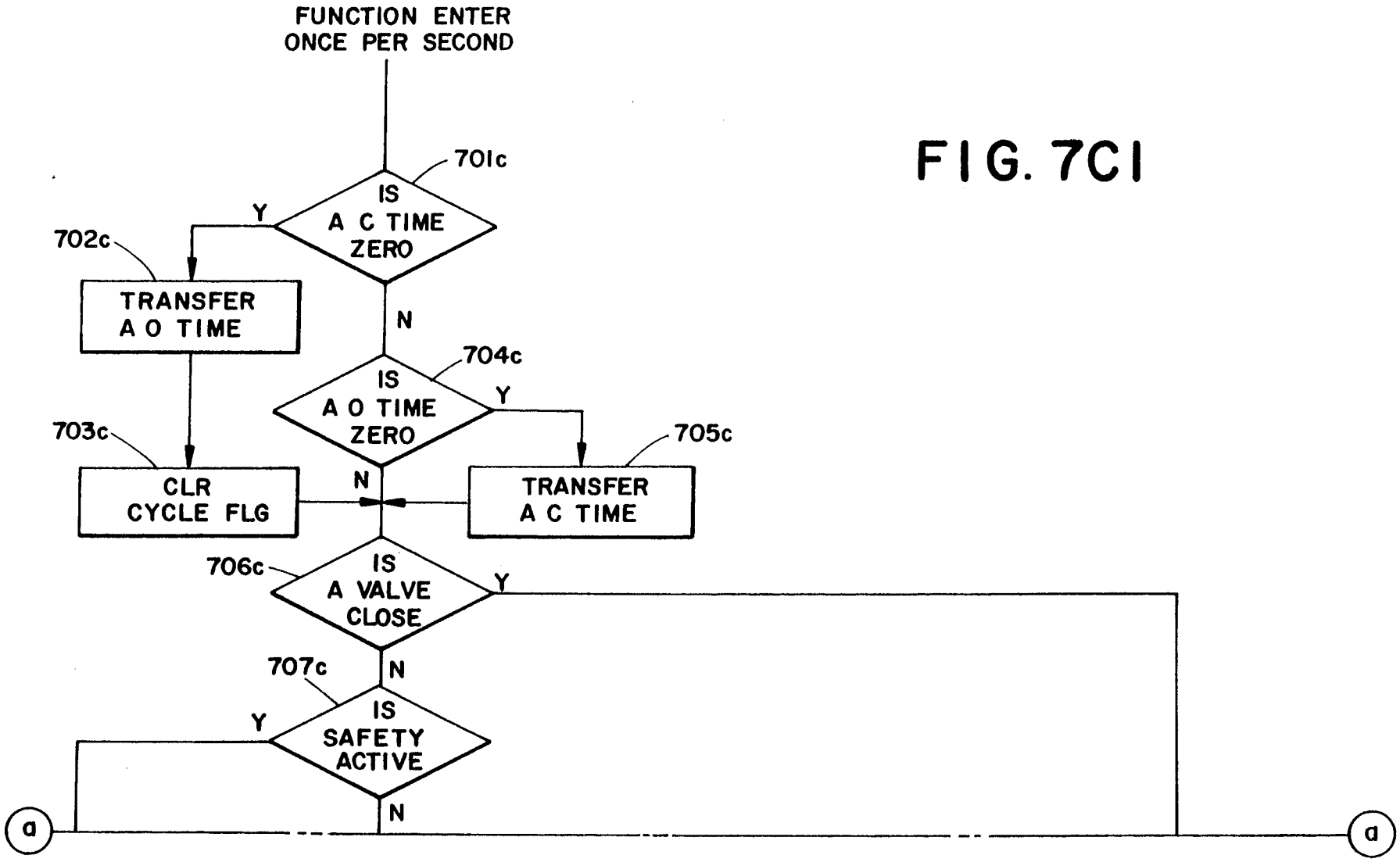
FIG. 7C1

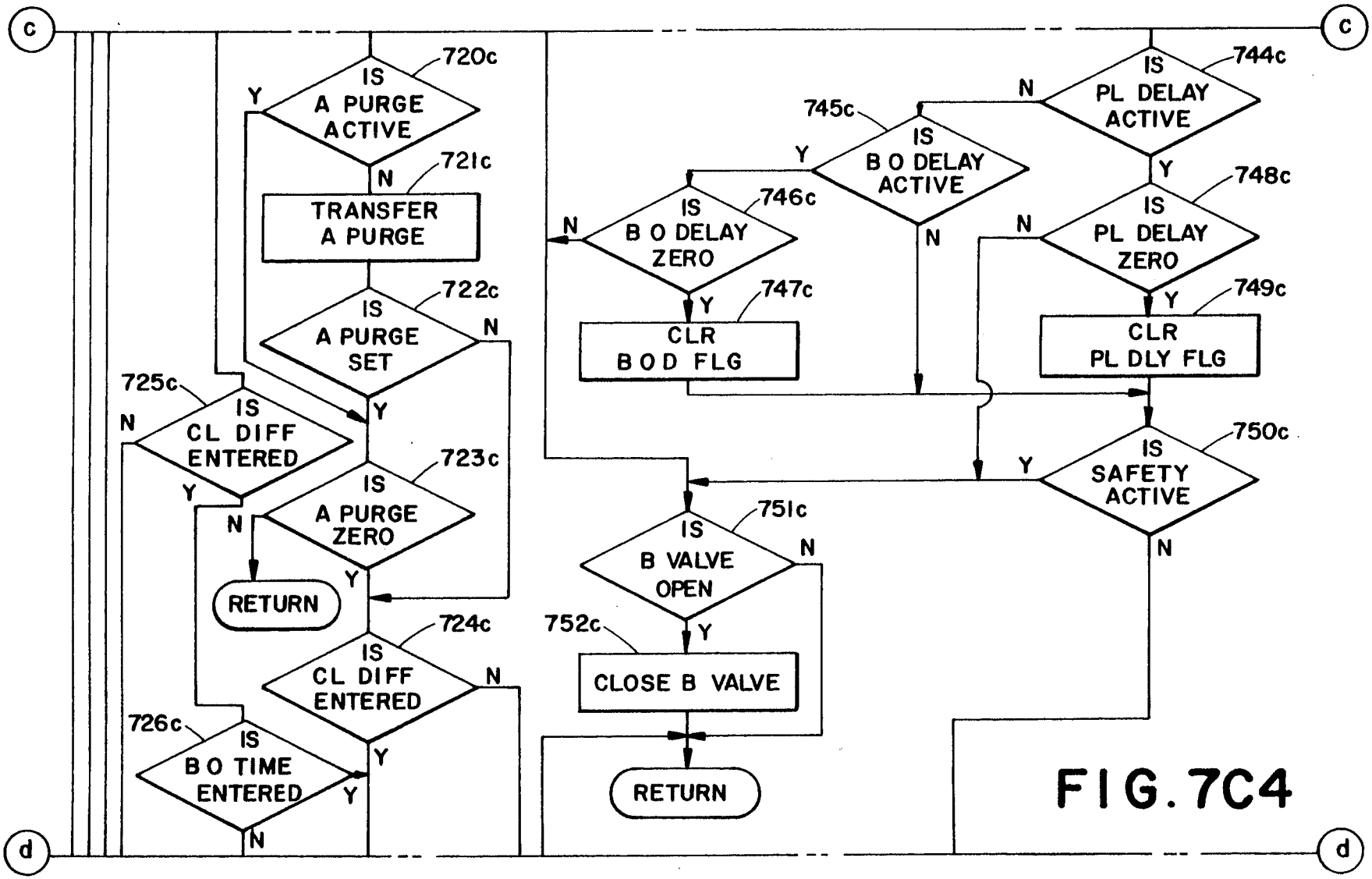
FIG. 7C4

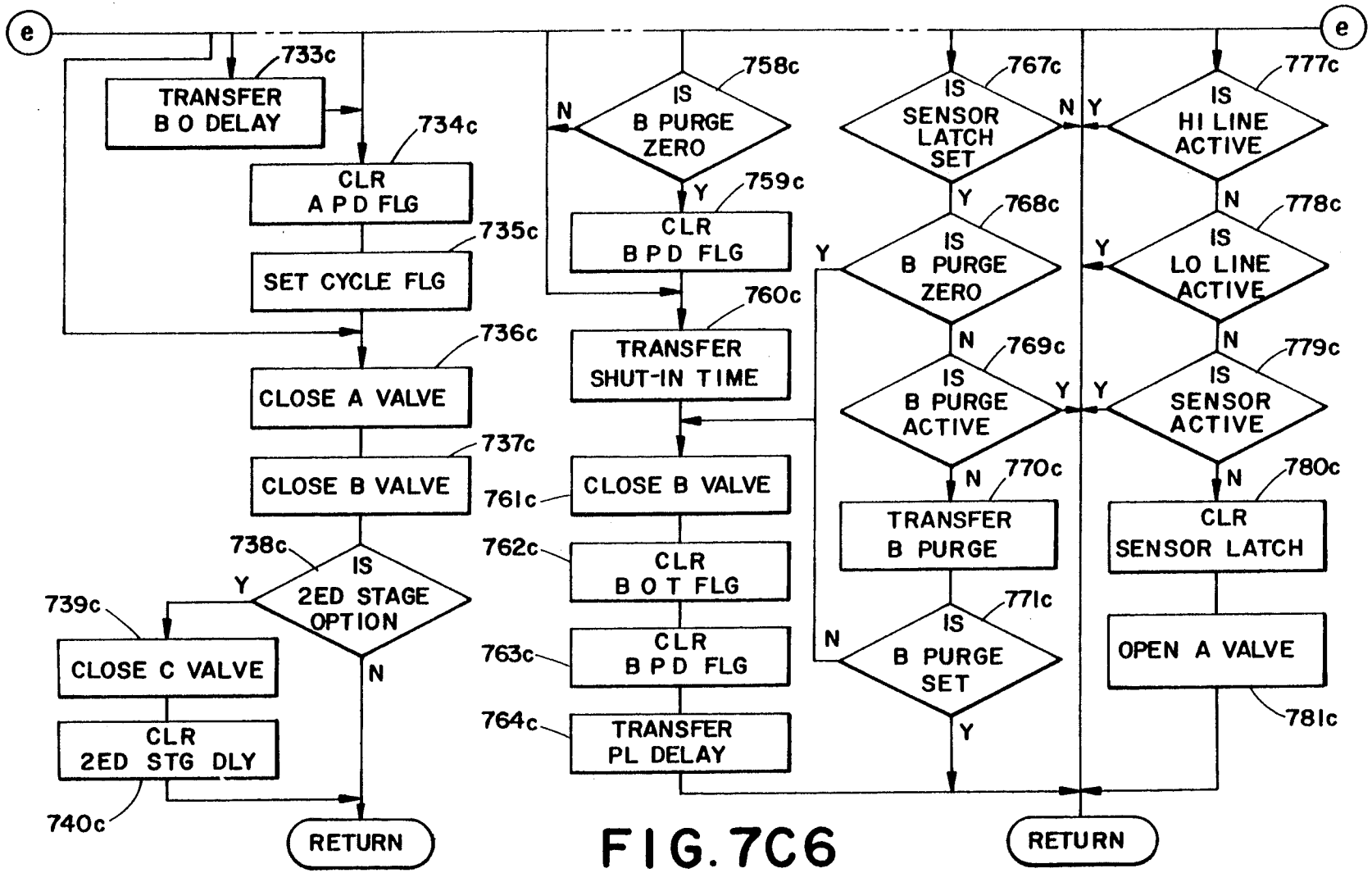
FIG. 7C6

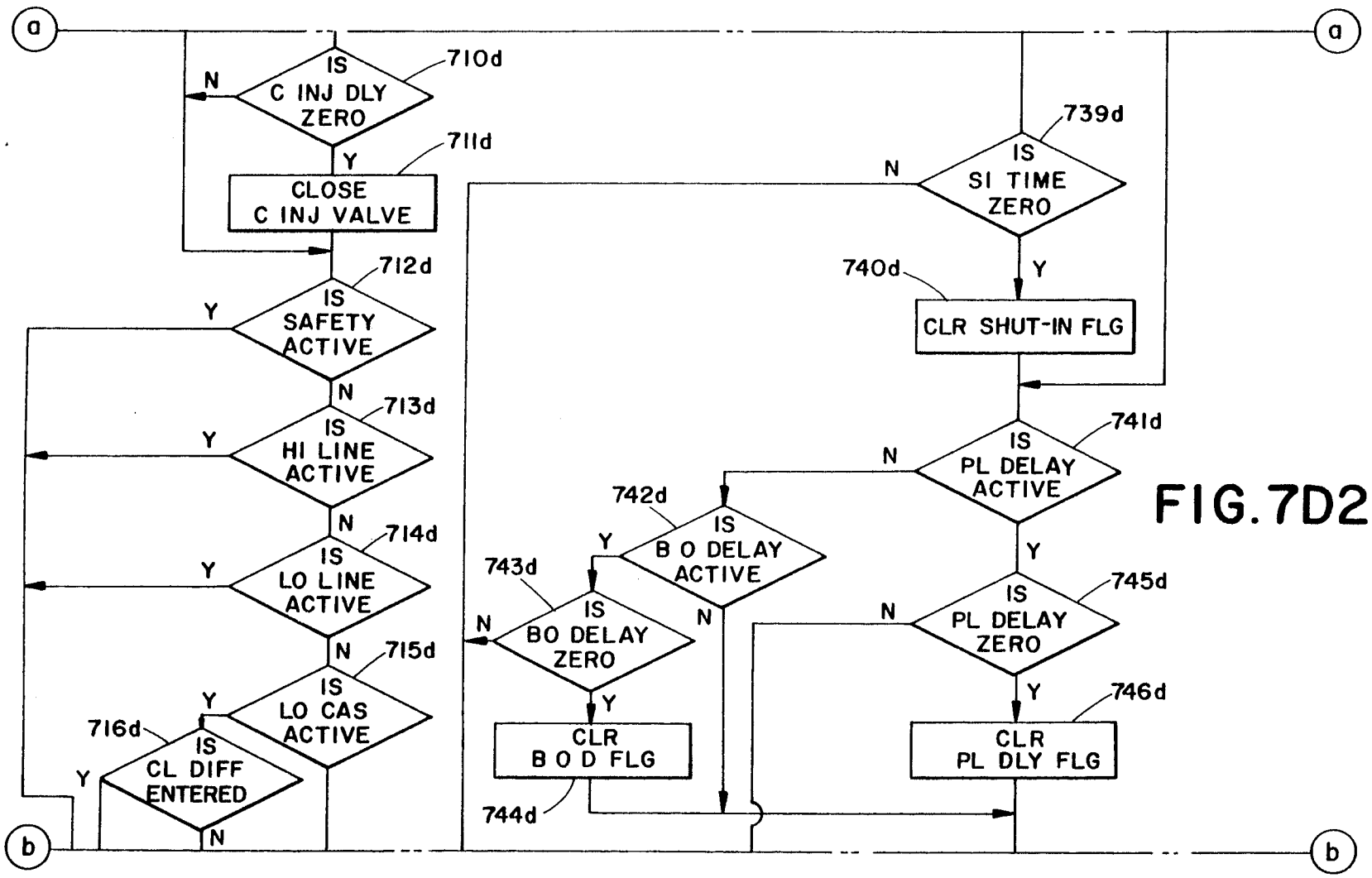
FIG. 7D2 b
c
IS SENSOR LATCH SET
717d
IS A PURGE ACTIVE
718d
TRANSFER A PURGE
719d
IS A PURGE SET
720d
IS CL DIFF ENTERED
721d
IS A PURGE ZERO
723d
RETURN
IS CL DIFF ENTERED
724d
IS SAFETY ACTIVE
747d
IS INJECTION OPTION
748d
IS C INJ TIME ACTIVE
749d
IS C INJ TIME ZERO
750d
IS CYCLE FLG SET
753d
IS OP DIFF ACTIVE
722d
IS HI CAS ACTIVE
773d
IS CL DIFF ACTIVE
774d
IS LO CAS ACTIVE
775d
TRANSFER A O TIME
776d
Y
N c
d
777d
IS HI LINE ACTIVE
778d
IS LO LINE ACTIVE
779d
IS SENSOR ACTIVE
780d
IS LO CAS ACTIVE
781d
CLR SENSOR LATCH
782d
OPEN A VALVE
754d
IS B O TIME ACTIVE
755d
IS B O TIME ZERO
765d
IS B VALVE OPEN
751d
IS B VALVE OPEN
752d
CLOSE B VALVE
RETURN
756d
IS B PURGE ACTIVE
757d
IS LO CAS ACTIVE
722d
IS B O TIME ENTERED
725d
IS CL DIFF ACTIVE
726d
IS A C TIME ACTIVE
727d
TRANSFER B O TIME
728d
IS B O TIME SET
729d
TRANSFER SHUT-IN TIME
Y
N

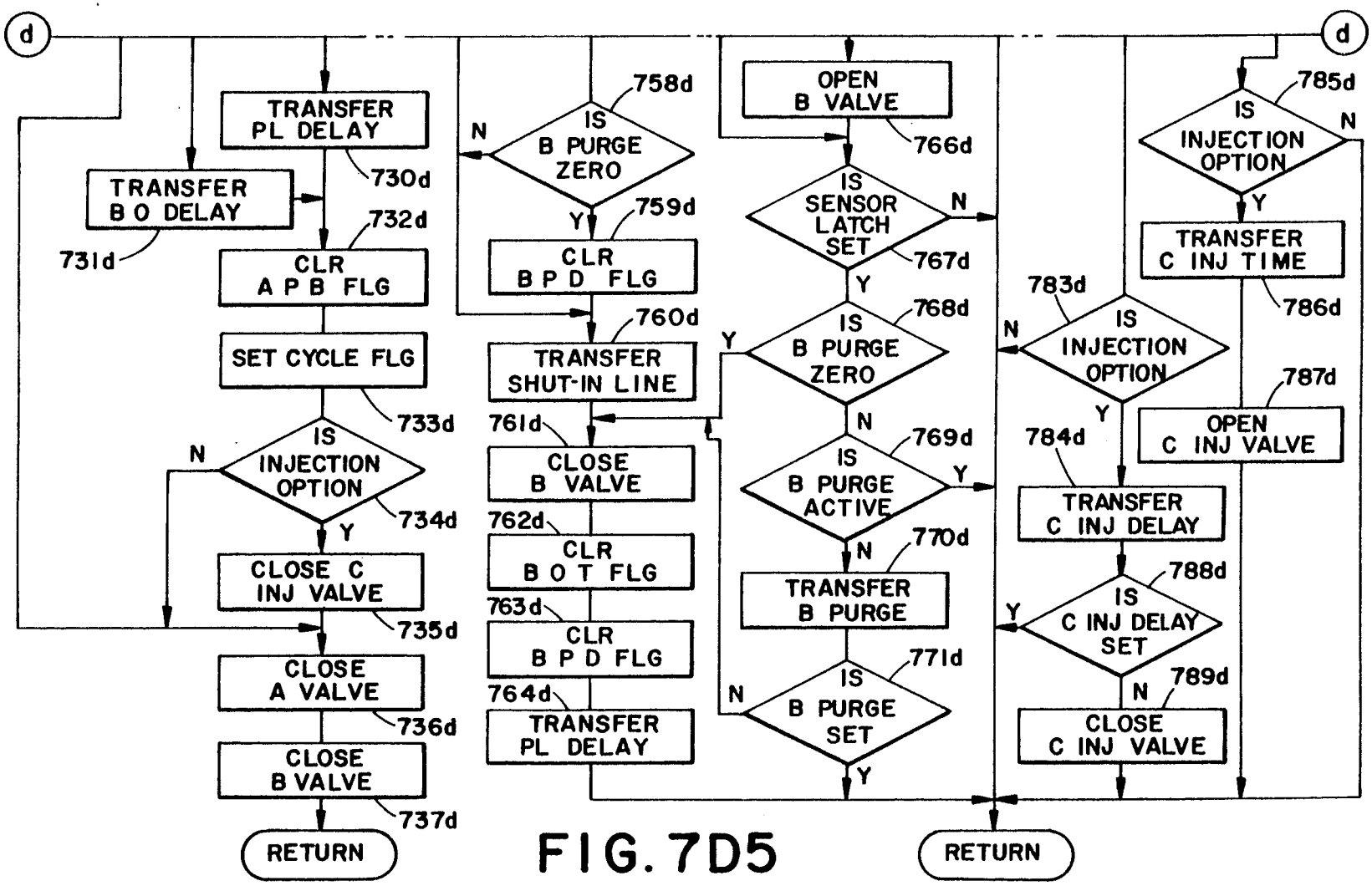
FIG. 7D5

REMOTE WELL HEAD CONTROLLER WITH SECURE COMMUNICATIONS PORT

BACKGROUND OF THE INVENTION

This invention pertains to the art of control systems and more particularly to a controller for regulating fluid flow in a pressurized fluid system with attention to various time, pressure, and safety parameters.

The invention is particularly applicable to a control for unattended or remote control of any process requiring one or more fluid or gas control valves to be opened or closed at specific times, pressures, or flow specifications. The control software is especially tailored for application to gas and oil wells including a plunger lift device for maximizing production and efficiency by selectively regulating production and shut-in through close supervision of time, pressure, and safety parameters. The production may be controlled by pressure only, time only, or any combination of the two. In addition, a plunger arrival sensor and delay time programming allows for selective operation to further maximize production and efficiency. However, it will be appreciated by those skilled in the art that the invention could be readily adapted for use in other environments as, for example, where similar control devices and systems are employed to control and regulate other types of fluid transmission and communication.

Gas and oil wells typically have varying production characteristics attributable to such factors as well depth, the types and quantity of fluids present in the well, and the natural gas "rock" pressure. Fluid accumulations in the well tubing particularly inhibit the gas production and, accordingly, should be removed. Such fluid accumulations are usually comprised of salt water and oil. Accordingly, dependent upon the particular characteristics of the well, differing well operating techniques are necessary to adapt and to handle these factors and thereby optimize production.

Some oil and gas wells are produced by using the plunger lift method by which a plunger lifts the liquids (e.g., oil, water) out of the well tubing by using the gas pressure in the casing of the well. The standard method of producing such wells is by a time "on" and a time "off" cycle. An "on" period means that a designated time or pressure has been reached and a flow valve is opened which vents the pressure in the well tubing and allows the plunger to rise to the top of the well bringing oil or water ahead of it. After the plunger has arrived at the top of the well, gas is allowed to flow out of the well through the well tubing. An "off" period means that the flow valve is closed, the plunger falls to the bottom of the well tubing and the well sits idle accumulating gas pressure, which will be used to move the plunger during the "on" cycle, and liquids.

Most wells employ a controller system which alternately shuts-in the well for pressure accumulation in the well casing and then opens it to allow the for the expulsion of gas and fluids through a tubing received in the casing. The various forms and types of well controllers that have heretofore been suggested and employed in the industry have met with varying degrees of success. It has been found that the defects present in most prior well controllers are such that the controllers themselves are of limited economic and practical value.

One method of oil and gas production is by means of a simple open/close time cycle controller or variation thereof. An improvement over the simple timer is shown in U.S. Pat. No. 4,150,721 issued to Norwood. The Norwood controller can modify its preset production time cycle by inputs from manually set pressure switches located on the casing, tubing, or sales line and by limit switches which can indicate low flow rate, plunger arrival, or fluid storage full.

U.S. Pat. No. 4,355,365 issued to McCraken is similar to the Norwood controller. The open cycle time may be initiated by a high limit input from a manually set pressure limit switch on the casing. The close cycle time may be initiated from any low or off limit input from the manually set pressure limit switches on the casing, tubing, or sales line or by the switch indicating plunger arrival. The McCraken controller will also extend the open cycle time by the duration of a high limit input or extend the close cycle time by the duration of a low or off limit input to ensure a full time count per cycle.

A problem with previous time cycle production control systems is the failure of the controllers to provide a means for synchronization of several producing wells into a common sales line. This is more desirable with a field of low volume or stripper wells. A producing well with relatively low rock pressure will not be able to discharge its gas into a sales line which has greater pressure. The stronger wells must be shut-in to permit the weaker wells to produce. Timing of the various wells is important as fluid may build and load up the weaker wells. A time cycle controller must be used but must also have pressure limits and conditional inputs for safety. The Norwood and McCraken controllers have the pressure limits and conditional safety inputs but neither are suitable for synchronization for their time cycles are modified by the inputs The McCraken controller extends its time cycle with the inputs and both McCraken and Norwood controllers terminate the open cycle and transfer the close cycle time low limit of off inputs.

It would be desirable to maintain a "constant time" with reference to the open and close cycles. All wells feeding the common sales line may then be assigned an operating period synchronized to within one second from any given time. This permits the individual wells the opportunity to produce at their optimum. The safety and line pressure limits would override an open cycle to close the main production valve only as long as the input condition exists. The time cycle would not be modified and the production valve would reopen for the duration of the open cycle when the line pressure limit or input condition no longer is active. If during the shut in condition of the open cycle, the open cycle time is complete, the close time would be transferred and the well would remain shut in.

Another problem associated with the previous time cycle production control systems is the failure of the controller to be adaptable to changing well conditions due to well aging. Generally, as a well ages, the method of production used when the well was originally tapped, gradually becomes less efficient. It is possible that an initially strong well will become so weak as to necessitate an injection method to achieve an acceptable level of production.

It would be desirable to provide a single controller configurable to a plurality of applications without extensive hardware modification. As a particular well ages, the system program of the controller may be modified to account for the changing conditions when it becomes necessary to do so.

The collection of data representative of the conditions of gas and oil wells typically involves on-site inspection by an operator of the volume of gas and fluids collected for a given time period. A number of collections may be accumulated to form a history against which future data may be evaluated by the operator Because the gas and oil wells are typically spread out over a large area, personnel in charge of maintaining the wells spend much of their time travelling between the sites. Various data collection methods have been proposed which would enable an operator to use an interrogation unit to selectively access the information stored on-site. U.S. Pat. No. 4,799,169 issued to Mims is directed to a gas well flow instrumentation apparatus including a computation unit and an interrogation unit. The computation unit measures parameters of gas flow at the well head and accumulates gas flow information over a plurality of different independent time intervals. The interrogation unit can be used to calibrate the computation unit and to make a permanent record of the information via on-board integral printer.

A low cost data logging device is disclosed in U.S. Pat. No. 4,414,633 to Churchill. Churchill's data logging device comprises a transducer means located in a gas supply line which provides an electrical signal having a pulse frequency representative of the magnitude of the parameter being measured A timing means is also provided to permit the measurement of the parameter at a predetermined time interval. A permanent record of the measurement of the parameter may be made on a printer device or the measurement may be stored in a memory. These devices are useful for the collection of data, particularly data relating to the flow of gas or fluids through a line but are limited to the passive collection of that data It is desirable to provide a single controller configurable to a plurality of applications and having a data logging function. A small hand held computer may be used by an operator to retrieve information from the controller concerning logged events at a particular site. Once collected, the resident controller memory may be cleared for the storage of new data. The hand held computer may be carried to the next site for similar data acquisition by the operator Upon completion, the operator may then carry the hand held computer back to a home base where the data retrieved from the various well sites may be downloaded to another computer having various data base or spread sheet programs to provide immediate production reports for each of the remote controllers.

The present invention contemplates a new and improved controller which overcomes all of the above problems referred and to above others and meets the above stated needs to provide a new gas and oil well controller which is readily adaptable to a plurality of well operational environments and uses with wells having a variety of operational characteristics and parameters, and which is easy to install, easy to operate, inexpensive to manufacture, provides improved well control and production, and which provides improved well head security.

BRIEF SUMMARY OF THE INVENTION

In accordance with the present invention, there is provided a gas and oil well controller particularly suited for regulating the flow of gas and fluids from a well to a gas sales line and the communication of well fluids to a storage tank. A security access code is provided to prevent unauthorized access to operator variables and options. The new controller for a gas and oil well having a casing, a tubing, a gas line, a plunger lift device, and a production valve intermediate of the tubing and sales line includes a microcomputer control circuit. The microcomputer control circuit is in operative communication with a casing pressure sensing means for sensing pressure in the casing, a tubing pressure sensing means for sensing pressure in the tubing, a line pressure sensing means for sensing pressure in the sales line, and a plunger lift device position sensing means for sensing the plunger lift device adjacent a position in the tubing. The microcomputer has interface capabilities with both analog and digital peripheral sensing devices also including serial and parallel communication ports. The production valve is opened and closed in response to control signals from the microcomputer in response to well parameters sensed by the sensing devices bearing a predetermined relationship to preselected well parameter limits programmed in the computer memory.

The controller of the present invention is designed specifically for unattended or remote control of any process requiring one of more fluid or gas control valves to be opened or closed at specific times, pressures, or flow specifications.

Unlike other controllers, the present controller has no display or keypad for operator input. All communications to and from the controller are through an RS232 serial communications interface. Any hand held or portable computer having an RS232 serial port and running preselected software may be used to access the controller. A telephone modem or telemetry link to a central "host" computer may also permit several controllers to be accessed without an on-site operator Security and individual controller selection is provided by a specific "password" code entered by the operator during initial programming. The physical form of the controller may take any shape required for above ground, subsurface, underwater, or down-hole installation.

The controller of the present invention is totally flexible in both "hardware" configuration and "firmware" operating routines. After the required "input" devices and "output" control devices have been selected for a specific controller, one of several basic system programs may then be selected for optimum performance. The system programs are the fundamental operating routines for the general tasks that the controller must perform but do not include the specific variables and options for those tasks. The system program selected is down-loaded from an approved "host" computer into the controller only at its initial configuration. Unless an alternate system program is required, any and all subsequent inputs are limited to operator input variables and options or normal system commands. Both "hardware" and "firmware" may be changed at any time to meet changing task requirements.

The controller of the present invention is modularized to separate its functional components and permit on-site hardware configuration. Several modules having different options and controls may be selected and connected or changed as required. The controller input and output driver capacity may be expanded by the addition of one or more "I/O" modules.

A benefit of the present invention is the reduction in cost resulting from the manufacture of a controller without a keypad or display. One hand held computer or device having a keypad and display, may be used by an operator to gain access to a number of controllers in the field.

Another benefit of the present invention is the inherent security provided for against unauthorized modification of operator variables and operator options through the use of the communication port and security password.

Yet another benefit of the present invention is a controller having detachable manually programmable key pad switch means for entering well control parameters and having a detachable display for convenient and easy control and readout by and to an operator of well operating limits, conditions, and performance.

Still another benefit of the invention is the provision of a controller which permits a record to be logged of well production and overall performance without additional equipment.

Yet another benefit of the present invention is a controller having a telephone modem or telemetry link whereby a number of controls may be linked to a central computer to provide access to controllers in the field without an on-site operator.

Still yet another benefit of the present invention is a hand held computer having a keypad and display to download well performance data from a plurality of well head controllers precluding operator errors in transcribing the data manually.

An additional benefit of the present invention is a hand held computer for efficient collection of well performance data from a plurality of well sites.

Other benefits and advantages of the present invention will become apparent to those skilled in the art upon a reading and understanding of this specification.

BRIEF DESCRIPTION OF THE DRAWINGS

The invention may take physical form in various parts and arrangements of parts, the preferred embodiments of which will be described in detail in this specification and illustrated in the accompanying drawings which form a part hereof and wherein:

FIGS. 7A–7D5 form are software flow charts representative of the function control algorithms for the control of various well configurations; and, FIGS. 8A–8E are software flow charts representative of typical auxiliary delay flow routines of the present invention.

DETAILED DESCRIPTION OF THE INVENTION

Figure 1:
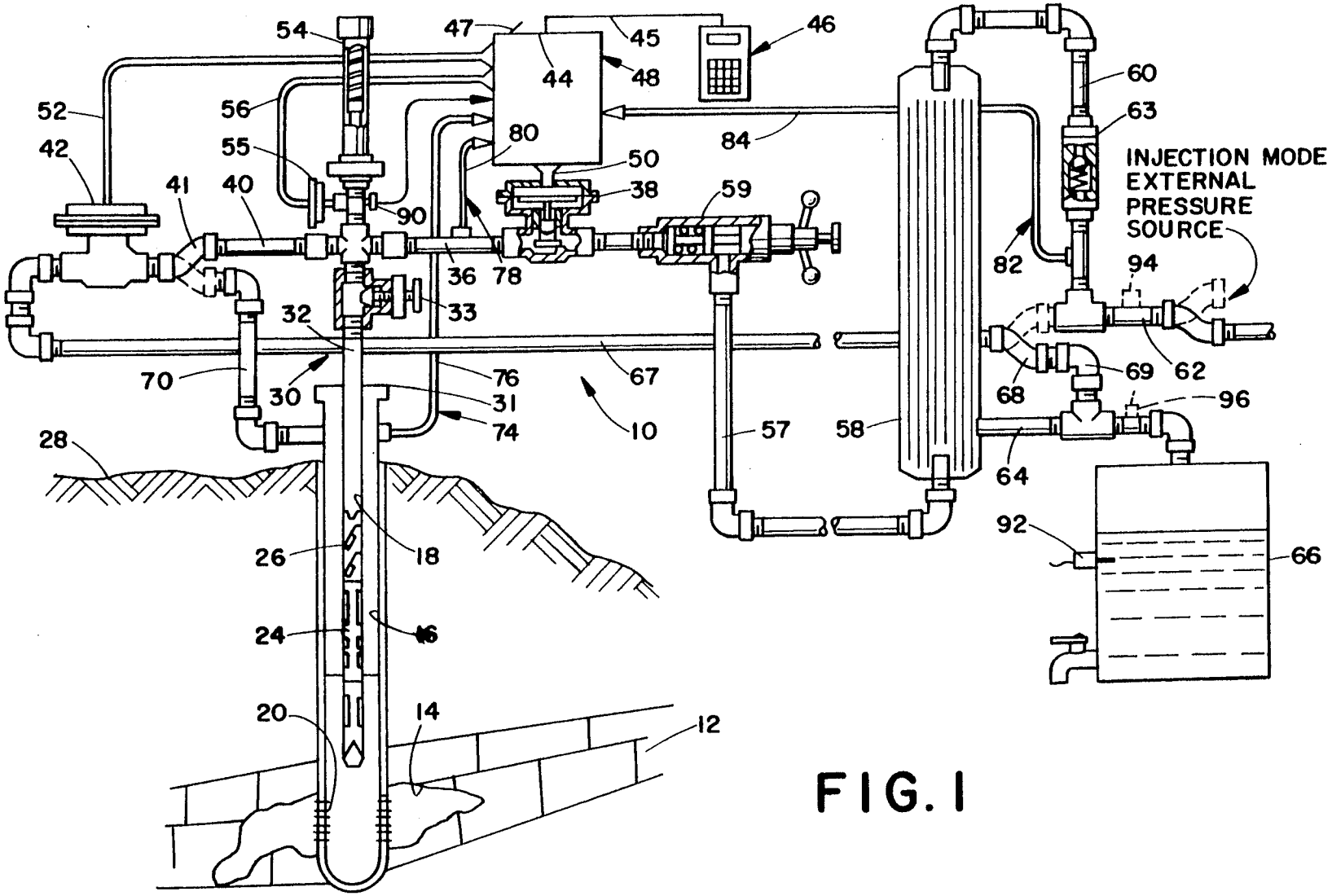
FIG. 1 is a sectional schematic view of a gas and oil well installation formed in accordance with the present invention showing its components sectionally and out of scale.

Referring now to the drawings wherein the showings are for purposes of illustrating the preferred embodiments of the invention only and not for purposes of limiting same, the figures show a gas and oil well installation including a controller for controlling the flow of product from the well. More specifically, and with reference to FIG. 1, the well installation 10 is constructed at an oil and gas bearing formation 12 including a fracture 14 communicating oil, water, and gas to a well casing 16 and a tubing 18 contained therein through casing perforations 20. The installation of the well casing and tubing is accomplished by well known and conventional well drilling and installation techniques. The tubing includes a plunger lift device 24 to facilitate the removal of fluids 26, such as oil and water, accumulated above the plunger lift device from the tubing 18. The construction and operation of plunger lift devices are also well known in the art (see U.S. Pat. No. 4,150,721).

The casing and tubing extend from the formation 12 to above the ground level 28 toward the tubing top portion 30 which extends from the casing 16 and is sealed into the casing with a conventional sealing cap 31. The tubing top portion 30 includes a first tubing section 32, which has positioned therein an on-off valve 33. The to portion further includes a first tubing conduit 36 leading to a first production valve 38 and a second tubing conduit 40 leading through an elbow joint 41 to an auxiliary production valve 42. The first and second tubing conduits 36, 40 are in fluid communication with the first section 32 and can extend oppositely therefrom as illustrated. Valves 38, 42 are conventional gas and oil well production valves which are opened and closed by a controller 48 in operative communication with them through respective communication lines 50, 52.

The tubing top portion 30 also includes a lubricator 54 configured to receive and absorb the impact of the plunger 24 as it arrives at the top of the tubing string. Provided adjacent the lubricator 54 is a means for holding the plunger at the top of the tubing. In the embodiment shown, the means is a control valve 55 which is connected by a communication line 56 with the controller 48. The holding means is advantageous for greatly simplifying the inspection and servicing of the plunger by holding it in the lubricator 54 at the top of the tubing 32. The plunger is usually held after a specified number of cycles.

The controller 48 is equipped with a safety switch 47 provided to shut in the well head in the event of an emergency. When the safety switch 47 is closed, the controller 48 forces a valve close signal to all valves connected thereto effecting an override of the control logic. The controller 48 is also equipped with a serial and parallel communication port 44 for operator access to operator variables and options using a detachable computer device 46 via communications link 45. The detachable computer device provides an operator a means for entering well control parameters and for convenient readout of well operating limits, conditions, and performance. Further, the detachable computer device is utilized automatically when it is first connected to the controller and may be removed from the well site without affecting the performance of the controller 48. It may then be used by the operator at a next well head installation using the controller of the present application upon proper security password entry at the next site.

The communications port 44 may also be connected to a printer device to obtain a hard copy of well performance data or other pertinent operational data. To obtain performance data from a number of well site installations, a central host system may poll each individual control 48 via telemetry link and modems local to each controller 48 through serial and parallel communication port 44.

Downstream from production valve 38 is third conduit section 57 which communicates well product to a separator 58 for separating oil and water from the gas component of the product. A variable choke 59 is preferably provided in the third conduit section 57 to control the flow rate through the conduit Gas is communicated from the separator 58 through a fourth conduit section 60 to a gas sales line 62. Preferably, a sales line check valve 63 is provided in the fourth conduit to prevent reverse flow of gas when sales line pressure is greater than well pressure.

Oil and water are communicated from the separator 58 through a fifth conduit section 64 to an oil and water storage tank or battery of tanks 66. The auxiliary production valve 42 is also in direct communication with storage tank 66 through a sixth conduit section 67, an elbow joint 68, and a tubing section 69 which leads to the fifth conduit section 64 for the transmission of oil and water to the tank according to the method as will be hereinafter more fully explained.

A lift gas, when using the casing injection method, can be introduced from an external pressure source through line 62 and the elbow joint 68 when in the position shown in the dotted outline of FIG. 1; the tubing 67, through the 'B' valve 42, the elbow joint 41, when in the position shown in the dotted outline, and a conduit section 70 into the casing 16, as will be described hereinafter. Naturally, whichever conduits the elbow joints 41, 68 are disconnected from, are closed off.

The varying well operating characteristics incidental to any gas and oil well are observed according to the present invention by a number of sensing devices. With continued reference to FIG. 1, the sensing devices include a casing pressure sensing means 74 comprised of a conventional pressure sensing device which senses a parameter directly related to and representing the pressure in the well casing. The parameter is communicated to the controller 48 through a casing read line 76 in operative communication with the controller 48. A tubing pressure sensor means 78 senses the pressure in the first tubing conduit 36 upstream of the first valve 38. The sensor means 78 communicates with the controller 48 through a read line 80. Sales line pressure in conduit 60 is detected through a tubing sensor means 82 and is likewise communicated to the controller 48 through a read line 84. As will be described hereinbelow, the sensor means 74, 78, 82 can be transducers located in the housing of the controller 48 and communicate with the respective casing tubing sections through the respective read lines 76, 80, 84. It should, however, be recognized that other conventional types of sensor means, which may be located either in the controller box or in the respective lines, for sensing these pressures could also be utilized A plunger sensor 90 is included in the tubing top portion to detect when the plunger lift device 24 has been urged to the top of the tubing through pressure in the casing 16.

A temperature sensor 92 can be provided in the oil and water storage tank 66 to detect the temperature of the tank 66 and communicate a parameter indicating the temperature to the controller 48 through a read line (not shown). The controller has the capability to shut in a supply valve (not illustrated) used to provide a heating means for the storage tank which is necessary for more complete separation of oil and water prior to shipment. It is within the scope of the invention to include other known types of well installation sensors and detecting devices such as an oil and water storage tank fluid level indicator to indicate a full tank, separator sensors to indicate separator conditions and other similar types of sensing devices.

Additionally, a flow sensor 94 can be placed in the gas sales line 62 to measure the flow of gas therethrough is desired. A similar flow sensor 96 can be positioned in the fifth conduit section 64 to measure fluid flow therethrough if desired.

Figure 2:
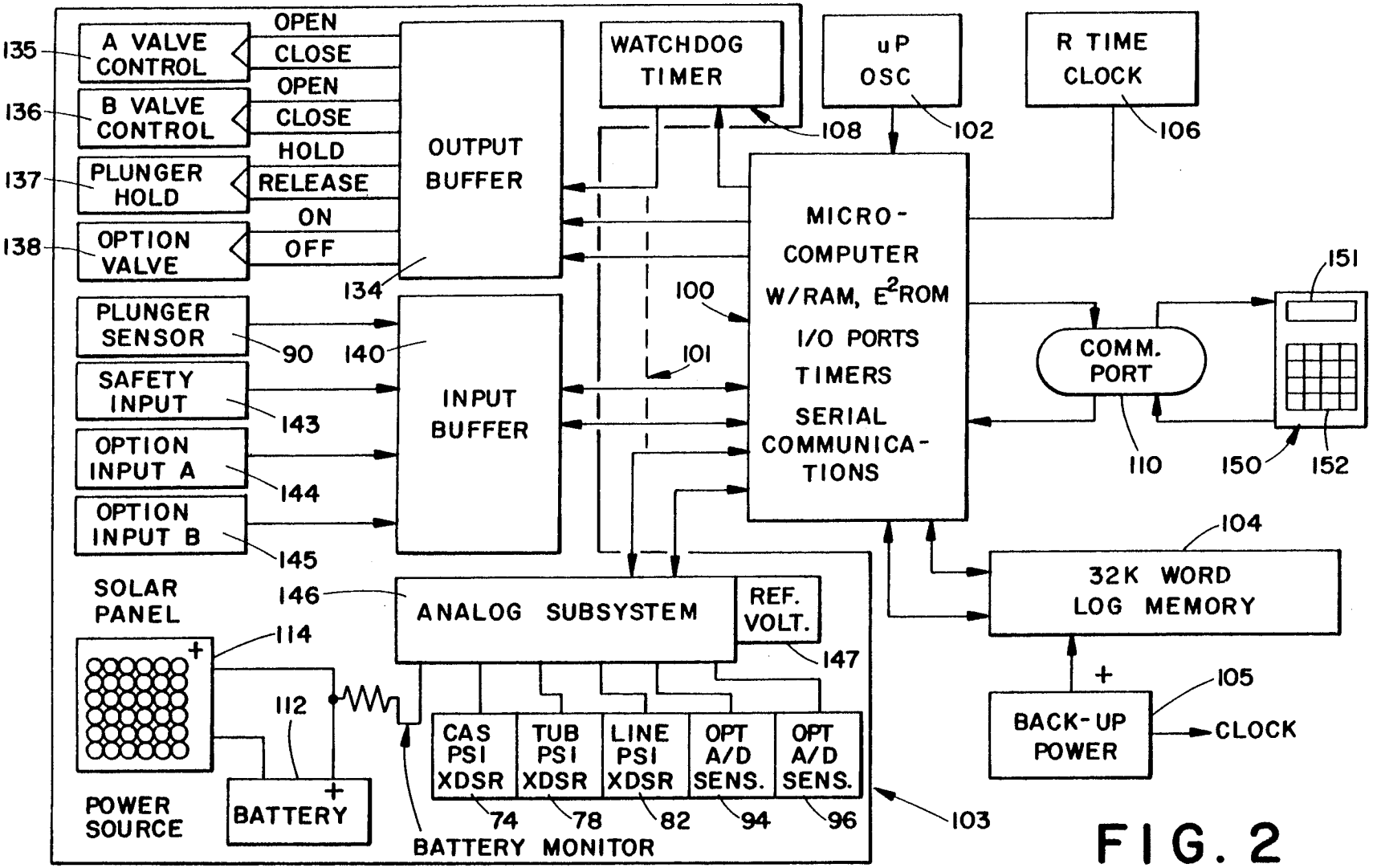
FIG. 2 is a functional block diagrammatic schematic showing a control system formed in accordance with the present invention.

With reference now to FIG. 2, a functional block diagrammatic of a schematic controller formed in accordance with the present invention is illustrated. The control system is configured around a low power CMOS microcomputer 100 with on-chip serial communication interface, RAM, program memory, and bidirectional I/O lines. Although several semiconductor manufacturers offer similar devices, the Motorola MC68CH805 series is currently preferred. These microcomputers offer sufficient ports with internal memory, timers, and communications circuitry to minimize the size, power, and complexity of the device.

A precision timing circuit generating software interrupts to the microcomputer at selectable rates of 2 to 128 times per second, provides the basis for a "real time clock" 106, and high speed input sampling.

Included in the CPU module of the present invention is an RS232 interface IC type MAX232 which provides standard voltage levels for direct communications interface with external "host" computers.

The system program down-loaded from a "host" computer through the serial communications port 110 is stored in the non-volatile program memory. The program may not be changed or erased except by means of an external computer running an authorized program. This permits on-site configuration changes and updates of the controller system.

In addition to the normal on-chip static ram used for registers and stack, the microcontroller has a serial peripheral interface system which communicates with nonvolatile serial RAMs 104. These memory devices store the operator variables or options and log records of specific events which may be communicated to the "host" computer upon request The size of the serial RAM memory is an option which may be increased or decreased as required.

The on-chip I/O lines are terminated at the CPU module edge-connector 101 for connection with the I/O modules 103. All communication and control of inputs or outputs, with the exception of the serial communications port, are through these lines. Power for the CPU module is also provided by an I/O module 103.

One or more I/O modules 103 may be connected to the CPU module to support a variety of input sensors and output devices. Each I/O module may also have options and functions added or deleted if required, but all are interchangeable in the controller system.

Power for the system may range 4.5 volts to 18 volts. Typically, a rechargeable battery 112 with a solar power charging circuit 114 is used, but power may also be input with an AC to DC converter. A regulator circuit in the I/O module limits the power to the CPU module and interface devices to a maximum of 5 volts. The actual system power voltage level is monitored by the system program for low-power detection.

The control valve driver circuit is isolated from the logic 5 volt supply and uses the unregulated system power to pulse the "open" or "close" coils of the valves. The operating voltage of the valves must match the system power voltage. Each I/O module may directly drive three latching type control valves and two optional valves.

Every I/O module has two "latched" input lines and four "sampled" input lines to detect momentary and actual external switch closures respectively. The inputs may indicate plunger arrivals or any number of safety or limit devices As with all I/O lines, the function of these lines are determined by the selected system program and operator selected options.

The standard I/O module 103 includes a 16 bit analog subsystem 146 with six input channels. Three of the analog channels are connected to strain gage amplifiers, with a fourth as optional, for input of strain gage type pressure or flow transducers. Excitation voltages for the strain gage type devices are provided by drivers individually synchronized with the analog subsystem to reduce unnecessary power drain.

A temperature sensor may be provided for automatic temperature compensation of the strain gage calibration factors within the $-25°$ to $+135°$ range. The sensor output is connected to an input channel 94 of the analog circuit.

A nonvolatile RAM circuit is also included with the analog circuits to store all calibration and offset voltage levels for the analog input devices. All calibration of the analog pressure or flow sensors are automatically calculated by the system program during initial installation with entry of actual values.

The "real time clock" 106 is a software construct based on a precision interrupt clock circuit and provides the date and time data for the log memory 104 and a once per second system update of time registers and input/output functions. The microcomputer "wakes up" from a low power standby mode with each interrupt input and returns to a low power "sleep" mode when required operations are completed. All operations except active communications routines are completed within a small fraction of a second.

An independent "watchdog" timing circuit 108, which can be designed from a 4528 dual precision timer, provides system failure detection by initiating a system restart and direct shut-in override to the production valve if it is not reset once each second during the normal program sequence The timing circuit 108 will close all control valves and reset the microcomputer 100 in the event of program failure or control system malfunction.

A communications port 110 is controlled by the internal communications circuitry of the microcomputer 100. Security access codes and commands are all accepted through the communications port and all data and output messages are transmitted using ASCII (American Standard Code for Information Interchange).

The power supply may consist of storage battery 112. An external solar panel 114 or a portable recharge power pack (not shown) can be used for recharging the battery Alternatively, discardable dry cells can be used for the battery 112.

It is a feature of the invention that the controller 48 consumes a minimum amount of power in operation. To further facilitate a capability for lengthy unsupervised operation, the solar panel 114 can be employed to supply power to the controller and recharge its battery 112.

All operator commands are entered through the communications port 110. The controller 48 of the present invention has no attached operator control panel, but rather provides a 25 pin sub-D type communications port 110 which permits either serial or parallel data transfer. Access to the controller 48 is only possible, however, after transmission and acknowledgement of a password or ID character string unique to each specific controller A small hand held computer 150 having a display 151 and a keypad 152 may be used by an operator to gain access to the operation variables and options within the controller 48 after entry of the proper password or ID character string.

The system display 151 is preferably a one or two line LCD alpha-numeric display module, such as the H2570 or LM052 self contained display modules capable of displaying both upper and lower case letter, numbers, and special characters Such modules accept ASCII code input and commands from the microcomputer and perform all necessary data storage and refresh functions internally. The display 151 indicates status, time, and pressure parameters, as will hereinafter be more fully explained.

An expandable output buffer 134 is included in the preferred configuration for control of up to four independent control valves. The buffer circuit terminates with a low input darlington or mosfet power driver which enables either an open coil or close coil of a pulse type, two position pneumatic control valve 135–138. The pneumatic valve can be similar to the VALCOR 54P193 series or the CLIPPARD EV3M/R302 series. Available gas well pressure, regulated by a WILKERSON R10-01 or an equivalent regulator, is used by the pneumatic valve to open or close a large production control valve, such as TELEDYNE MB40 or KIMRAY 2200SMT type (FIG. 1, 38, 42). The plunger catching device (FIG. 1, 55) uses a similar pneumatic valve arrangement to move a "trap pin" into the tubing below the plunger when it is in the lubricator (FIG. 1, 54).

An expandable input buffer 140 is included to enable immediate response to input signals from various sources. Typical switch inputs comprise a plunger lift sensor 90 and various safety sensors which may also indicate system component failure. One such sensor could be a safety input 143, such as a limit switch which would indicate that the oil and water storage tank is full. Another input could be a safety switch that would indicate the failure of an installation component such as a valve which could be an option input 144 or 145, as shown The gate 140 can be directed to sense or ignore any of the inputs and to cause an "interrupt" , which will require an immediate response.

An analog subsystem 146 is configured around a six channel analog to pulse width converter (Motorola 14443) and a quad differential opamp. The system is isolated from the main power and provides a precision reference voltage 147 for transducers 74, 78, 82 through synchronized drivers.

The analog devices can comprise such installation components as pressure transducers 74, 78, 82, flow rate transducers 94, 96, temperature probes, tank level indicators, and battery voltage monitors. These devices are monitored to ultimately control the production control valve. It is a particular feature of the invention that active control of the production valve can be delayed while a specific pressure limit or input is "double checked" for a selected time period to ensure its validity and prevent premature opening or shutting-in due to spurious fluid or pressure fluctuations.

Control of the subsystem by the microcomputer results in an analog to digital converter capable of greater than 16 bit resolution An analog input may be resolved into more than 65,000 parts. An example of the usefulness of this data would be the measurement of the casing pressure using a transducer which may be rated as high as 4000 PSI full range. The output may be resolved to within +/−0.1 PSI. This measurement, with the tubing and line measurements, provide very high accuracy in determining differential and flow rate calculations. The microcomputer monitors ambient temperature and any analog subsystem drift to adjust the actual pressure calculations over a wide range of temperature and power supply variables.

One input of the analog subsystem is used to monitor the power supply 112. The power supply can, as mentioned, consist of a rechargeable storage battery and an external solar panel, or discardable dry cells. The analog input permits direct supply voltage readout and low battery warning.

It is another feature of the invention that internal circuitry and peripheral devices not required for immediate functions are shut down by the system to conserve power. The system is expandable through a device select and decode circuit (not illustrated) to include additional functions and interface modules. All components for the gas well controller circuit shown in FIG. 2 comprise well known commercially available elements.

The controller 48 does not function as a programmable controller, that is, a sequencer, but rather its function is specifically designed for production of various types of oil and gas well configurations. The type of production used for a given well determines the selection of a specific function algorithm to control the well A set of operator variables and operator options is made available based upon the function algorithm selected FIGS. 3A–3D illustrate various well head configurations for which a distinct function algorithm exists to tailor controller performance. Other function algorithms may result from the application of the controller 48 to novel well head configurations, as well as to systems not directed to well heads at all, e.g., chemical process control.

Figure 3A:
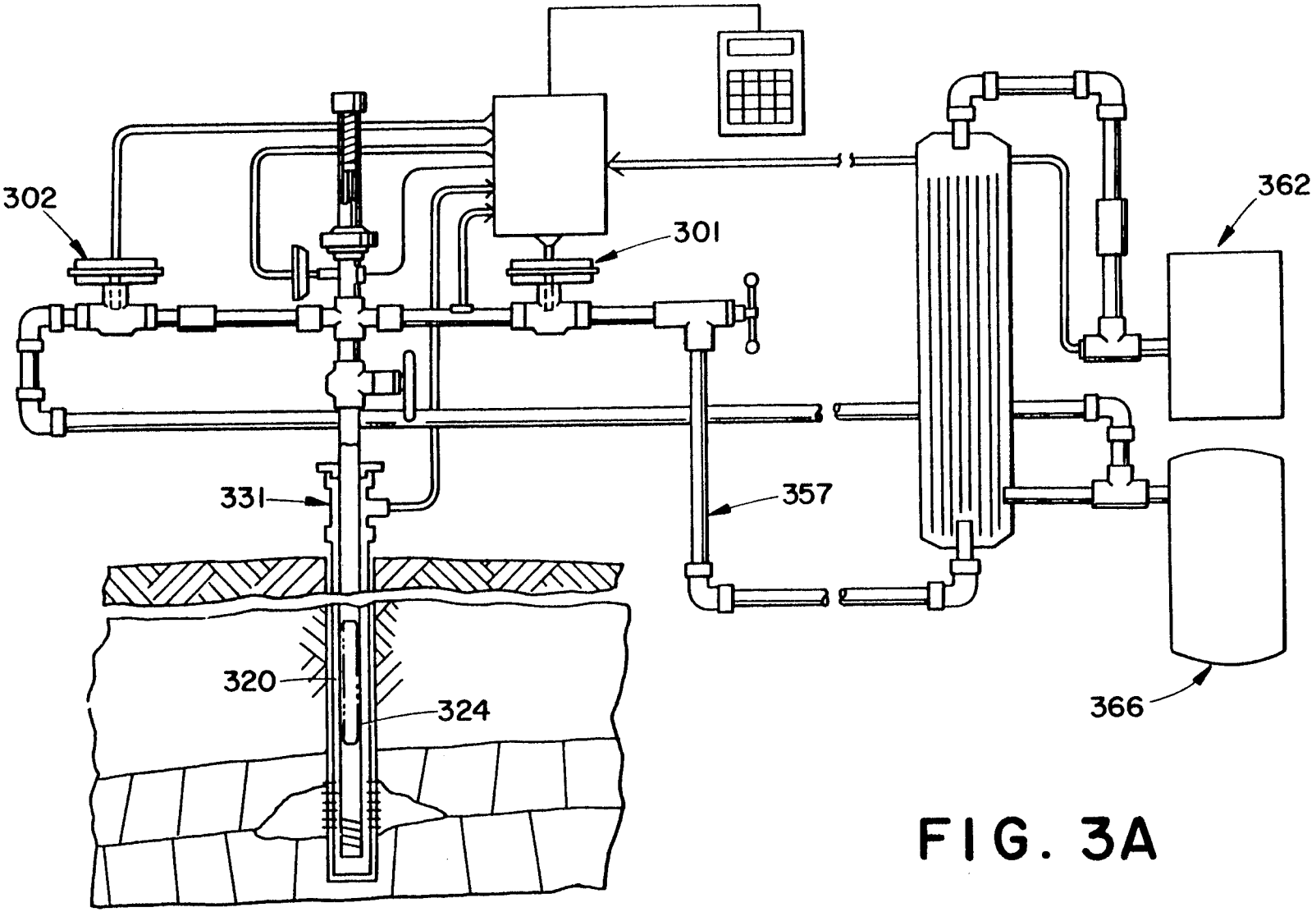
FIGS. 3A–3D are sectional schematic views of gas and oil well installations to which the controller of the present invention is particularly directed.

A "plunger lift" well is illustrated in FIG. 3A. The configuration may also include an optional bypass valve 302.

The 'A' valve 301 is opened for a specific time to permit the fluids 320 above the plunger 324 to flow into the fluid storage tank 366. Upon plunger arrival, the 'A' valve 301 may then be closed or delayed in closing (purge) to permit sale of gas until the 'A' valve open time is zero.

High sales line 357 pressure may prevent the plunger 324 from being lifted to the top within the allowed 'A' valve open time The 'B' valve 302 may be opened for a specific time ('B' valve open time), or until plunger 324 arrival, to dump the fluid directly into the fluid storage tank.

After plunger arrival or 'A' valve purge delay time, the valves 301, 302 are closed to permit the plunger 324 to return below accumulated fluids 320 and allow the casing pressure to build.

Figure 3B:
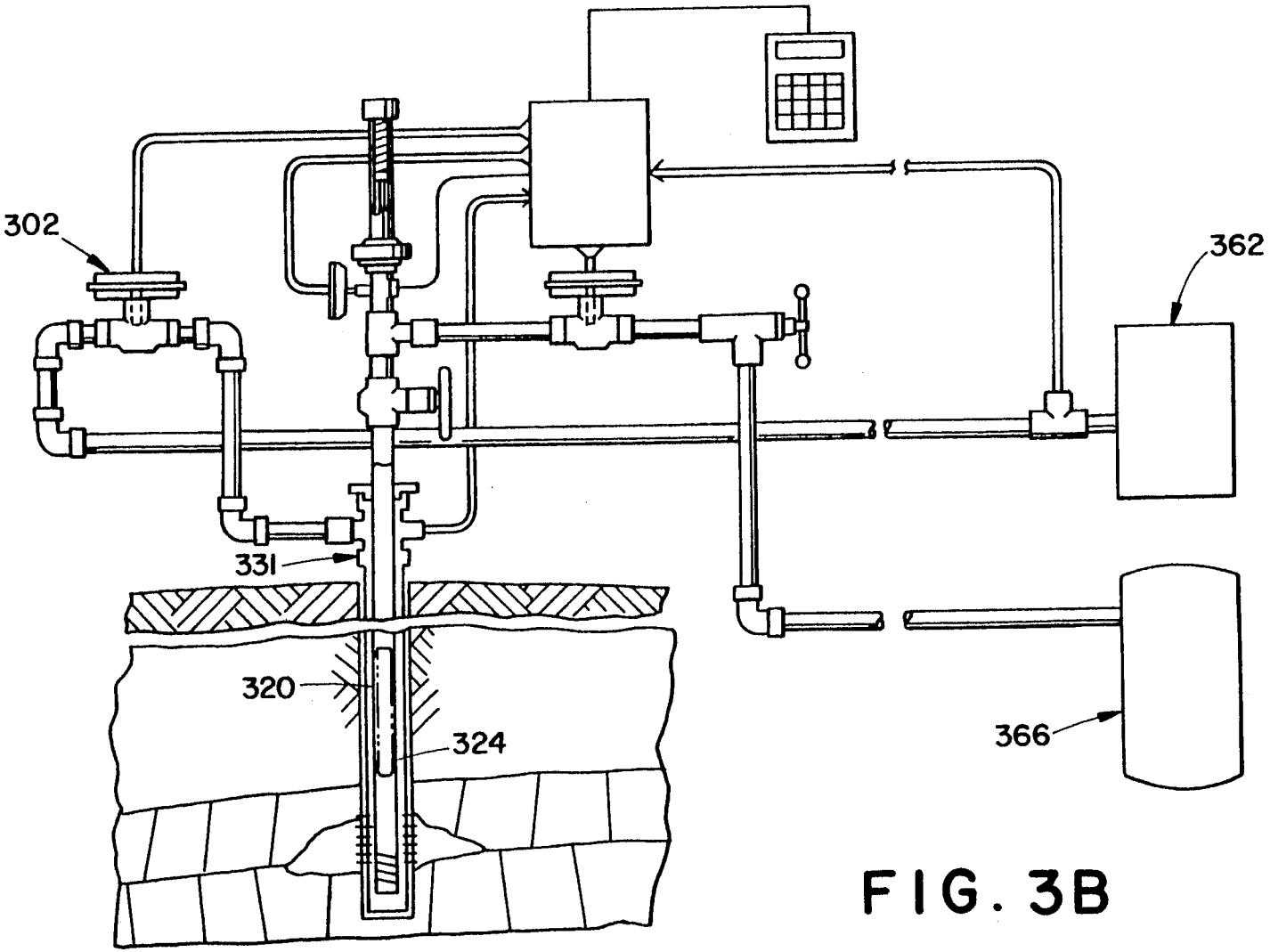

An injection type plunger lift well is illustrated in FIG. 3B. An injection type plunger lift well is characterized as having very low natural casing (rock) pressure.

The 'B' valve 302 (injection valve) is opened to an external source of high pressure gas 362 The casing 331 pressure is allowed to build to an appropriate level to lift the plunger 324 and accumulated fluids 320. The 'A' valve is then opened to permit the flow of fluids into the fluid storage tank 366. The 'A' valve is closed upon plunger arrival, time out of allotted 'A' valve open time, or low casing pressure limit.

The plunger 324 is allowed to return below the accumulated fluids 320 during 'A' "close time" before the 'B' valve 302 is reopened to again build the casing pressure.

Figure 3C:
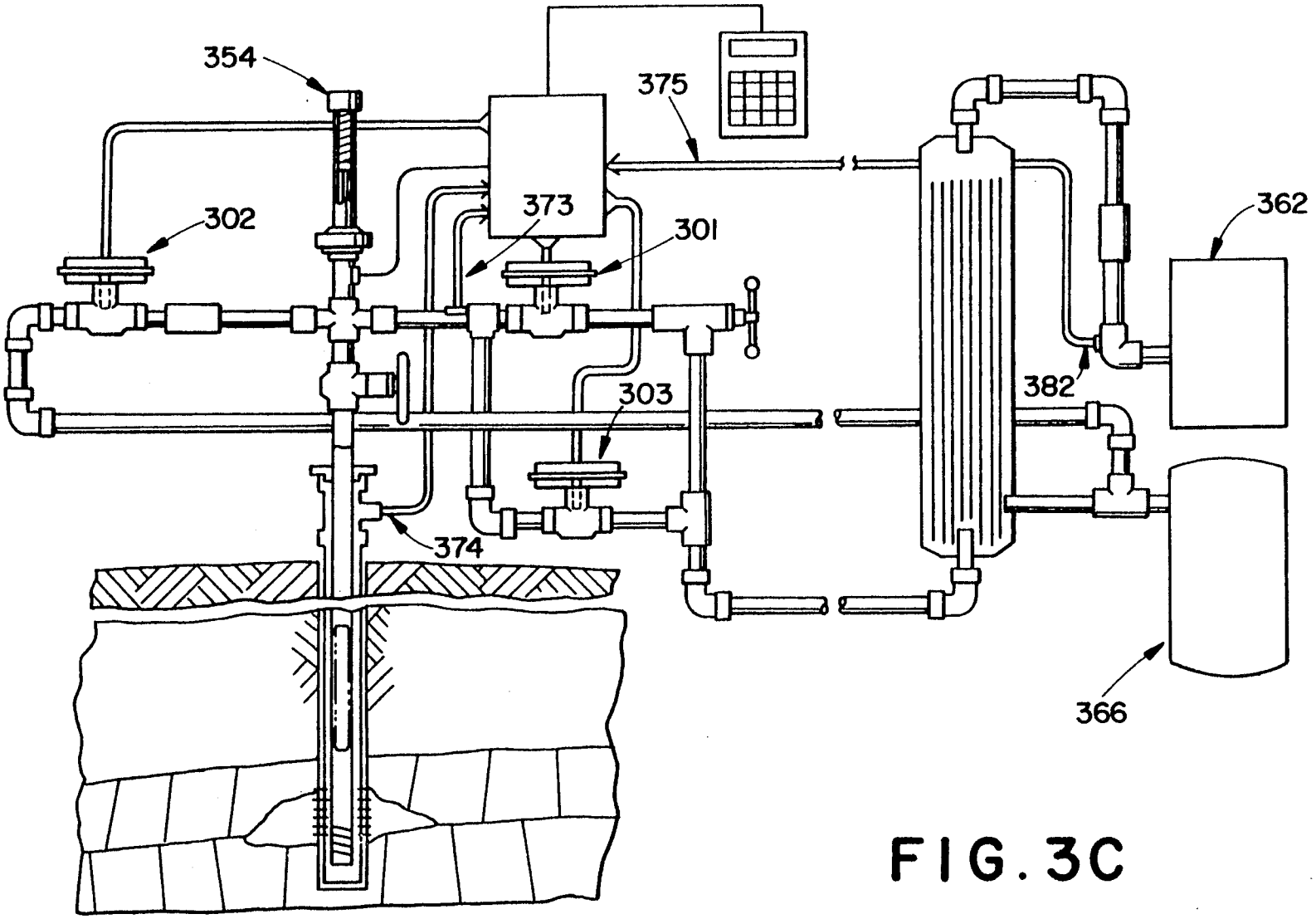

A plunger lift well with optional bypass and second stage choke is illustrated in FIG. 3C.

The two stage choke using the 'A' valve 301 and the 'C' valve 303 are both part of the sales control for use in high pressure gas wells to limit the force of the flow of fluids into the fluid storage tank 366 or the force of the plunger arrival at the top of the tubing string 354 before opening to a larger orifice.

The bypass valve, 'B' valve 302, may used as described in the plunger lift well for additional control. The tubing pressure 373 is monitored in addition to the casing pressure 374 and the line pressure 382 for additional control. A flow control limit or flow factor for calculation of total fluid and gas production volumes may be derived by subtracting the line pressure 382 from the tubing pressure 373 for a differential value, and referencing this to the tubing pressure and known aperture or orifice openings.

The tubing pressure 373 may also be subtracted from the casing pressure 374 for a differential value which indicates fluid accumulation in the tubing. When the sales valves 301, 303 have open for a period of time and the casing/tubing differential increases to a predetermined set-point, the system will close the valves 301, 302, 303) and allow the plunger to drop below the accumulated fluids before reopening on a high casing pressure set point or time entry.

A low casing/tubing pressure differential may also be used with a high casing pressure set-point to initiate the sales cycle sequence for production requiring the equalization of gas through the accumulated fluids in the tubing.

Figure 3D:
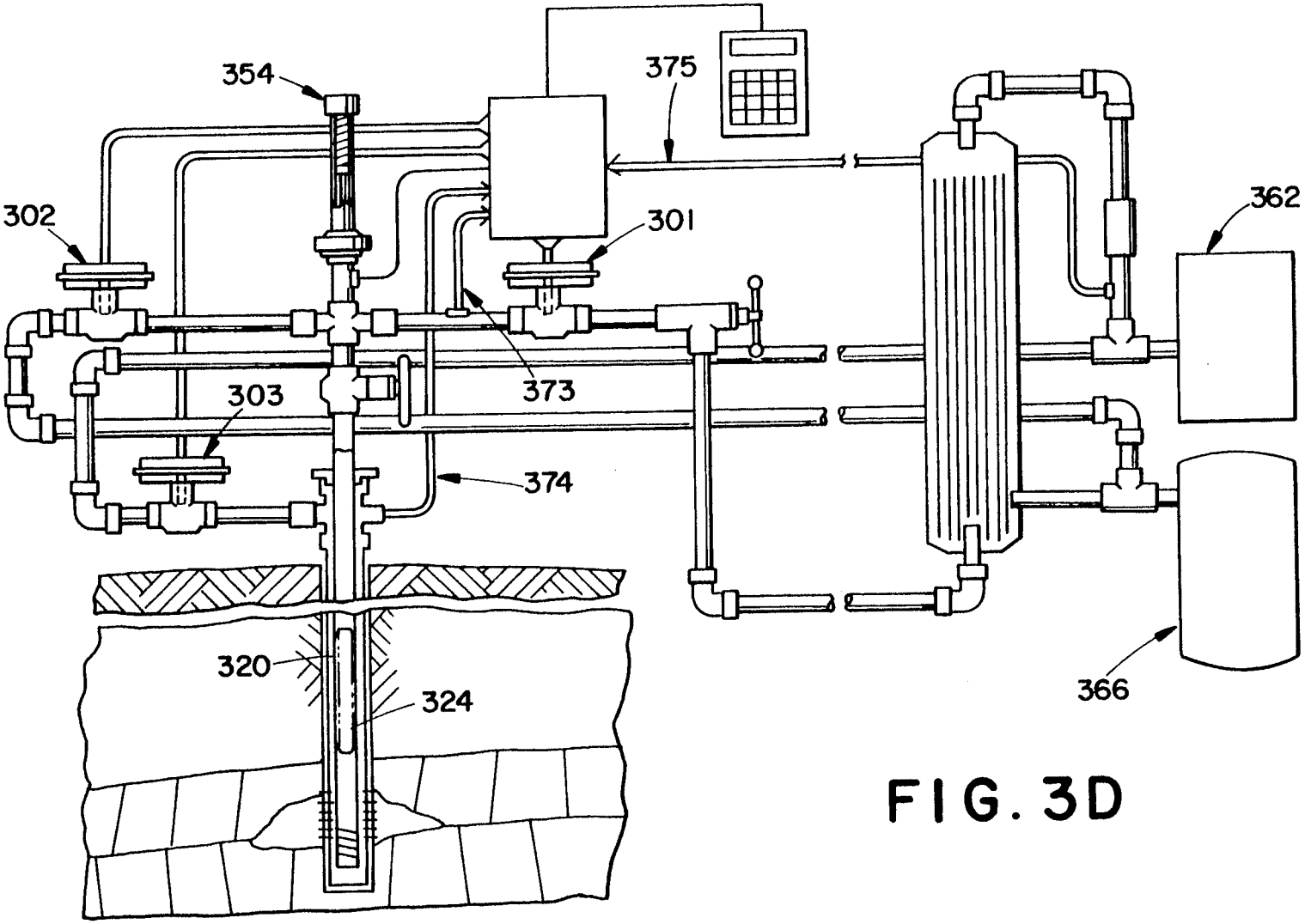

A plunger lift well which has marginal natural casing (rock) pressure and may occasionally require assistance in building its casing pressure to expel fluid is illustrated in FIG. 3D.

Figure 4A:
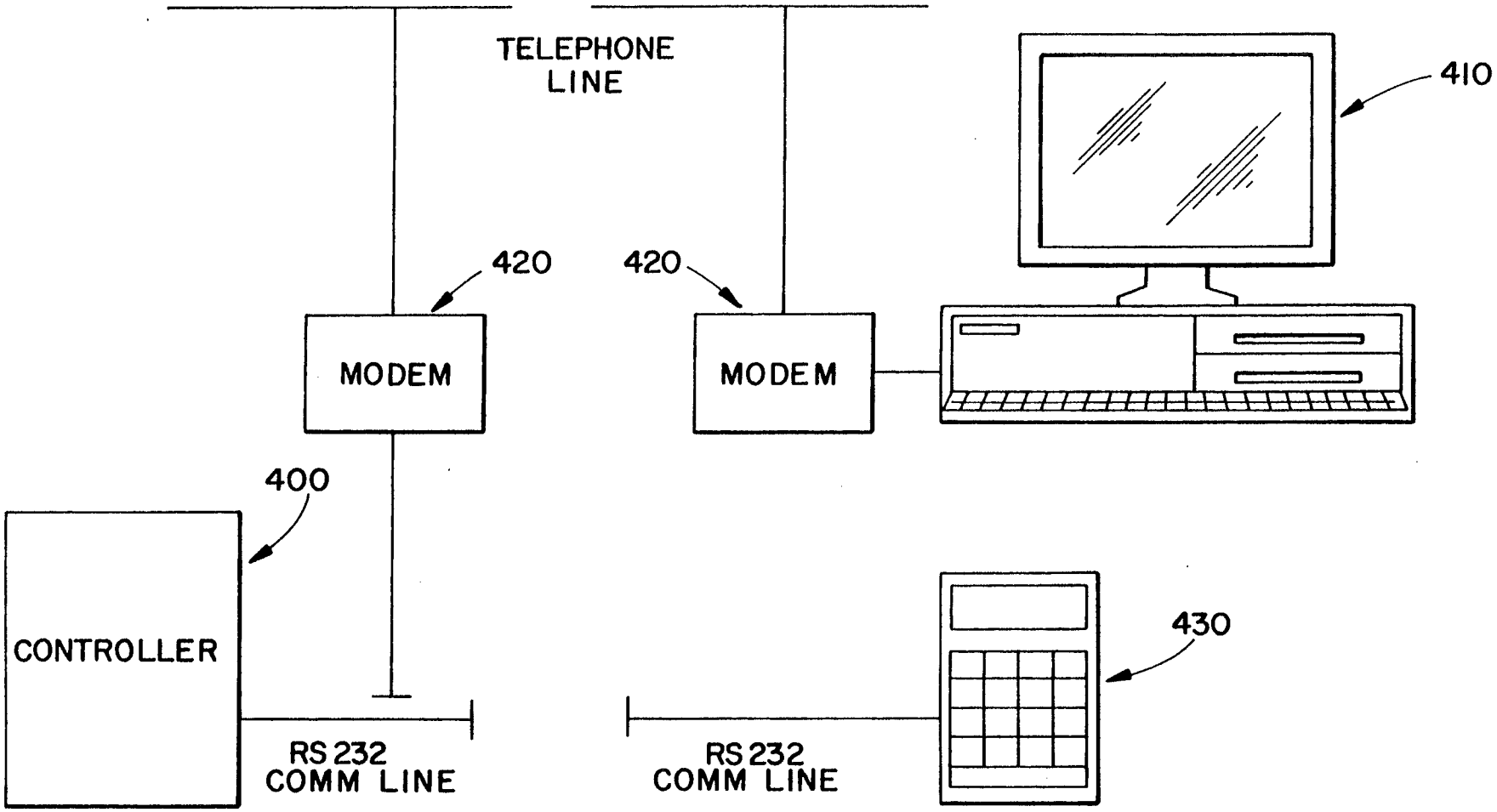
FIG. 4A is a function block diagram of the present invention shown with connections to a telemetry link and to a hand held computer.
Figure 4B:
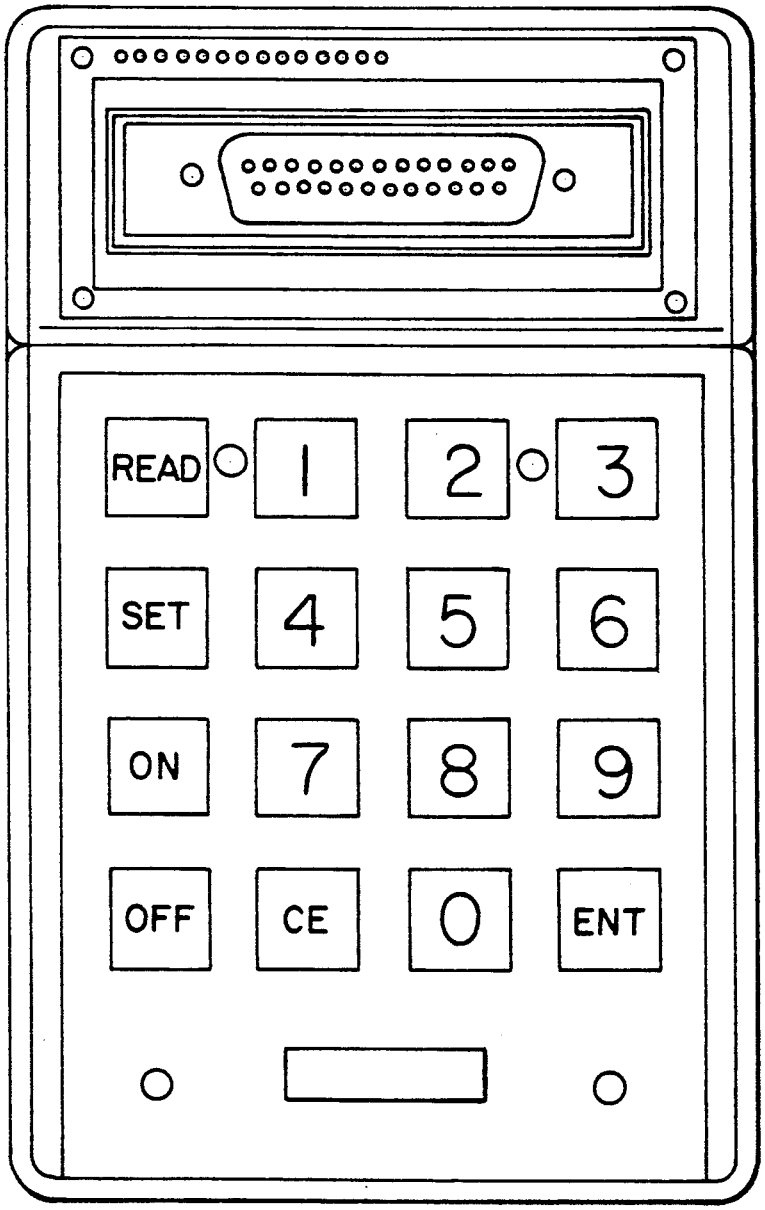
FIG. 4B is a front sectional view of the hand held portable computer of the present invention.

The algorithm permits the values 301, 302, 303 and inputs (tubing pressure sensor input 373, casing pressure sensor input 374, and sales line pressure sensor input 375) to be used as in a plunger lift well with optional bypass; however, if the natural casing pressure drops below a predetermined set-point when the bypass valve 'B' valve 302 is opened, and before the plunger arrives at the top of the tubing string 354 the 'C' 303 valve is opened to boost the casing pressure from an external source 362 and ensure the expulsion of the fluids 320. The greater the fluid accumulation, the greater the casing pressure required to raise it to the surface. Excessive fluid accumulation will require an expensive "swabbing" operation to put the well back into production. The controller of the present invention is a combination of hardware and software and must include at least one host computer running special software. The host computer may be any hand held, portable, or desktop IBM compatible computer with at least one serial communications port as shown in FIG. 4A. A ruggedized and simplified hand held unit is available for general purpose operator use as shown in FIG. 4B.

With reference to FIG. 4A, the IBM type computer 410 may be located at the field office and may communicate directly with the controller 400 via telephone modems 420 or receive data which has been stored on the hand held computer 430. The data may then be integrated into several data base programs or spread sheets to provide immediate production reports for each of the remote controllers.

The hand held unit 430 permits direct operator command and data entry to the controller and will store the log data for transfer to the IBM type computer 410. The hand held unit 430 also has the capability of downloading firmware programs into the controller.

The software used in the host computer 410 or 430 is a menu driven, user friendly program which will permit an operator to enter program variables (i.e., times and delays), select options (i.e., constants, limit functions, etc.), and read current status or past logged events. Logged data from the controller 400 may be saved to input into other statistical programs for analysis. All manual control commands are entered through the host computer with the exception of a shut-in switch (not shown) on the connecting panel of the controller. This shut-in feature is for safety and permits a fast method of closing all control valves and placing the controller into a shut-in mode which may only be escaped through commands of an authorized host computer. For security, the controller may only be accessed by an authorized host computer in which a password for the controller has been entered This password is established during initial configuration of the controller.

The system program for the controller must be entered from an authorized host computer through a special interface device (not shown) which permits the controller EEPROM to be cleared and rewritten. The interface device provides the requisite voltage and control signals to first erase, then program the EEPROM. It acts as a safety measure to prevent accidental program changes during normal operations and must be removed after initial configuration.

The system program which becomes resident in the controller, includes communication, timekeeping, and analog system routines. Special I/O options and functional algorithms which are selected during configuration determine the menu selection and options available to the operator. Any functions or options which are not required for the selected configuration, are not presented.

The operator variables and options available are directly dependent upon the functional algorithm chosen and the configuration options selected. An example would be if the dual valve/time/pressure production algorithm was chosen and the action of C valve option was selected as 'independent', then one of the operator variables would be the open and close time for C valve.

Some standard operator variables include the open and close times of the selected valves, the hi and lo pressure settings, the maximum and minimum differential settings, various delay times, and flow rate limits.

Some of the operator options include constant/non-constant time, plunger disable, action of hi/lo casing, action of hi/lo line, action of hi/lo differential, log event select, and log sample rate. To increase the flexibility of a given controller, some options are selected as "open" during the configuration program. This allows the operator to select or change the options as required without reconfiguring the controller.

The actual function of the controller after configuration will be a result of all operator variables entered or left open and all options selected This function will change with each modification of allowable options.

Referring to the keypad arrangement shown in FIG. 4B, the following basic commands are available to an operator:

| | |
|---|---|
| Read time/status | READ, 1 |
| Read delay times active | READ, 2 |
| Read casing PSI | READ, 3 |
| Read BOT or SI times active | READ, 4 |
| Read differential-active | READ, 5 |
| Read Line PSI | READ, 6 |
| Read C valve stat | READ, 7 |
| Display test data | READ, 8 |
| Read/set total cycles | READ/SET, 9 |
| Read battery voltage | READ, 0 |
| Read/set A open time entry | READ/SET, ON, 1 |
| Read/set high casing delay entry | READ/SET, ON, 2 |
| Read/set high casing limit entry | READ/SET, ON, 3 |
| Read/set B open time entry | READ/SET, ON, 4 |
| Read/set open diff entry | READ/SET, ON, 5 |
| Read/set high line limit entry | READ/SET, ON, 6 |
| Read/set C open time entry | READ/SET, ON, 7 |
| Read/set B open delay entry | READ/SET, ON, 8 |
| Read/set total on time | READ/SET, ON, 9 |
| Read/set input options | READ/SET, ON, 0 |
| Read/set A close time entry | READ/SET, OFF, 1 |
| Read/set A close delay entry | READ/SET, OFF, 2 |
| Read/set low casing limit entry | READ/SET, OFF, 3 |
| Read/set shut-in time entry | READ/SET, OFF, 4 |
| Read/set close diff limit entry | READ/SET, OFF, 5 |
| Read/set low line limit entry | READ/SET, OFF, 6 |
| Read/set C close time entry | READ/SET, OFF, 7 |
| Read/set plunger delay entry | READ/SET, OFF, 8 |
| Read/set total shut-in time | READ/SET, OFF, 9 |
| Read/set output options | READ/SET, OFF, 0 |
| Read/set A open delay entry | READ/SET, ENT, 1 |
| Read/set real time clock | READ/SET, ENT, 2 |
| Read/set casing offset entry | READ/SET, ENT, 3 |
| Read/set total B valve cycles | READ/SET, ENT, 4 |
| Read/set diff offset entry | READ/SET, ENT, 5 |
| Read/set line offset entry | READ/SET, ENT, 6 |
| Read/set C delay entry | READ/SET, ENT, 7 |
| Read/set B close delay entry | READ/SET, ENT, 8 |
| Read/set B valve cycles | READ/SET, ENT, 9 |
| Read/set function options | READ/SET, ENT, 0 |
| SET, ENT, * | Enable calibration menu [CS (casing); LN (line); TB (tubing); AX (auxiliary flow); BT (battery)]<br>* where:<br>CE = escape from menu<br>ENT = move to next<br>ON = set or enable for value entry<br>OFF = clear or clear value entry<br>0 = zero offset value |
| 0, ENT, 0 | Clear all calibrated values/ all inputs/ all options |
| ON, ENT | Manual Start |
| OFF, ENT | Manual stop |
| ON, 4 | Manual B valve open |
| OFF, 4 | Manual B valve close |
| ON, 7 | Manual C valve open |

-continued

| | |
|---|---|
| OFF, 7 | Manual C valve close |
| ON, 1 | Manual A valve open |
| OFF, 1 | Manual A valve close |
| 5, ENT, READ | Read current tubing/line flow rate calculation |
| 5, ENT, SET | Read/clear total gas flow volume calculation |

The above commands are recognized in the function table and stored in the microcomputer memory. The commands are self-explanatory from the table In each case, the SET and READ buttons are used in entering the commands.

For example, the read or set open time window command is obtained by pressing first the READ button or the SET button then the 'ON' button and the number 1 button. This gives the maximum time allowable for the main production valve in the time cycle or differential mode. Alternatively, it gives the maximum open time allowable for the injection source valve in the injection mode The open time may be terminated in the injection mode by plunger arrival and purge delay time out, low Casing pressure, or 'B' valve time out. In the time cycle and differential mode, the open time window may not be terminated thus preserving the CONSTANT TIME feature which permits the synchronization of several wells of varying strengths into a single common sales line. Optional entries (hi casing, hi differential, or optional low line limits) may be made by the operator to terminate the close time window if input conditions permit and after all active delays have timed out.

As another example, the "READ, ON, 4" or "SET, ON, 4" command will give the maximum open time allowable for the bypass valve in the time cycle and differential modes and the maximum open time for the main production valve in the injection mode. The 'B' valve time may be terminated with the time out of the maximum open time window in the injection mode or plunger arrival or a low casing limit in all modes.

As a further example the "READ, ON, 2" of "SET, ON, 2" command will give the delay time which the system allows after a programmed limit has been exceeded. This delay smooths out irregular pressure measurements during expected or allowable pressure surges. After the delay, the system will take another measurement and if the limit is still exceeded, the appropriate limit flag is set for the action to be taken. The types of limits are assigned priorities and if a limit of a higher priority occurs, the current limit delay will be terminated. The high and low line limits are not delayed but initiate immediate action.

Another example is the "READ, ON, 3" or "SET, ON, 3" command which gives the high casing pressure limit. This limit becomes active when the casing pressure increases to greater than the limit value entered. This value is the minimum pressure limit required to initiate a production cycle in the time cycle or differential mode. If set, it will override the close time window but may not override any other times or limits. In the injection mode, this limit is used to close the injection supply valve and permit the conditional opening of the production valves.

Conversely , the "READ, OFF, 3" or "SET, OFF, 3" command will give the low casing pressure limit. This limit becomes active when the casing pressure falls below the limit value entered. When the limit is active, all production cycles are terminated. In the time cycle or differential mode, if the limit is exceeded while the main production valve is open, it will be closed and may not reopen until the completion of the open/close cycle. If any 'B' time has been entered and the plunger has not arrived, the 'B' valve will open to discharge fluids directly to the fluid storage tank if possible. In the injection mode, if the limit is still exceeded after the limit delay while the injection source valve is open, it will be closed and may not reopen until the completion of the open/close cycle. If any 'B' time has been entered and the plunger has not arrived the 'B' valve will open to discharge fluids directly to the fluid storage tank if possible. In the injection mode, if the limit is still exceeded after the limit delay while the injection source valve is open, insufficient source pressure is indicated and the open cycle will terminate. If the limit is exceeded while the production valve is open in the injection mode, the open cycle will be terminated.

It should be noted that the invention is not limited by the foregoing commands and entries. Additional functions or operations may be specified by appropriate modifications of the firmware.

The plunger arrival, safety input, keypad entry, communications port, and the real time clock all initiate an immediate response and actions by the microcomputer through its interrupt inputs.

All tests and functions are normally performed by the microcomputer within a few milliseconds. The system may then be shut-down for a large percentage of the remaining one second cycle to conserve power. Specific sections of the system, such as the analog subsystem, may be individually turned-on as required to further conserve power.

The controllers firmware routines provide the housekeeping required to update input or output status, read the analog inputs, drive the control valves, and communicate via the serial and parallel port. An independent "watchdog" timer, shown in FIG. 5, will close all valves and reset the system to a shut-in mode in the event of a systems failure.

Figure 5:
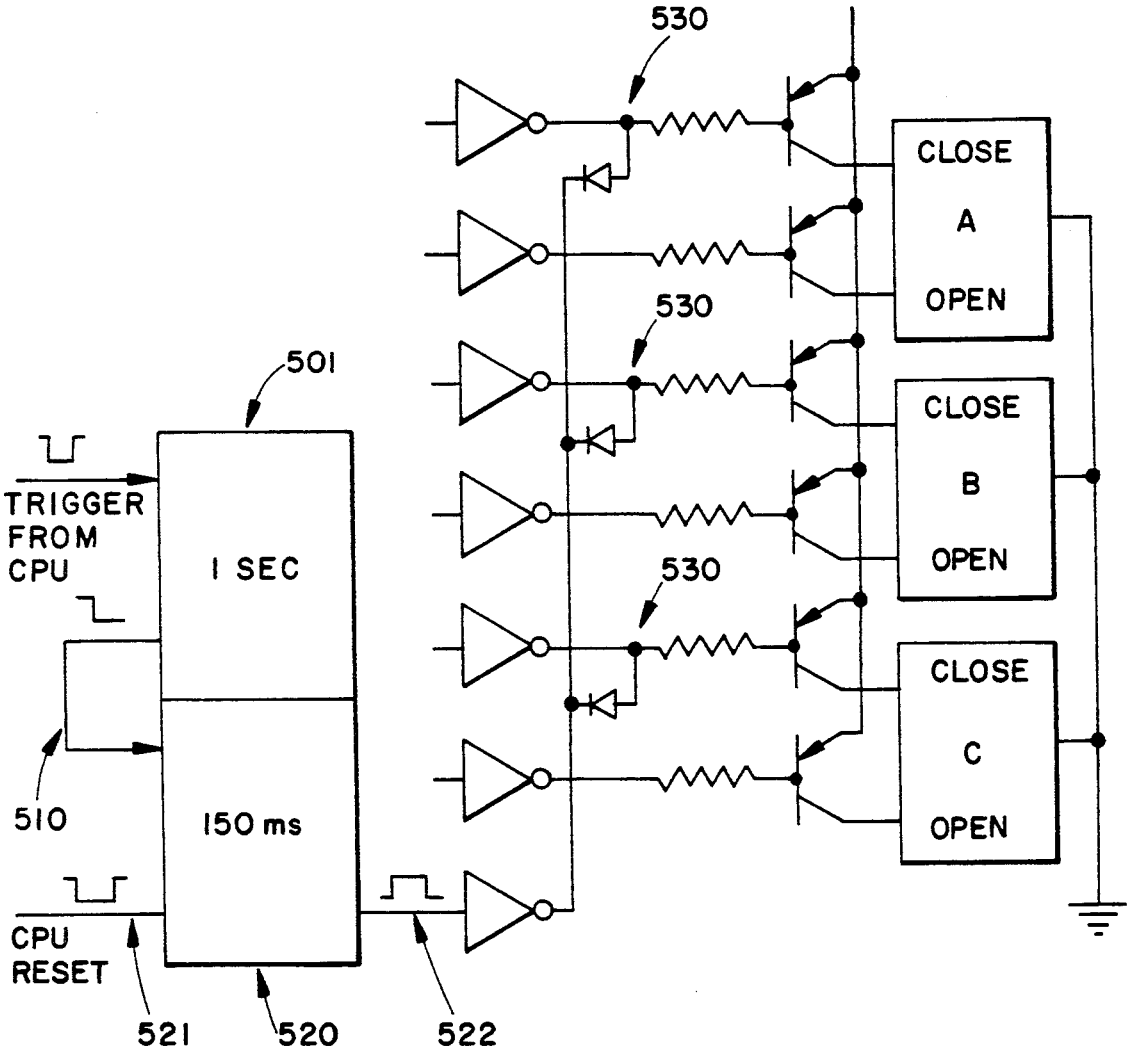
FIG. 5 is a schematic view of the watchdog timing circuit formed in accordance with the present invention.

With reference to FIG. 5, the processor of the present controller operates to generate a pulse having a period of less than one second. The pulse generated by the processor is transmitted to a 1 SEC timer 501 within the watchdog circuit. The 1 SEC timer 501 operates as a retriggerable multivibrator, if no pulse is output from the CPU within 1 second a trigger pulse 510 is then input to the 150 ms timer 520 which then outputs a negative going signal 521 to the CPU RESET input and a positive going signal 522 to a driver which, in turn, is connected to all the VALVE CLOSE coil drivers 530. All valves are then closed and the system goes to a non-operative reset condition until restarted by the operator.

The "function algorithm" is the heart of the entire system with all other functions and routines providing support or communications. The function algorithm uses status flags to determine its operation with the type and algorithm options selected. It may then directly control output drive routines, transfer times and delay, or change the status flags.

The present controller is not a "programmable controller". Its function has been specifically designed for production of various kinds of oil and gas wells. The function algorithm has been predetermined for optimum flexibility within the specific parameters required. The type of production used for a given well determines the selection of a specific algorithm. Within the algorithm, certain specific options are made available to the operator. This helps an inexperienced operator to optimize the well's production although complex cycling may be required.

Figure 6A:
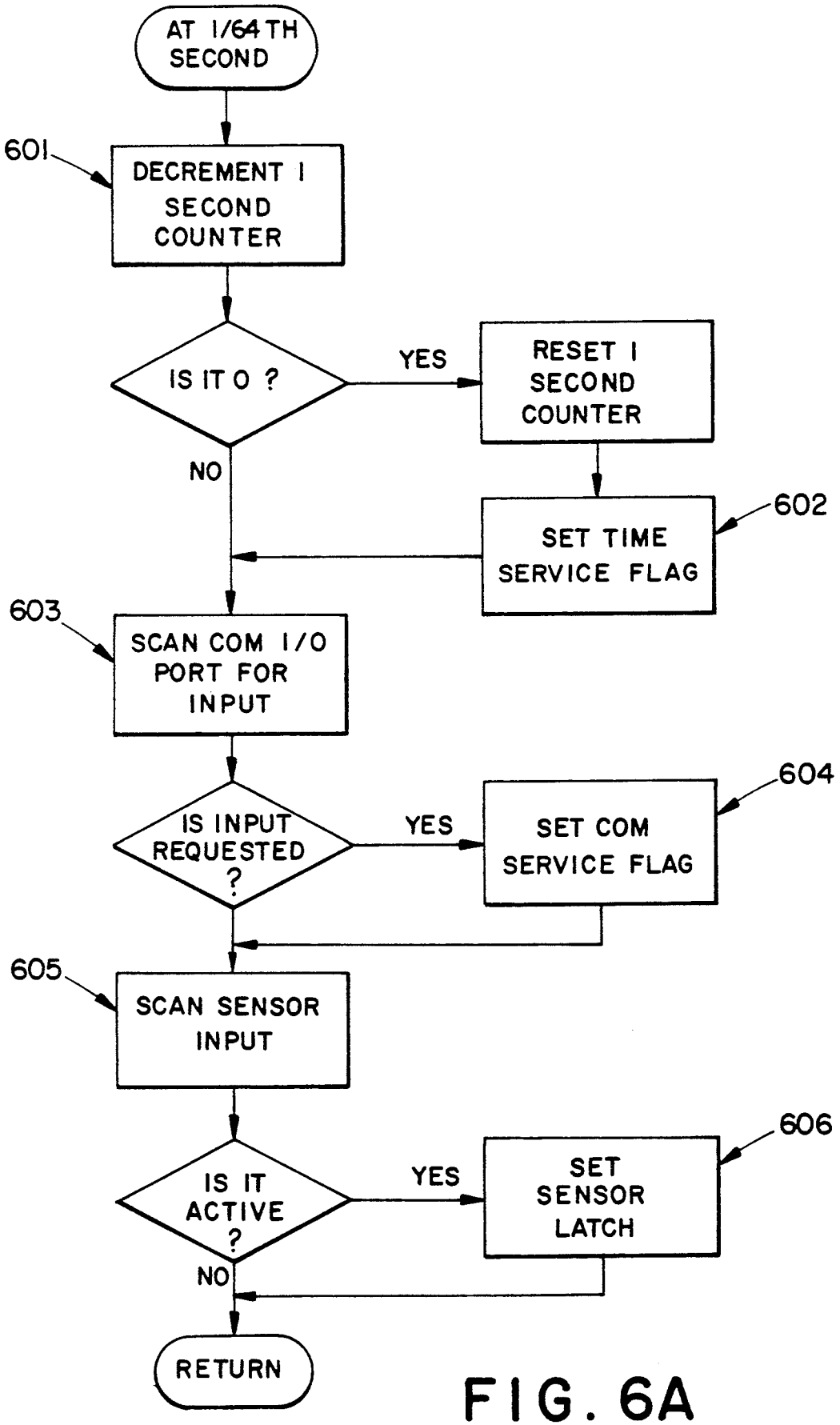
FIGS. 6A–6F are software flow charts representative of the programs of the present invention.

An overview of the system software is shown in FIGS. 6A-6E. FIG. 6A shows an interrupt driven housekeeping cycle whereby the 1 SEC counter is decremented 601 and, if zero, the TIME SERVICE flag is set 602. Also within that cycle, the COM port is scanned for input 603. If input is requested, the COM SERVICE flag is set 604. Next, the sensor input is scanned 605 and, if active, the SENSOR LATCH is set 606. This housekeeping cycle then returns to a SLEEP MODE until reactivated at the next 1/64th second.

Figure 6B:
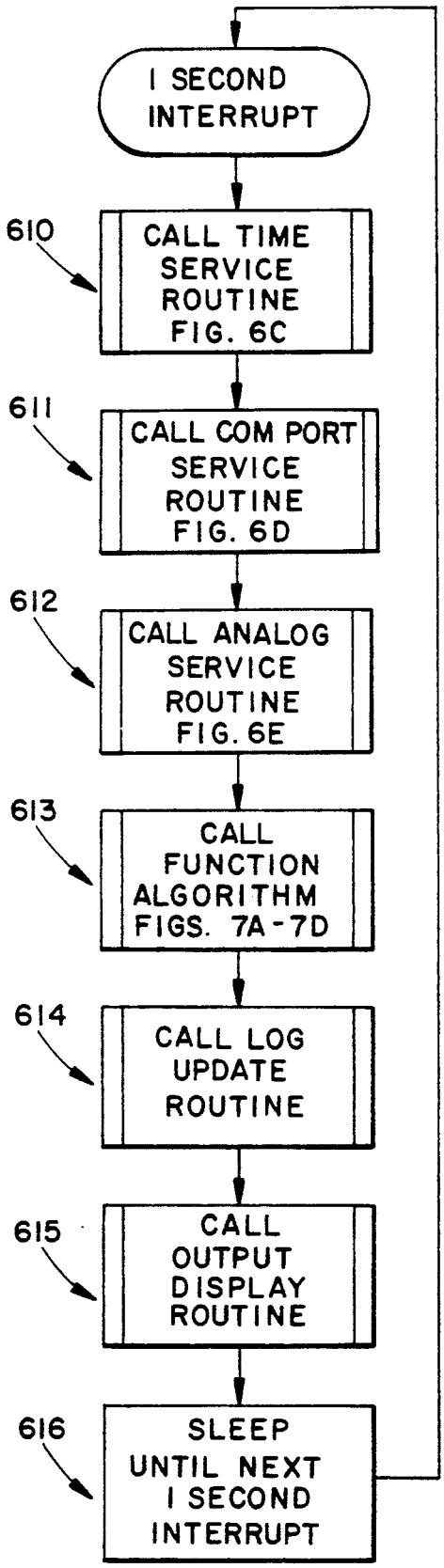

FIG. 6B shows an interrupt driven calling routine whereby all the basic system services are called sequentially. The system services include a TIME SERVICE routine 610, which updates all clocks and delays. The COM PORT SERVICE routine 611 handles all required communications if the COM SERVICE flag (604 in FIG. 6A is set. The ANALOG SERVICE routine 612 reads all the analog inputs and compares them with the operator selectable high and low limits. The function algorithm is called in step 613 and executes the necessary control for well head function. The function algorithm is specifically tailored to the particular well head installation as shown in FIGS. 3A-3C. The LOG UPDATE routine 614 saves into memory the current status of the timer flags along with a collection of analog inputs read to form a log of well head performance to be downloaded by an operator using a small hand held terminal device. The OUTPUT DISPLAY routine 615 sends data over the COMM port as required. Since the controller has no onboard display means, this routine is called only when the small hand held terminal device is connected to the COMM port. The calling routine then enters a SLEEP MODE 616 until the next 1 second interrupt whereupon the basic system services are again called sequentially.

Figure 6C:
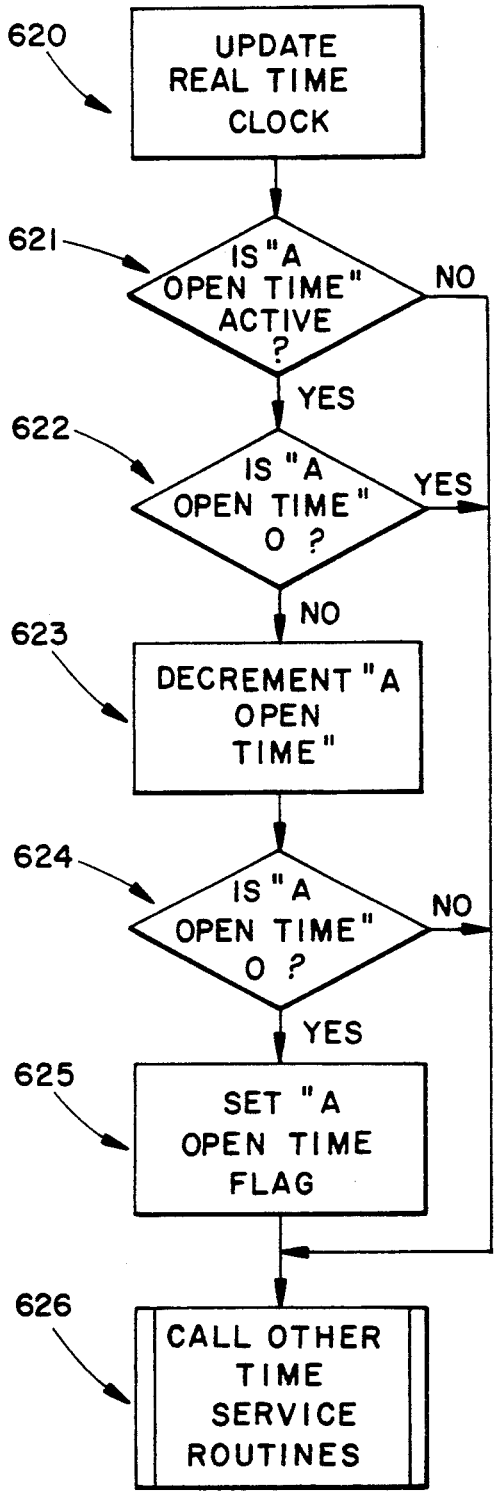

A representative time service routine is shown in FIG. 6C. For each function algorithm, there are at least fifteen major TIME SERVICE routines, several MINOR TIME SERVICE routines, and a number of DELAY TIME REGISTER routines. Each of these TIME SERVICE routines operate similar to the representative flowchart of FIG. 6C.

The time service routines are called from the interrupt-driven calling routine of FIG. 6B if the TIME SERVICE flag 602 is set according to the flowchart of FIG. 6A. Upon being called, the TIME SERVICE routine first updates the system real time clock 620 and proceeds to call other time service routines sequentially 626.

For the purposes of illustration, the A OPEN TIME service routine is shown in FIG. 6C. The A OPEN TIME active flag is first checked in decision block 621. If the A OPEN TIME flag is not set, the control flow proceeds on to call other time service routines 626. If the flag is set, the A OPEN TIME value is checked against a zero value in decision block 622 whereupon the A OPEN TIME is decremented 623 if not already zero. After decrementing the A OPEN TIME value, the A OPEN TIME value is again checked against zero 624. If the decrement function 623 reduced the value of A OPEN TIME to zero, the A OPEN TIME flag is set 625 and the time service routine continues on to sequentially call the other time service routines 626. The A OPEN TIME flag thus set 625 remains in memory and is used by other system software functions.

Figure 6D:
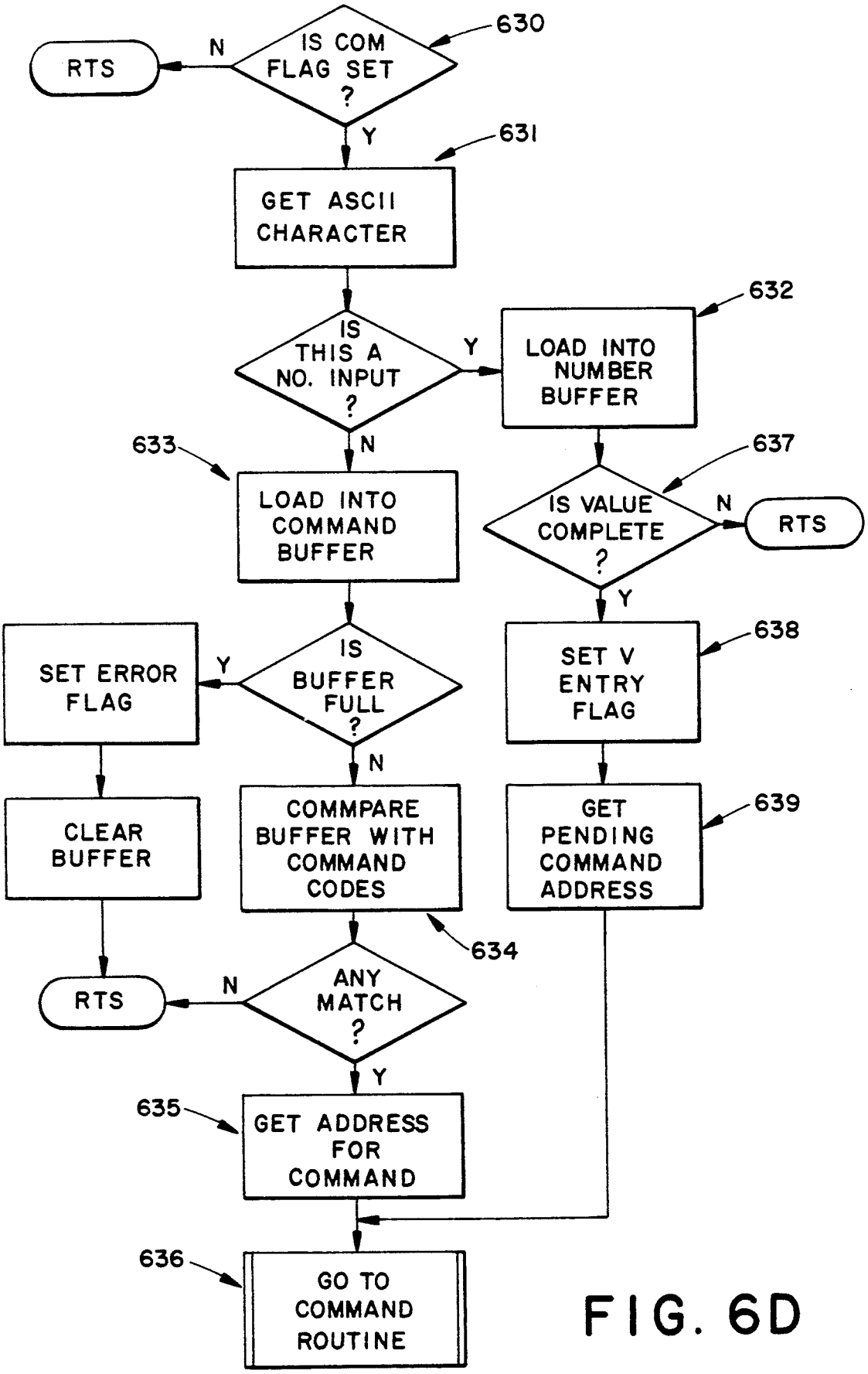

FIG. 6D shows a simple COM PORT SERVICE routine flowchart which is called in the one second interrupt routine 611 of FIG. 6B. In this COM PORT SERVICE routine, the COM SERVICE FLAG is first checked 630 and if set, an ASCII character is retrieved 631. If the number flag is set indicating a number value entry is in process, the entry is loaded into the number buffer 632. Alternately, the entry is loaded into a command buffer 633 whereupon the retrieved characters stored in the buffer are compared with valid command codes 634. Thereafter, the address for the command is retrieved 635 and the COMMAND routine is entered 636. In the event that a number was loaded into the buffer 632, its value is checked for completeness 637 and if complete, the V ENTRY flag is set 638 whereupon the pending command address is retrieved and the COMMAND routine is once again entered 636 to execute the complete alpha-numeric command, i.e., entry of a time or pressure limit.

Figure 6E:
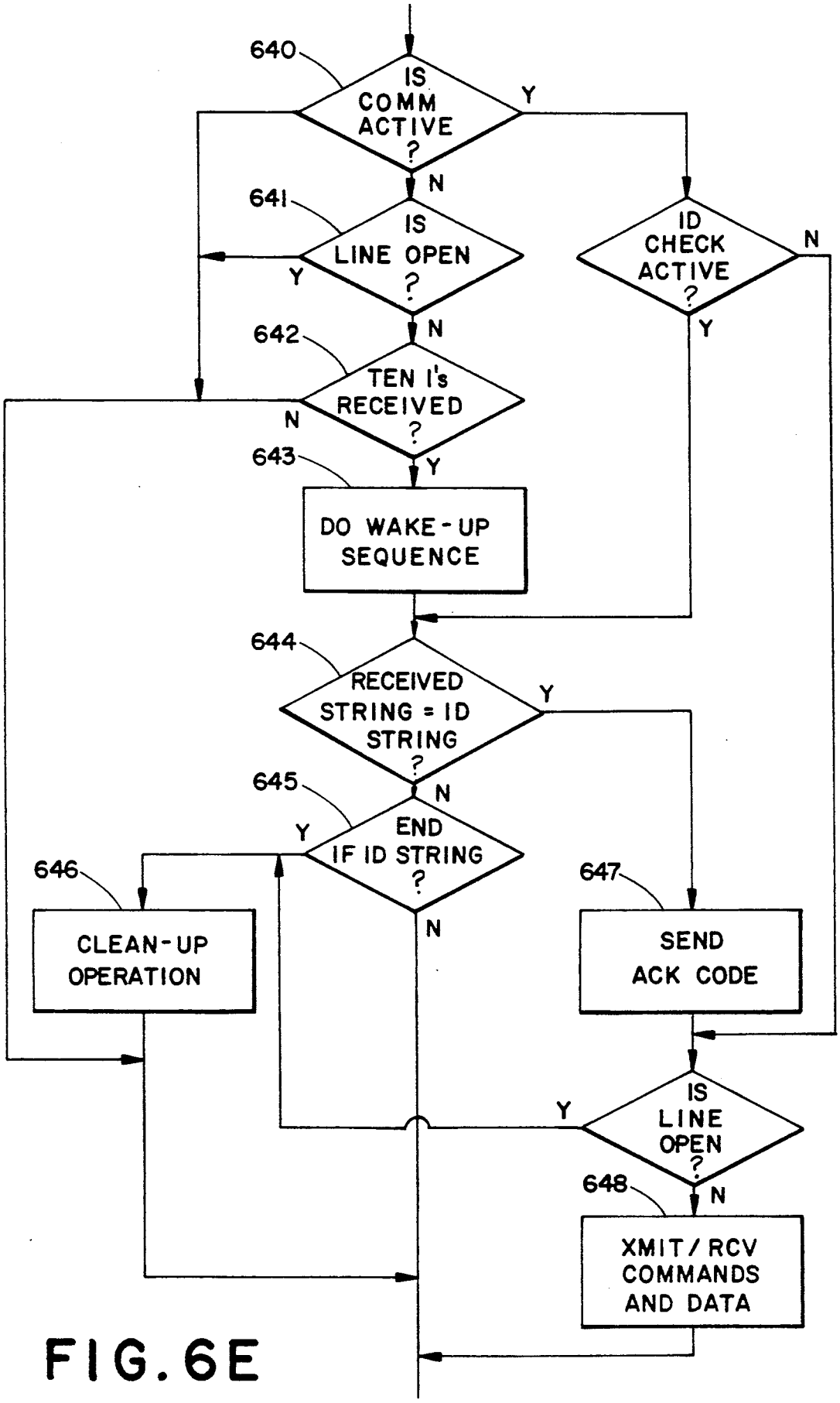

FIG. 6E illustrates a flowchart for the communications wake-up and identification verify routine of the present invention. This routine is executed every one-sixtyfourth (1/64) of a second when the COM I/O port is scanned for input 603 as shown in FIG. 6A.

The COMMUNICATIONS ACTIVE flag is first checked 640 and if not set the communication line is checked for a break condition or an open line condition as indicated by the receipt of all zeros (0's) 641. If characters other than zeros are received, the routine then checks for the receipt of ten consecutive ones (1's) 642 and if that condition is satisfied, a WAKE-UP sequence is performed 643. The WAKE-UP sequence 643 interrupts the CPU, sets the COMMUNICATIONS ACTIVE flag, and sets the IDENTIFICATION CHECK ACTIVE flag. After the WAKE-UP sequence 643, the next incoming characters are compared with the controller's particular identification character string 644, a valid character string ending with a carriage return (CR) code. If the character string received does not match the controller's particular identification string, the routine next checks for the end of string code CR or the receipt of thirty consecutive characters 645 indicating a nonrecognized command code. If either of these conditions occur, the routine executes a "cleanup" routine 646 which clears the COMMUNICATIONS ACTIVE flag, clears the IDENTIFICATION CHECK ACTIVE flag, disables the communications, and returns to the SLEEP MODE.

If the character string received matches exactly with the identification character string particular to the control 644, an acknowledge code (ACK) is sent by the controller and the communications protocol is enabled 647. Also, the IDENTIFICATION CHECK ACTIVE flag is cleared. If the communications line remains closed, that is no breaks or open lines, a normal dialogue between the controller and the host for the transmission and reception of commands and data is established 648.

A feature of the controller of the present invention is that the identification character string particular to an individual control can act as a "filter" to direct controller commands and data to the appropriate well site when a plurality of controllers operate in parallel with one common trunk line to a single host. This functionality is achieved in the routine of FIG. 6E when the received character string is matched with the particular identification character string 644. Upon identification character string mismatch or lack of identification string terminator CR 645, the software control is allowed to return to the calling routine and the commands are ignored or "filtered".

Figure 6F:
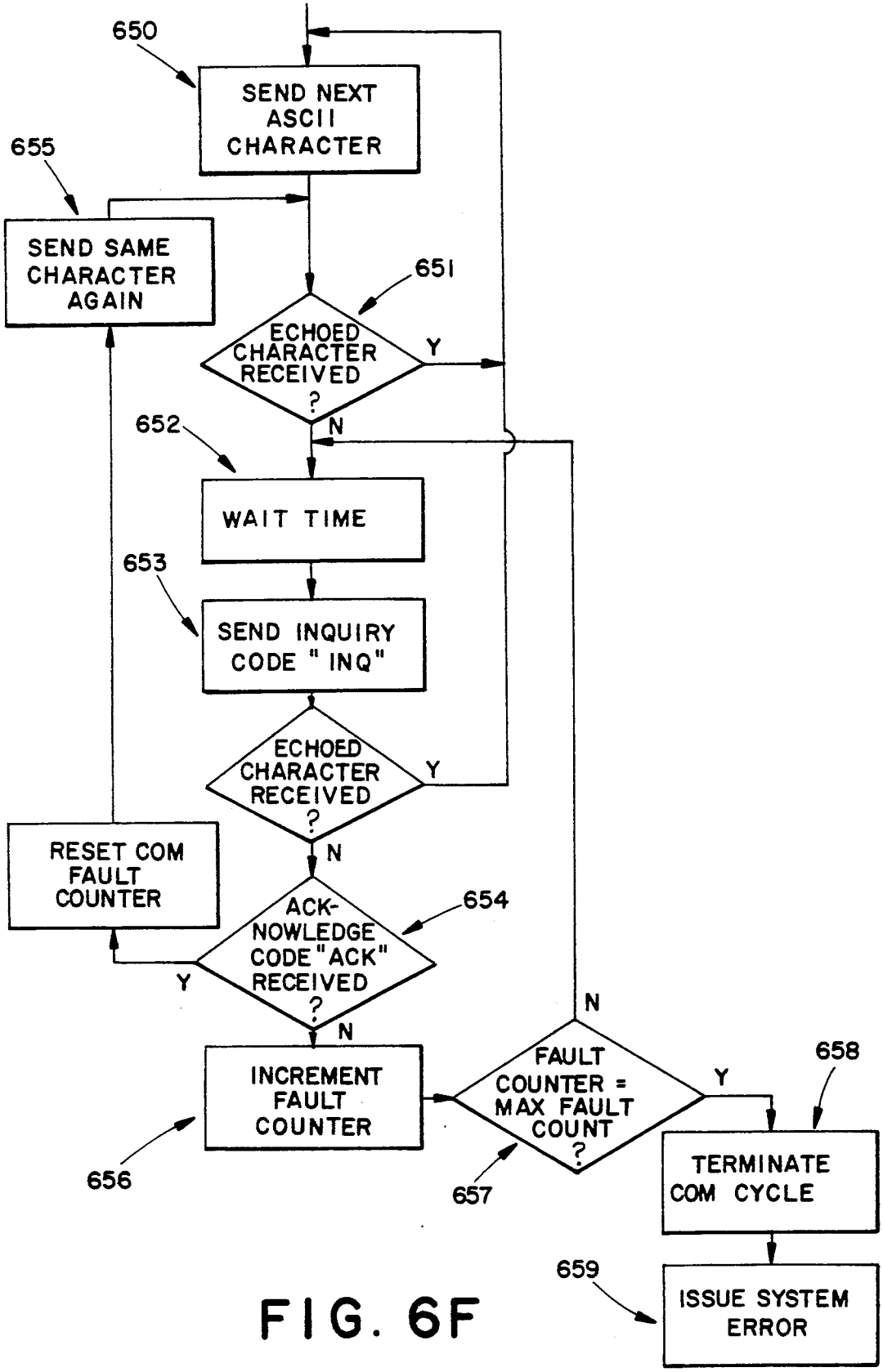

The flowchart of FIG. 6F illustrates the communication protocol of the present invention. A character is first sent by a sending unit which may be either the controller of the present invention or a host computer 650 whereupon an echo of the character previously sent is expected from the receiving unit which may also be either the controller of the present invention or a host computer. If, after a WAIT TIME 652, the character sent is not echoed back, an inquiry code INQ is sent to the receiving unit 653. If the echoed character is not received but instead an acknowledge code ACK is received by the sending unit from the receiving unit 654, the previously sent character is sent once again by the sending unit 655 assuming that the character was lost due to noise or some other disturbance on the communications line.

If neither the echoed character nor the acknowledge code is received by the sending unit, a fault counter is incremented once and the system loops in the "WAIT" , "SEND", "INQ", "ACK CHECK", and "INCREMENT FAULT" 656 until the fault counter reaches a maximum count 657. When the fault counter reaches the maximum count, the communication cycle is terminated 658 and an error code is issued 659.

The communication port protocol used in the controller of the present invention ensures data integrity between the sending unit and the receiving unit.

It is noteworthy here that the controller log information stored locally in binary form is first converted to ASCII by the controller before sending to a host through the communication line and using the above-described communication port protocol. The receiving host computer then unscrambles the ASCII data to generate a report or fill a data base.

A simplified flow diagram of the algorithm used to control the well configuration of FIG. 3A is shown in FIG. 7A7–7A4. This is a plunger lift, time/pressure algorithm using the casing and line pressure transducer inputs to control a sales and bypass control valve. Various other options and delays, as shown in Aux Flow Diagrams of FIGS. 8A–8E, may be chosen by the operator. The flow algorithm is entered once per second.

CONSTANT TIME is a feature of this algorithm which permits the synchronization of several wells into a common sales line. Upon entry into the flow routine, the A open time 702*a* is transferred if A close time is zero 701*a* or the A close time 705*a* is transferred if the A open time 704*a* is zero.

The cycle flag 703*a* is also cleared if the A open time is started to enable a normal reopening of the A valve as determined by test 738*a*.

The A valve, which is the normal sales valve is tested 706*a* to determine which leg of the algorithm is active If the A valve is open, the next 3 tests determine if the A valve should be temporarily closed. The safety test 707*a* checks the safety input to determine any number of conditions including full tanks or broken lines. The Hi line test 708*a* will shut in the production valve if the sales line pressure is too high to permit normal gas production. The Lo line test 709*a* will shut in the production valve if the line pressure indicates a break.

If the casing pressure 710*a* drops below the limit required to lift the plunger and fluids to the top of the tubing against the line pressure, the B bypass valve time 717*a* or the shut-in time 719*a* may be initiated to either permit the fluids to be routed directly to the storage tanks or shut-in to allow the casing pressure to build.

If the plunger arrives 711*a* at the top of the tubing within the allotted A open time, a purge delay 713*a* may be initiated to keep the A valve open longer to clear the lines or sell gas. If the plunger has not arrived, a test is made to see if the A close time has been initiated 716*a* and initiate the B bypass valve 717*a* or shut-in time 719*a* if it has. The B open delay time 720*a* may also be initiated in addition to the B bypass valve open time 717*a* to delay opening the B valve after the A valve has been closed allowing the plunger to drop below the fluid again.

If a purge delay has been initiated 713*a* and it has counted down to zero 715*a*, a plunger delay 721*a* may then be initiated to permit the plunger to drop fully below the fluid, the cycle flag 723*a* is set to indicate non temporary closure of the valves 724*a*, 725*a*.

If the A valve is closed 706*a*, tests are made to insure the timeout of any shut-in time 726*a*, plunger delay 729*a*, or B open delay time 731*a* before any valve action is taken.

If the B valve has been opened and a safety condition exists 735*a*, then it is closed and all other action is suspended.

If the cycle flag has been set 738*a*, indicating non temporary valve closure, a test is made to determine if B bypass valve action is active 739*a*. If the B open time has counted down to zero 740*a*, the B valve will remain open if a B purge delay is active 741*a* and the casing pressure is still above the low limit 742*a*. If the casing pressure is low 743*a* or the B purge is zero or nonactive, a shut-in time 745*a* may be initiated to override all other valve opening conditions before the B valve is closed 753*a* and the plunger delay 756*a* is started. Any times or delays not entered by the operator are ignored by the flow algorithm.

If the B valve time is still active 740*a*, the B valve is opened until the plunger arrives at the top of the tubing 748*a* and ay B purge delay time initiated 751*a* counts down to zero 740*a*.

If no B valve action is active 739*a*, a test is made of the Hi casing pressure limit 757*a* to initiate an A open time override 759*a* if active.

If the cycle flag is not set 738*a*, indicating a temporary valve closure of the transfer of A open time 703*a*, a test is made to determine if a Hi line limit 760*a*, Lo line limit 761*a*, or plunger is still in the lubricator 762*a* before resetting the plunger sensor latch 763*a* and opening the A valve. The plunger sensor latch 763*a* detects a short plunger which may pass the plunger sensor position at a high speed before hitting the lubricator spring at the top of the tubing string.

A simplified flow diagram, used to control the well configuration of FIG. 3B is shown in FIGS. 7b1–7B3. The algorithm uses the casing and line pressure transducer inputs with time valves to control an injection valve and sales control valve for control of plunger lift wells requiring the injection of gas into the casing from an external source. Various other options are available to the operator as may be shown in the AUX FLOW DIAGRAMS of FIGS. 8A–8E.

All times in the algorithm of FIGS. 7B1–7B3 are sequenced and, unlike other control algorithms, only one time may be active at any given period. The times which are standard for this series are A open time 728*b*, B open time 732*b*, Close time 721*b*, A open delay 706*b*, A purge delay 713b, and Shut-in time 707b. The flow routine is entered once per second after all inputs and pressures have been updated.

The sequence may be started by the operator by transferring the B open time 732b and opening the B valve 734b which is the injection valve. On the next entry to the flow routine, since the B open time 703b is the only active time, a test will be made to see if it has counted to zero 704b. If it has counted to zero before the casing pressure has built to an acceptable level 705b, the Shut-in time may be transferred to close down the well 723b, 724b until recovery of the external gas source or on-site inspection by the operator. If no Shut-in time has been entered by the operator, the next entry into the flow routine will be directed by the Shut-in time test 701b to the zero test 731b and on to transfer the B open time 732b and reopening the B valve 734b for another pass at trying to bring the casing pressure up to an acceptable level. The same path will be taken 731b, 732b, 734b if the Shut-in time has been entered and it has counted to zero.

If the B open time has not counted to zero 704b and the casing pressure is at an acceptable pressure 705b required to move the fluids to the surface, the A open delay time 706b is then transferred and the B valve is closed 723b. The A open delay time 706b is an option which permits the B valve to fully close before the A valve is opened. If the operator has not entered the A open delay time 706b or it has counted to zero 727b, the next entry of the flow routine will be directed by the A open delay test 708b to the zero test 727b to transfer the A open time 728b and open the A valve 730b which is the sales or production valve.

If during the A open time 710b the plunger arrives at the surface 711b, the A purge delay time 713b may be transferred to delay the closing of the sales valve after the fluids have been discharged to clear the lines of fluid. While the A valve is open, either by active A open time 710b or active A purge delay time 709b, several tests are made each second to transfer the Close time 721b and close the A valve 724b if required. The first test is the optional Hi casing/tubing differential pressure limit 717b which determines that an excessive amount of fluids have accumulated in the tubing for the present given casing pressure. The next test determines if the A open time or the A purge delay has counted to zero 718b. An optional Lo casing/tubing differential pressure test 719b may be used to indicate a lack of fluids in the tubing if a plunger or plunger sensor is not used. The last test which would terminate the A valve open time is the Lo casing test 720b which indicates that the casing pressure is no longer sufficient to produce the well.

After the A open time 728b was transferred, all the tests in the above paragraph were first run before the A valve was actually opened 726b. If the Low line pressure test 722b indicated a break in the sales line or injection supply line, the A valve would be temporarily closed until the condition was corrected.

The Close time 721b will allow the plunger to return below the fluids before again opening the B casing, injection valve 734b along the path of Close time test 702b to zero test 731b and transfer of B open time.

Other optional commands, as listed elsewhere, permit this control algorithm to be fully tailored by the operator for optimum production of any well having low natural rock pressure.

Figure 7C:
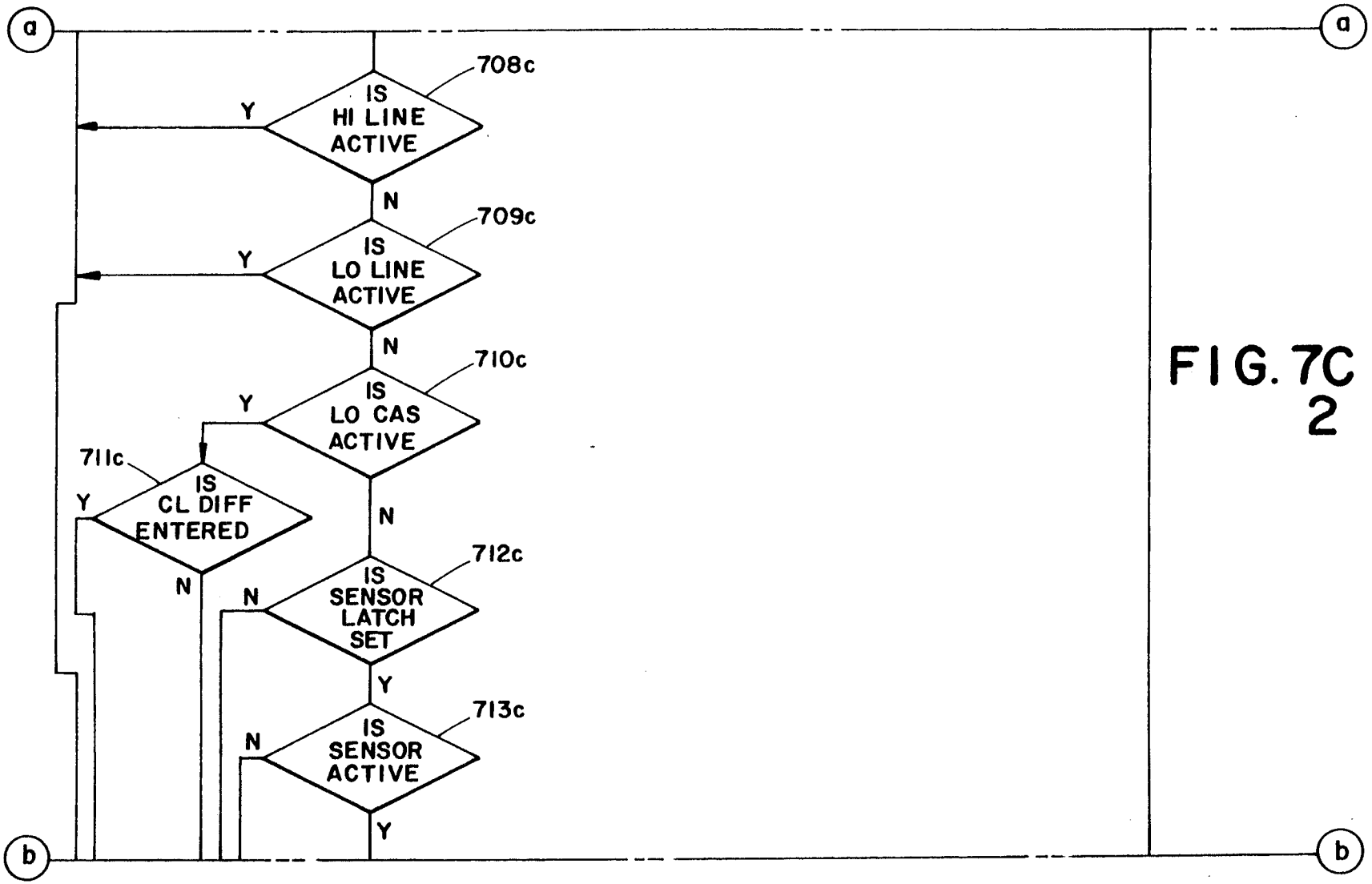
Figure 7C:
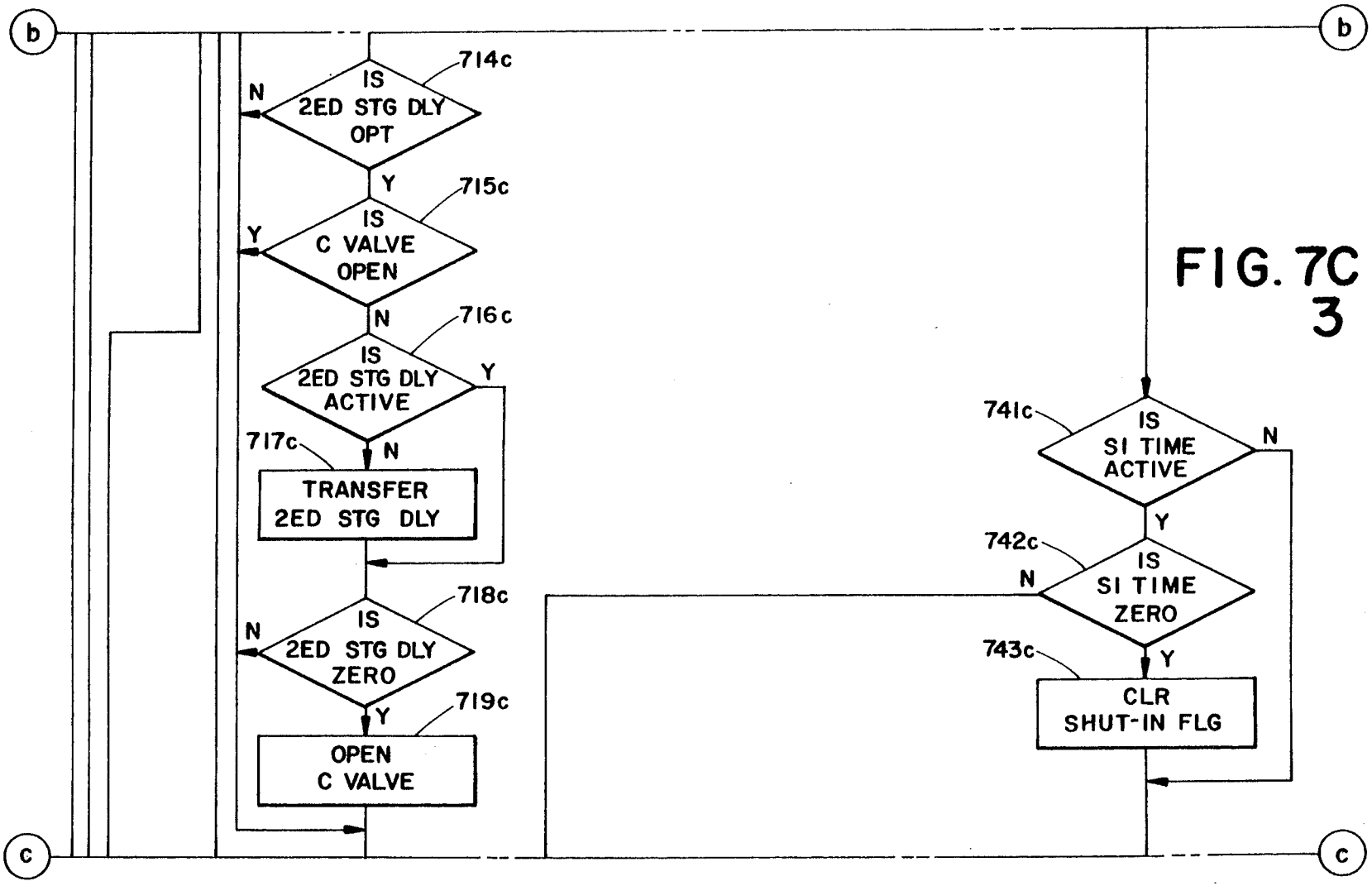
Figure 7C:
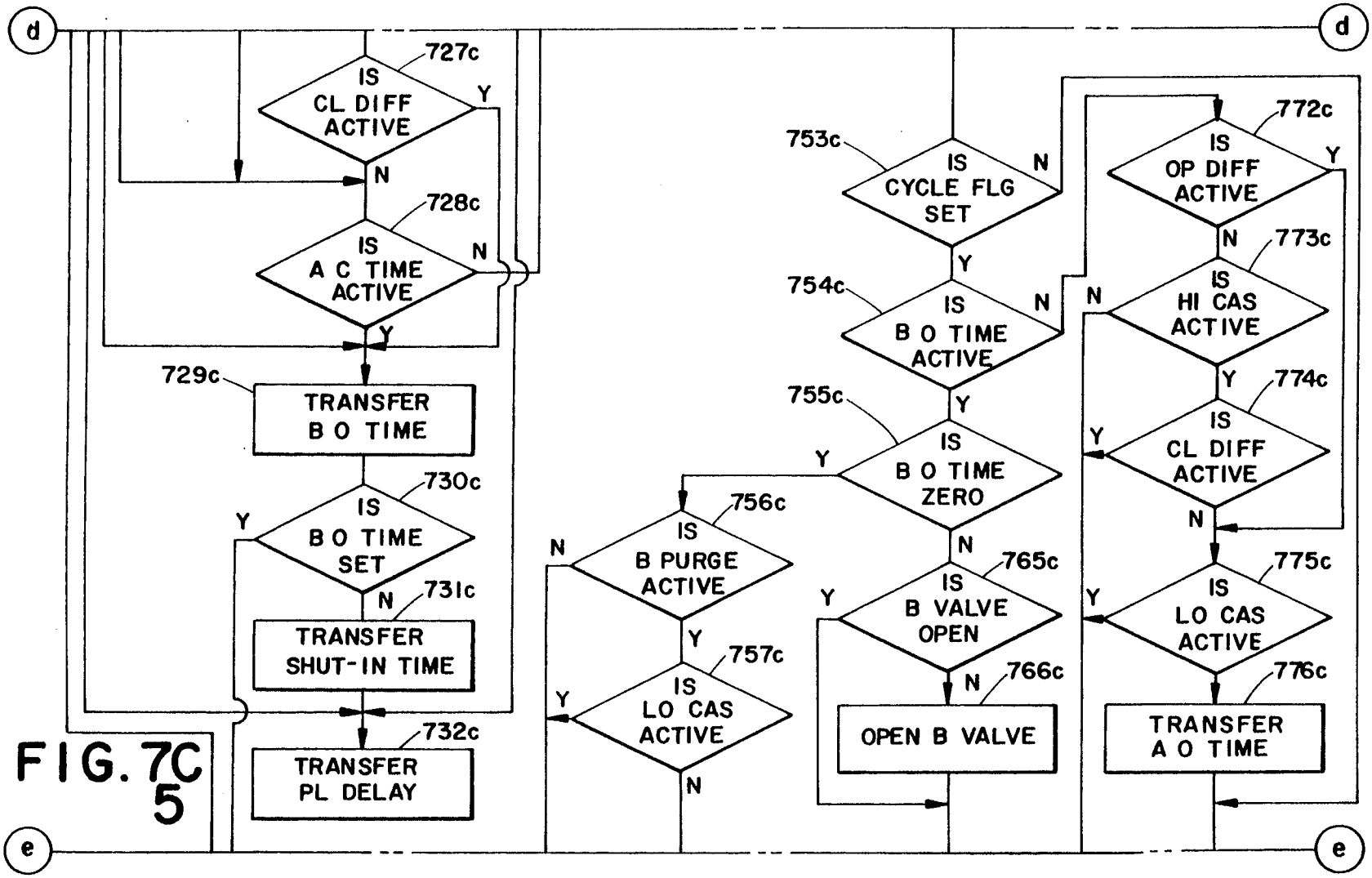

A simplified flow diagram of the algorithm used to control the well configuration of FIG. 3C is shown in FIGS. 7C1–7C6. This algorithm is similar to the algorithm of FIGS. 7A1–7A4 in that it is a plunger lift time/pressure control, but with the addition of differential pressure limits and a two stage production valve. Three valves are commonly used with this control system to provide an A main sales valve, B bypass valve, and C second stage sales valve or an independent time valve for automated "drip" fluid dumping. A tubing pressure transducer is also added to permit calculation of a casing/tubing differential or optional tubing/line flow rate/volume data.

Various other options are available to the operator, some of which are shown in the AUX FLOW DIAGRAMS of FIGS. 8A–8E, and others as listed elsewhere in the commands.

CONSTANT TIME which permits synchronization of several wells on a common sales line is a feature of this algorithm. The first entry into the flow routine will transfer the A open time 702c if A close time is zero 701c or transfer the A close time 705c if A open time is zero 704c.

The cycle flag 703c is also cleared with the transfer of the A open time to permit the opening of the A valve 781c as determined by the cycle flag test 753c and the condition tests 777c, 778c, 779c. This flag is set 735c upon completion of the A valve cycle 736c to discriminate between completion and a temporary close state of the A valve caused by an active safety input 707c or a Hi or Lo line pressure limit 708c, 709c.

If the A valve is open 706c , the temporary close conditions 707c, 708c, 709c are checked before the Lo casing limit 710c, which will terminate the A open cycle. If the Lo casing limit is active, the Close differential psi limit entry 711c is used to point to the best action for this condition. If the operator has not entered the Close differential limit 711c, the B open time 729c for the B bypass valve may be initiated along with a B open delay 733c to permit the plunger to fall back after the A valve is closed 736c. If no B open time has been entered by the operator 730c, then the Shut-in time may be initiated, if entered, to allow the casing pressure to build again before restarting the cycle. If the operator has entered the Close differential limit 711c, the Plunger delay 732c may be initiated, if entered, to permit the plunger to fall below the fluids after termination of the A open cycle 735c, 736c. The Plunger delay will prevent restarting of the A open cycle by a Hi casing pressure limit 773c or Open differential psi limit 772c.

If no Low casing psi limit is active a test is made 712c to determine if the plunger has arrived at the top of tubing. Again, the close differential limit entry 725c is used to determine the best action. If no Close differential limit has been entered and the plunger has not arrived, a test is made 728c to see if the A open time 702c has counted to zero 728c. If A close time 705c has been transferred, the A open cycle will be terminated 735c, 736c with the transfer of any entered delays or times 729c, 731c, 732c, 733c.

If a Close differential has been entered 725c, the B open time entry 726c is used to choose the best action. If the operator has entered a B open time by the bypass valve, the system will wait until the Close differential pressure limit 727c has been exceeded, indicating fluid accumulation in the tubing, or the A close time has been transferred 728c to terminate the A open cycle.

If the plunger does arrive at the top of the tubing 712c within the A open time and no second stage option 714c has been selected, the A purge delay 721c may be initiated to delay the termination of the A open cycle until the lines have been purged of fluids and the delay has counted to zero 723c or the continued transmission of gas through the A sales valve cause the casing pressure to drop below a selected limit 710c. If the second stage option 714c has been selected, the C second stage valve 719c will open after any second stage delay time 717c has counted to zero 718c. The C second stage valve is used for the discharge of gas into the sales line at a higher volume than that allowed by the A main sales valve. The C second stage valve will only open after the plunger has arrived at the top of the tubing and all fluids have been discharged. If the A valve is temporarily closed by safety or line conditions 707c, 708c, 709c, the C second stage valve is also closed 739c and will not reopen until A main sales valve has been opened and the plunger is safely again at the top of the tubing 713c. This prevents damage to the well by restricting the speed of the plunger as it ascends to the surface. Termination of the A open cycle also closes the C second stage valve 739c.

If the A valve is not open 706c, the system will wait until any active Shut-in times 741c, Plunger delay 744c, or B open delay 745c has counted to zero 742c, 748c, 746c before initiating any actions. The Safety input 750c is also checked before the test is made on the cycle flag 753c to determine if the A valve has been closed temporarily or if it is time to reopen by the transferring of the A open time 702c.

If the cycle flag 753c indicates that A valve may be reopened 781c, a test is made of the Hi line limit 777c which would indicate that the sales line pressure is too great to permit production, and of the Lo line limit 778c which would indicate a broken sales line. The A valve will not open if the plunger has not dropped away from the top of the tubing 779c indicating that the plunger has been captured by an optional plunger hold device, the plunger is stuck, or that the plunger sensor has been damaged.

If the A open time has been terminated, a test is made to determine if B bypass valve action has been initiated 754c. If no B valve action is pending, the A valve 781c will normally not be reopened until the A open time 702c has been transferred; however, optional pressure limit entries may have been entered by the operator to initiate the transfer of the A open time 776c and open the A valve 781c before the A close time 705c has counted to zero 701c. The first of these options is the Open differential pressure limit 772c which would be used to open the sales valve when a test of the casing pressure and the casing/tubing psi differential indicates sufficient pressure to raise the plunger to the surface with the fluids present. The second option is the Hi casing pressure limit 773c alone which would indicate sufficient pressure is present to lift the plunger to the surface with the fluids present. Lo casing pressure 775c is also tested along with Close differential casing/tubing pressure 774c to determine if insufficient pressures or excessive fluids in the tubing would prevent proper production of the well.

If B bypass valve action has been initiated 754c after termination of the A open cycle, B open time is tested for zero 755c before insuring that the B valve is open 765c, 766c and a test is made to determine if the plunger has arrived at the surface 767c indicating that all fluids have been discharged into the storage tank. If the plunger has arrived 767c, a B purge delay 770c may be initiated if entered by the operator, to delay the closing time of the B bypass valve 761c and permit the line to be purged of all fluids 756c, 758c. If the B open time counts down to zero 755c while any B purge delay is active 756c, the B valve will remain open until the B purge delay counts to zero 758c or the casing pressure drops below an acceptable value 757c. When the B open time 755c has zeroed or the B purge delay has counted to zero 768c, the B valve will be closed 761c and any plunger delay 764c the operator has entered will be initiated to permit the plunger to fall below the fluids in the tubing.

Various other options not shown in this flow diagram may be selected by the operator to modify the control of the algorithm for optimum production of the well in any stage of its production.

Figure 7D:
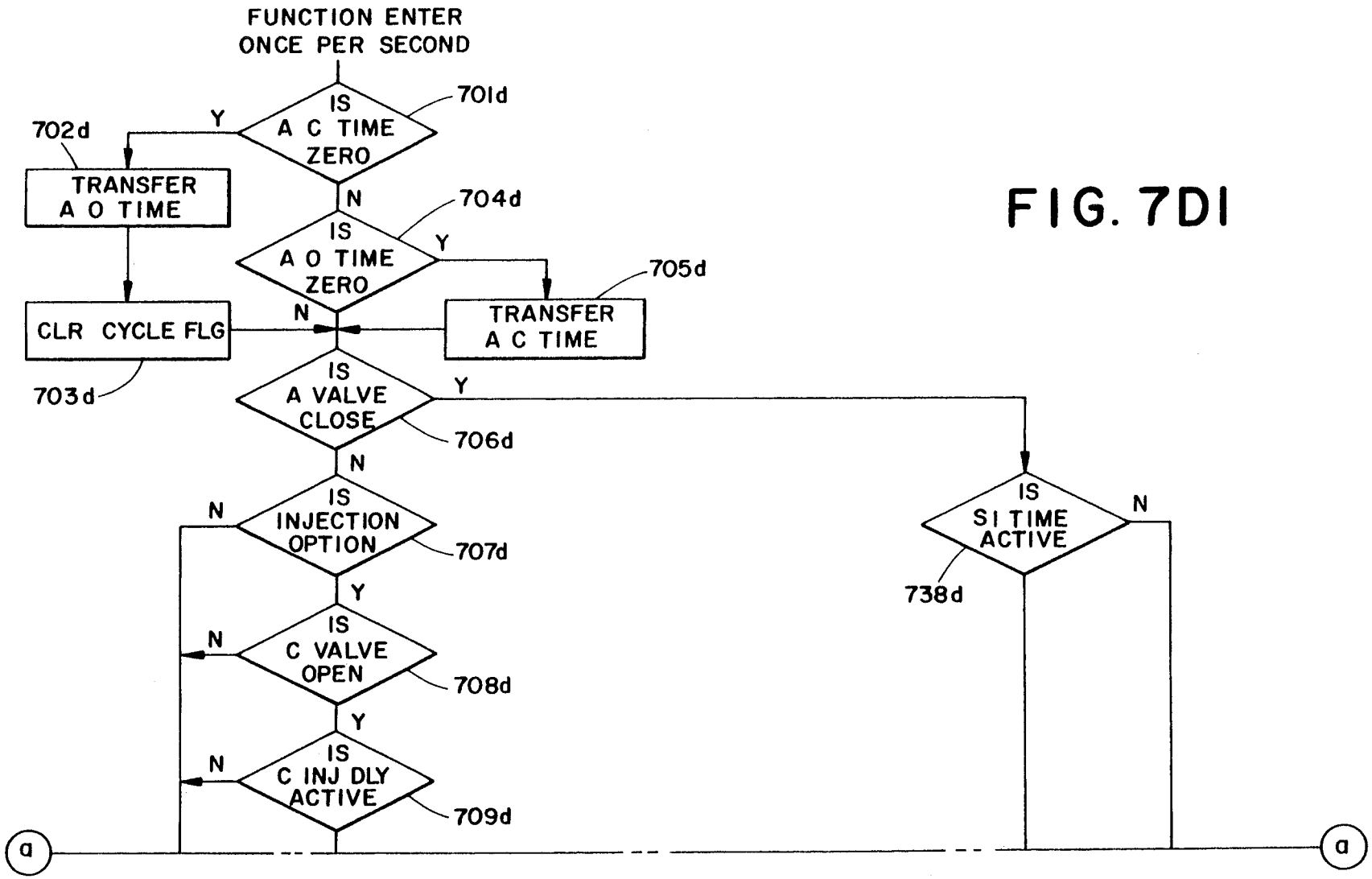
Figure 7D:
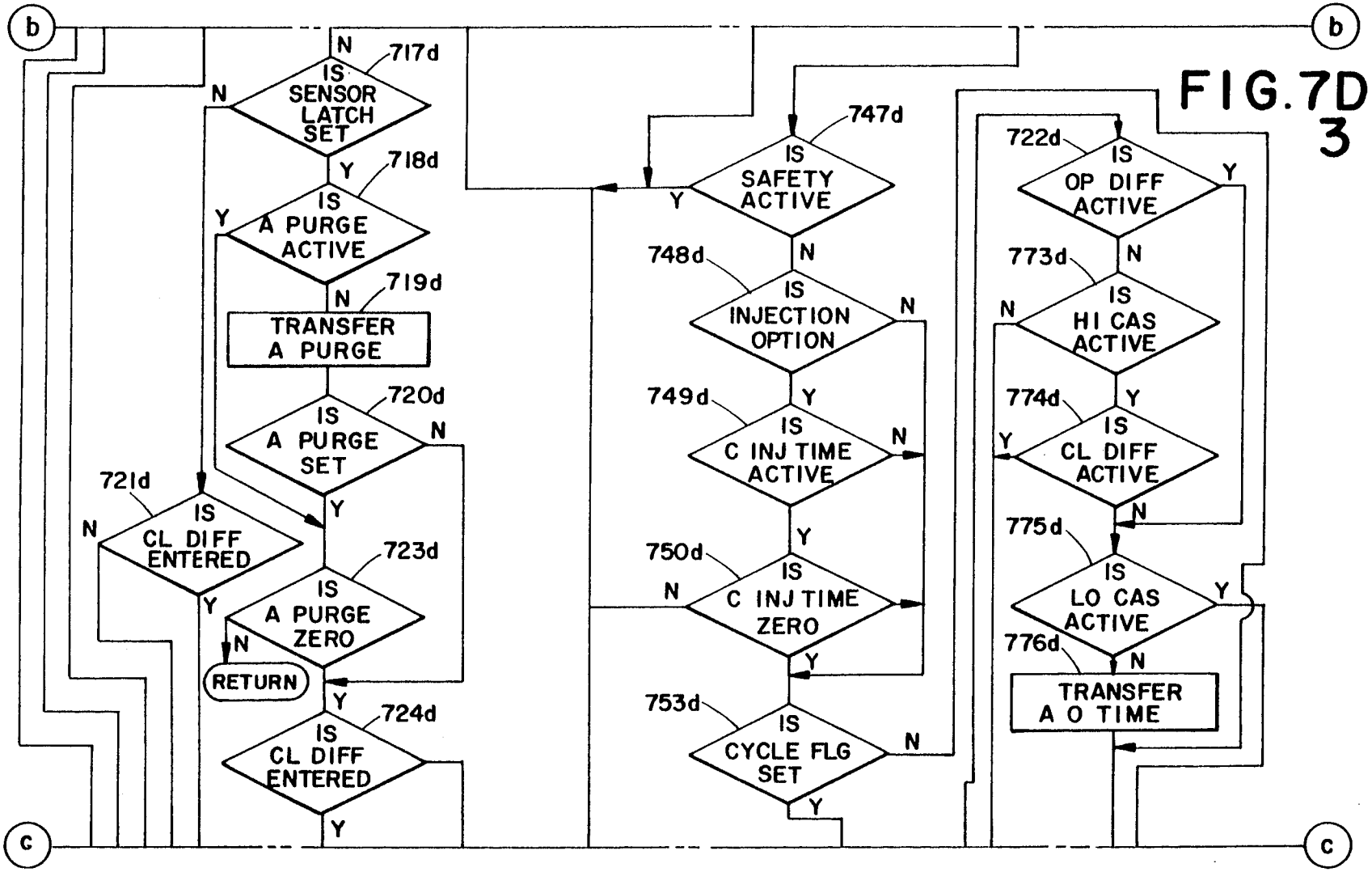
Figure 7D:
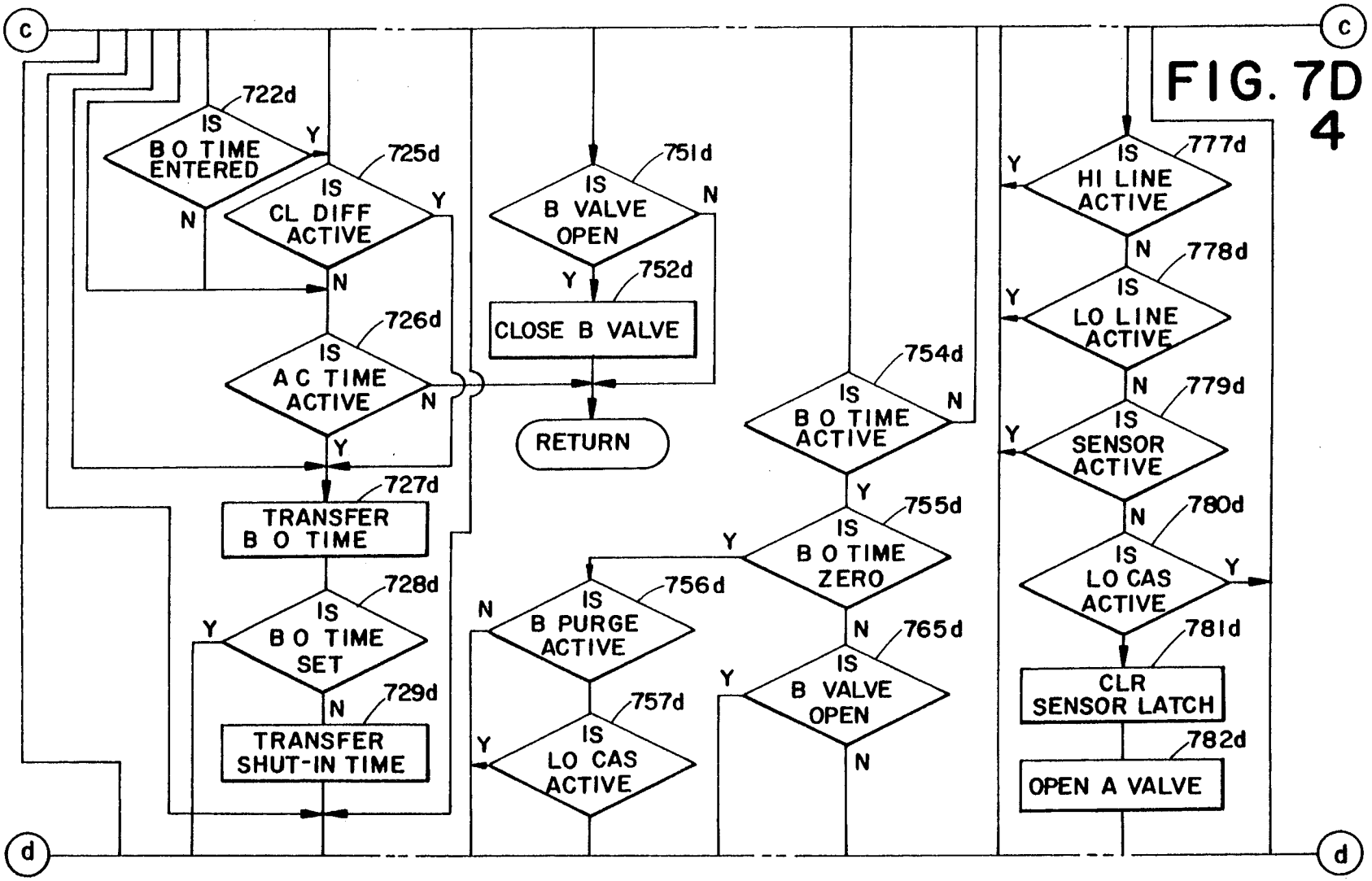
Figure 8B:
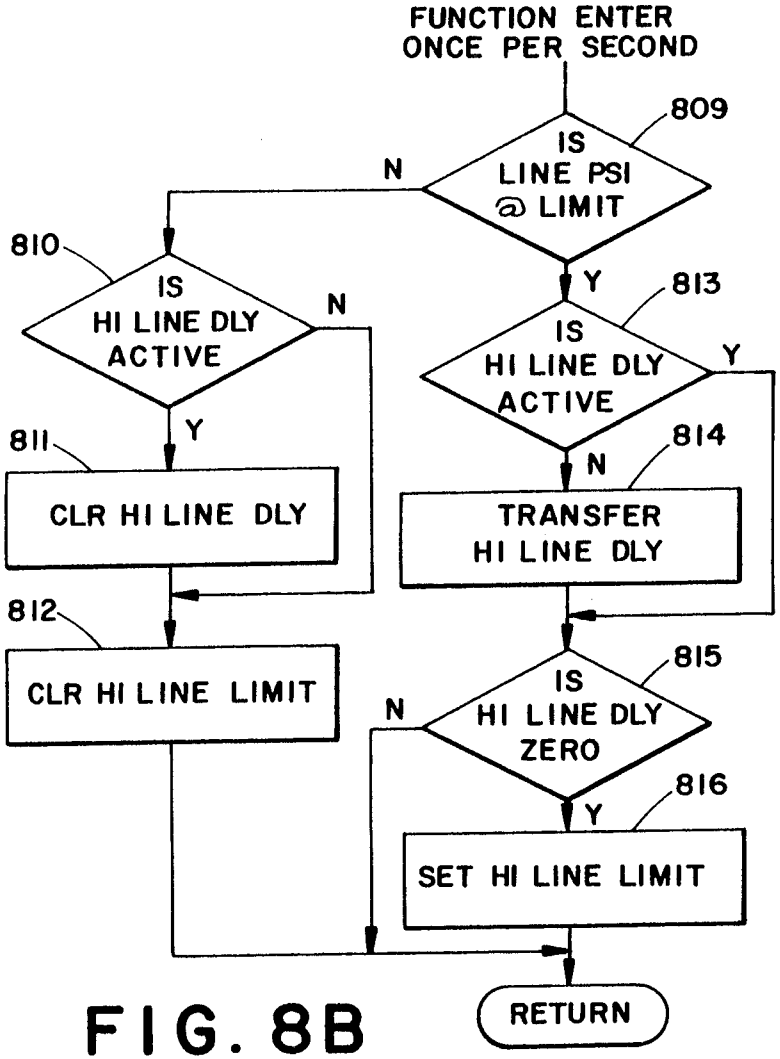
Figure 8A:
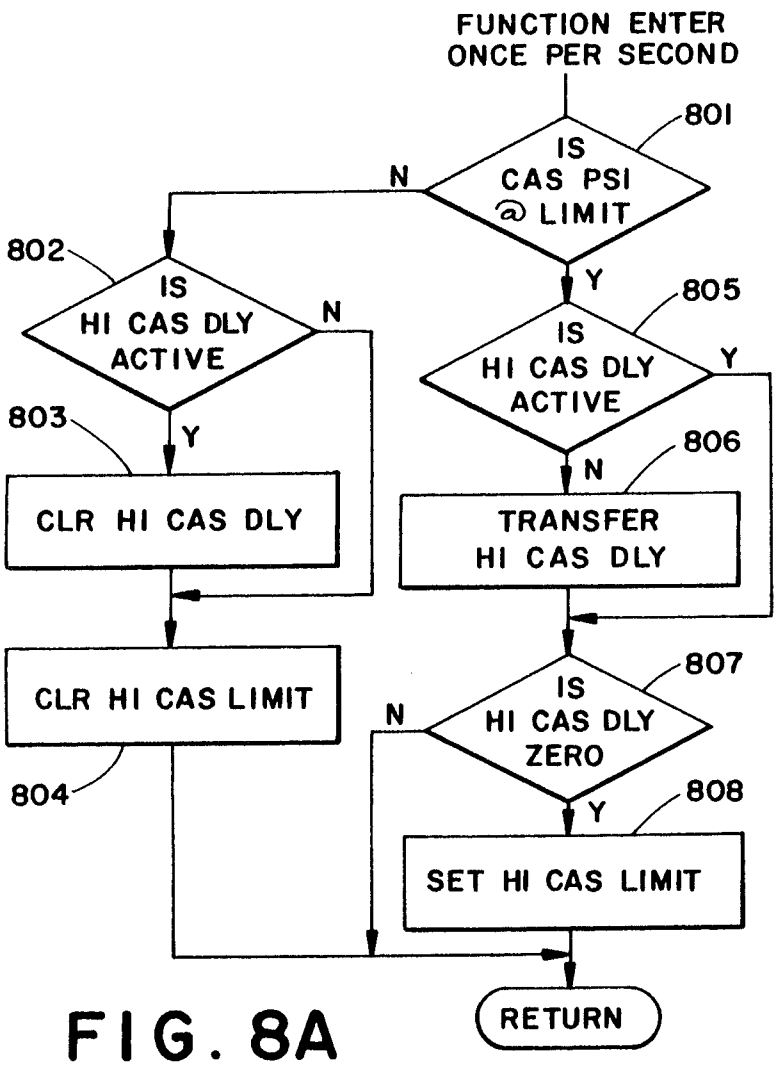
Figure 8C:
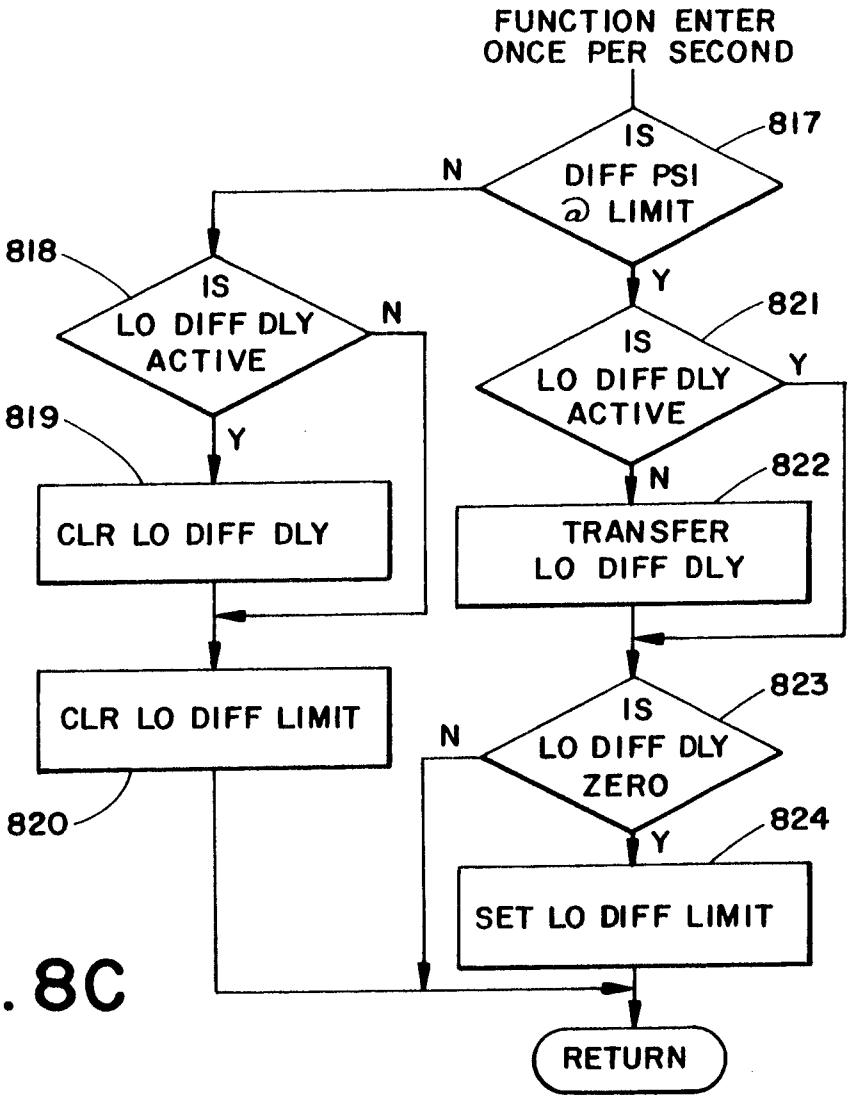
Figure 8D:
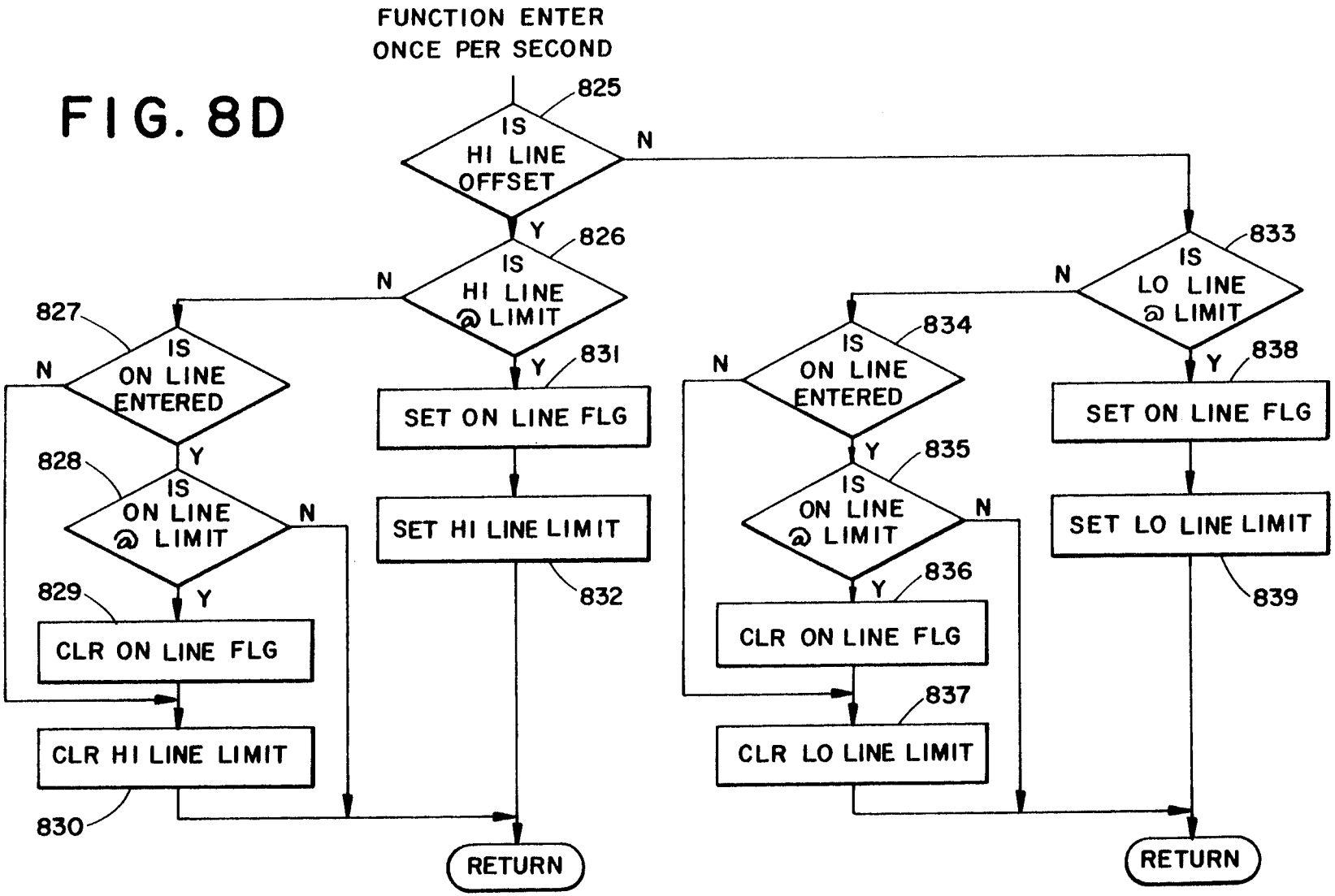
Figure 8E:
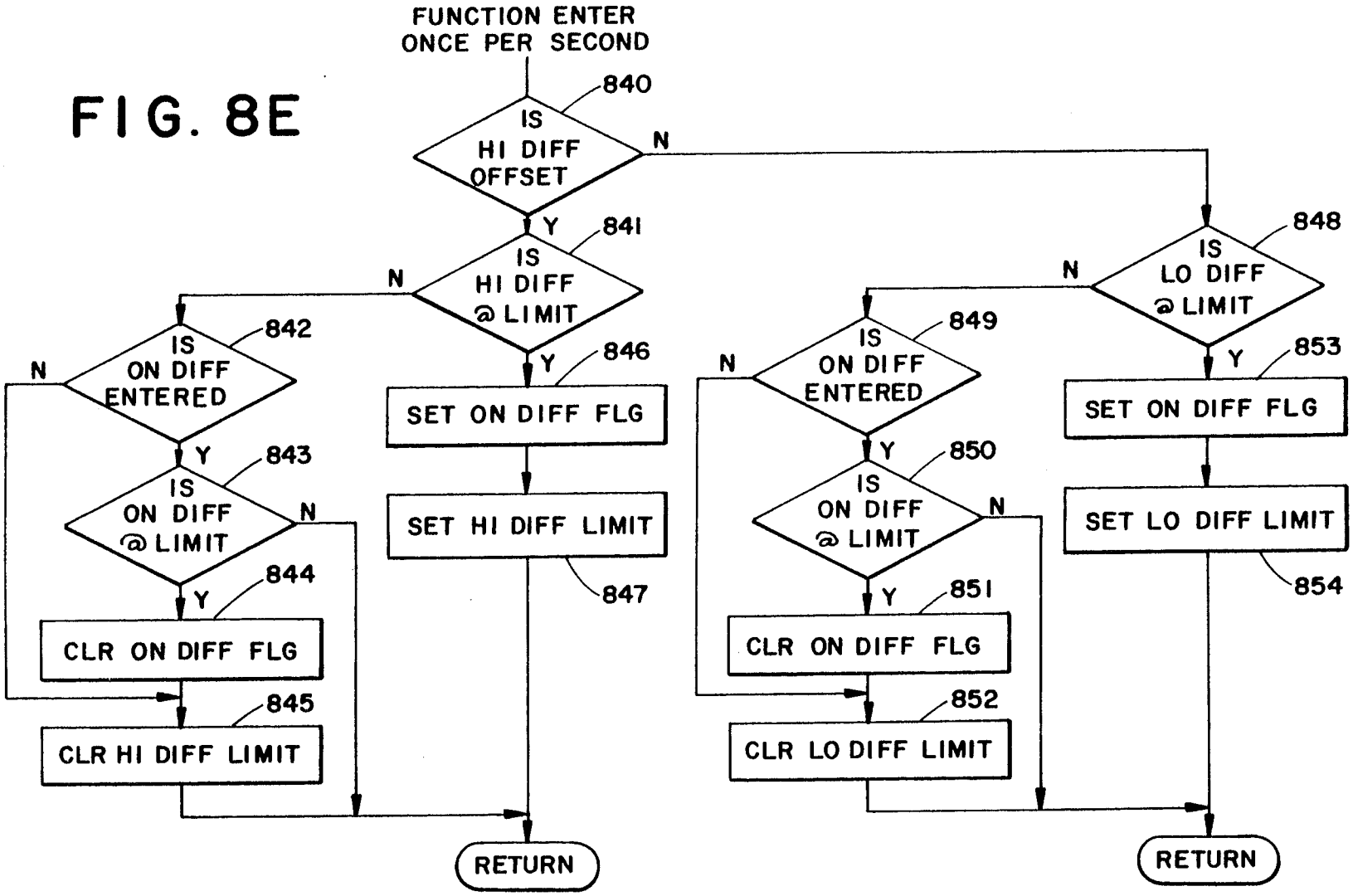

A simplified flow diagram of the algorithm used to control the well configuration of FIG. 3D shown in FIGS. 7D1–7D5. This algorithm is similar to the algorithm of FIGS. 7C1–7C6, with the addition of an option to use the C valve as an injection valve for wells having a low natural rock pressure. Various other options are available to the operator, some of which are shown on AUX FLOW DIAGRAMS of FIGS. 8A–8E, and others as listed elsewhere in the commands.

CONSTANT TIME, which permits synchronization of several wells on a common sales line, is a feature of this algorithm also. The first entry into the flow routine will transfer the A open time 702d if A close time is zero 701d or transfer the A close time 705d if A open time is zero 704d.

If the A valve is open 706d and the injection option 707d has no been selected, the temporary close conditions 712d, 713d, 714d are checked before the Lo casing limit 715d, which will terminate the A open cycle. If the Lo casing limit is active, the Close differential psi limit entry 711d is used to point the best action for this condition. If the operator has not entered the Close differential limit 716d, the B open time 727d for the B bypass valve may be initiated along with a B open delay 731d to permit the plunger to fall back after the A valve is closed 736d. If no B open time has been entered by the operator 728d, then the Shut-in time may be initiated, if entered, to allow the casing pressure to build again before restarting the cycle. If the operator has entered the Close differential limit 716d, the plunger delay 730d may be initiated, if entered, to permit the plunger to fall below the fluids after termination of the A open cycle 735d, 736d. The plunger delay will prevent restarting of the A open cycle by a Hi casing pressure limit 773d or Open differential psi limit 772d.

If no Lo casing psi limit is active, a test is made 717d to determine if the plunger has arrived at the top of the tubing. Again, the Close differential limit entry 721d is used to determine the best action. If no Close differential limit has been entered, and the plunger has not arrived, a test is made 726d to see if the A open time 702d has counted to zero 726d. If A close time 705d has been transferred, the A open cycle will be terminated 735d, 736d with the transfer of any entered delays or times 727d, 729d, 730d, 731d.

If a Close differential has been entered 725d, the B open time entry 728d is used to choose the best action. If the operator has entered a B open time for the bypass valve, the system will wait until the Close differential pressure limit 725d has been exceeded, indicating fluid accumulation in the tubing, or the A close time has been transferred 726d to terminate the A open cycle.

If the plunger does arrive at the top of the tubing 717*d* within the A open time, the A purge delay 719*d* may be initiated to delay the termination of the A open cycle until the lines have been purged of fluids and the delay has counted to zero 723*d* or the continued transmission of gas through A sales valve causes the casing pressure to drop below a selected limit 715*d*.

If the A valve is no open 706*d*, the system will wait until any active Shut-in time 738*d*, Plunger delay 741*d*, or B open delay 742*d* has counted to zero 739*d* , 745*d*, 743*d* before initiating any actions. The Safety input 747*d* is also checked before the test is made on the cycle flag 753*d*, if no injection option has been selected, to determine if the A valve has been closed temporarily or if it is time to reopen by the transferring of the A open time 702*d*.

If the cycle flag 753*d* indicates the A valve may be reopened 782*d*, a test is made of the Hi line limit 777*d* which would indicate that the sales line pressure is too great to permit production, and of the Lo line limit 778*d* which would indicate a broken sales line. The A valve will not open if the plunger has not dropped away from the top of the tubing 779*d*, indicating that the plunger has been captured by an optional plunger hold device, the plunger is stuck, or that the plunger sensor has been damaged.

If the A open time has been terminated, a test is made to determine if B bypass valve action has been initiated 754*d*. If no B valve action is pending, the A valve 782*d* will normally not be reopened until the A open time 702*d* has been transferred; however, optional pressure limit entries may have been entered by the operator to initiate the transfer of the A open time 776*d* to open the A valve 782*d* before the A close time 705*d* has counted to zero 701*d*. The first of these options is the Open differential pressure limit 772*d* which would be used to open the sales valve when a test of the casing pressure and the casing/tubing psi differential indicates sufficient pressure to raise the plunger to the surface with fluids present. The second option is the Hi casing pressure limit 773*d* alone which would indicate sufficient pressure is present to lift the plunger to the surface with the fluids present. Lo casing pressure 775*d* is also tested along with Close differential casing/tube pressure 774*d* to determine if insufficient pressures or excessive fluids in the tubing would prevent proper production of the well.

If B bypass valve action has been initiated 754*d* after termination of the A open cycle, B open time is tested for zero 755*d* before insuring that the B valve is open 765*d*, 766*d* and a test is made to determine if the plunger has arrived at the surface 767*d* indicating that all fluids have been discharged into the storage tank. If the plunger has arrived 767*d*, a B purge delay 770*d* may be initiated, if entered by the operator, to delay the closing of the B bypass valve 761*d* and permit the line to be purged of all fluids 756*d*, 758*d*. If the B open time counts down to zero 755*d* while any B purge delay is active 756*d*, the B valve will remain open until the B purge delay counts to zero 758*d* or the casing pressure drops below an acceptable value 757*d*. When the B open time 755*d* has zeroed or the B purge delay has counted to zero 768*d* , the B valve will be closed 761*d* and any plunger delay 764*d* the operator has entered will be initiated to permit the plunger to fall below the fluids in the tubing.

The C injection option in the algorithm will permit the flow of high pressure gas from an external source into the casing if required for production. Whether the C injection valve is opened or not is fully under the control of the algorithm. If while the A valve is closed and the casing pressure drops below a preselected pressure limit 775*d* or 780*d*, the C injection valve will be opened 787*d* and a C injection open time will be transferred 786*d*. All valve action is suspended until the C injection time has counted to zero 749*d*, 750*d*. The gas injected into the casing should permit the well to cycle on CONSTANT TIME or open with a pressure limit 772*d*, 773*d* which may have been selected by the operator. After the A valve has been opened 782*d*, an optional C injection delay time 784*d* may be initiated to delay the C injection valve from closing immediately and aid in the lift of the plunger. If no C injection delay time has been entered 788*d*, the C injection delay time immediately closed 789*d*. The system will now monitor the C injection delay 709*d* during the A valve open cycle until the delay counts to zero 710*d* when the C injection valve is closed 711*d*. The C injection valve will also be closed when the A open cycle is terminated 735*d*. The C injection valve will only be used by the algorithm when necessary to augment a well's natural rock pressure to complete a production cycle.

Various other options not shown on this flow diagram may be selected by the operator to modify the control algorithm for optimum production of the well.

Referring now to FIGS. 8A–8E, the various pressure limits used by the control algorithm also have options which may be selected or entered by the operator to smooth, delay, or provide hysteresis to enhance the results of the pressure tests.

The HI CASING DELAY 8A, HI LINE DELAY 8B, and LO DIFF DELAY 8C shown are typical of smoothing routines. The pressure must exceed the preset limit 801 entered by the operator for a specific time period 806, also entered by the operator, before the Limit Flag for that pressure 808 is valid and set. If the pressure drops below the preset limit within the specific time period 802, the smoothing delay will be reset 803 and no Limit Flag will be set 804. After the Limit Flag is set 808, if on the next pressure test the preset pressure limit is no longer exceeded 801, the Limit Flag will be reset 804.

The LINE OFFSET 8D and DIFF OFFSET 8E shown are typical of routines which provide a hysteresis effect to the pressure limits. The operator may select which offset is required for the application 825, either a Hi 826 (pressure above the specified limit) or Lo 833 (pressure below the specified limit). If the pressure limit is exceeded (for the Hi) 826, not only is the Limit Flag 832 set but also a Flag 831 indicating that the pressure limit was exceeded and that the operator has selected this option. When the pressure again drops below the preset limit 826, a test is made to determine if the offset option was selected 827 and if the pressure limit had previously been exceeded. If the test is true, a test is then made of the actual pressure compared to the Offset Pressure which had been entered by the operator 828. The Limit Flag for the pressure will not be cleared 830 until the actual pressure drops, not only below the preset pressure limit but also below the offset pressure limit 828 entered by the operator. This prevents a "toggling" of the Limit Flag when the actual pressure is just on the preset limit. If no offset option had been selected 827, the Limit Flag would have been cleared 830 when the pressure dropped below the preset pressure limit 826.

The controller has no attached operator control panel but provides a 25 pin Sub-D communications port which permits either serial or parallel data transfer. Access is only possible, however, after transmission and acknowledgement of a password or I.D. character string unique to the specific controller. Any device capable of full-duplex asynchronous serial communications using the standard NR2 format at a 200 or 1200 band rate may be used to communicate with the controller. These devices may be as simple as a hand held computer or a modem for a central base computer through telemetry or telephone lines.

The parallel data pins permit the temporary attachment of a simple keyboard and display device for on-site operator control or the connection of any portable parallel printer to record the controllers data log.

The controller is completely self-sufficient once its program, options, and times are selected. It may be left unattended for an extended period of time. Access means to the controller may be through a small waterproof plug wire with as few as three circuit contacts. This has been very useful for controllers on wells located on a lake bottom (e.g., lake Erie). In this particular application, no permanent connections to the surface are feasible. Markers or floats have been torn loose or vandalized. The water is so murky a diver has to operate by feel. A barge is normally used as a base for divers to check each well. Previous controllers had to be disconnected and brought to the surface for periodic checks or time adjustments. The operation was very expensive and time consuming.

The controller may also be buried for protection in extremes of temperature as temperature affects the electronic circuits and the operation of the small valves used to control the large motor valves. Any moisture content in the supply gas may crystallize with the cold and prevent the plungers in the small control valve from moving or plug the orifices.

The controllers may be housed in an approved enclosure with all outside electrical circuits passing through safety current limiting devices All circuits are normally very low current with the exception of the solar panel input; however, its current may also be limited to a safe level due to the low average current consumption of the controller.

The controllers I.D. character string or special display character strings (i.e., company names or logos) may be loaded into a non-volatile memory by a coded command by authorized personnel.

Special algorithms designed for unique applications may also be loaded via modem from the manufacturing facility or from special software for on-site downloading. These algorithms require a security code embedded within the routine to be recognized as valid. This increases the controller flexibility while maintaining the expert system of operation. The algorithms may only be programmed by the manufacturer.

The invention has been described with reference to the preferred embodiments. Obviously, modifications and alterations will occur to others upon a reading and understanding of the specification. It is my intention to include all such modifications and alterations insofar as they come within the scope of the appended claims or the equivalents thereof.

Having thus described the invention, I claim:

1. An improved controller for use in a gas and oil well system having a casing, a tubing, a sales line, a plunger lift device positioned within said tubing, a production valve intermediate of the tubing and sales line, a sales line pressure sensing means for generating a signal representative of pressure within said sales line, a casing pressure sensing means for generating a signal representative of pressure within said casing, and a plunger sensing means for generating a signal representative of said plunger lift device adjacent a position in the tubing, said improved controller comprising:

control circuit means, in operative communication with said production valve, said sales line pressure sensing means, said casing pressure means, and said plunger sensing means, for operating said production valve to regulate flow to the sales line, said control circuit means including: i) a microcontroller module for executing a predetermined algorithm, the microcontroller having a communication interface for selective communication of data between the microcontroller module and operatively associated external devices, a plurality of interfaces lines for communicating output signals generated by the microcontroller module and for communicating input signals to the microcontroller module, and a memory means for storing operating parameters and a plurality of status flags representative of operator variables and operator options; ii) identification means for selectively identifying a first set of the external devices as recognized devices, the identification means comprising: storage means for storing a first identification code signal; reading means for selectively reading a device signal from at least one of said operatively associated external devices through said communication interface; and, comparison means for comparing the first identification code signal with the device signal read to identify the at least one device as being among said first set upon an equivalence of the first identification code signal and the device signal; and, iii) communication port means, connected to said communication interface and selectively connectable with said external devices, for selective interactive communication between the microcontroller module and said recognized devices of the external devices.

2. The improved controller of claim 1 further comprising:

means for storing the predetermined algorithm as a system program portion and a housekeeping program portion;

means for downloading the system program portion from a preselected host computer through the communication port means during an initial controller configuration, the system program including a function algorithm tailored for a predetermined controller application, and the housekeeping program portion including physical event and timer service routines.

3. The improved controller of claim 2 further comprising means for modifying the operator variables and operator options by an operator through the communication port means to affect performance of the control circuit means.

4. The improved controller of claim 3 wherein the communication port means comprises interface means for interfacing the microcontroller module with a selectively connectable external communication device and with a selectively connectable external parallel communication device.

5. The improved controller of claim 1 further comprising: output buffer means, connected between a bidirectional interface line and said production valve, for buffering output signals generated by said microcontroller; and input buffer means, connected between a bidirectional interface line and said sales line pressure sensing means, between a bidirectional interface line and said casing pressure sensing means, and between a bidirectional interface line and said plunger sensing means, for buffering the signals generated by said sales line pressure sensing means, said casing pressure sensing means, and said plunger sensing means, respectively, the input buffer means comprising means for providing latched input signals to a first set of the plurality of bidirectional interface lines and means for providing sampled input signals to a second set of the plurality of bidirectional interface lines.

6. The improved controller of claim 5 wherein the input buffer means and the output buffer means comprise means for limiting current passing through the plurality of bidirectional interface lines to below a predetermined level.

7. The improved controller of claim 6 wherein the control circuit means further comprises a plurality of analog interface inputting means for inputting analog signals to the microcontroller module.

8. The improved controller of claim 7 wherein the communication port means comprises a waterproof plug having three circuit contacts.

9. The improved controller of claim 1 wherein the memory means comprises means for storing a data log of well production data, the data log being accessible by an operator through the communication port.

10. A modular controller for controlling a gas and oil well comprising:

a central processing module for executing a set of predetermined instructions to provide an output control signal to a production valve, the central processing module comprising:

i) a microcomputer having an on-chip communications interface, an on-chip random access memory, an on-chip electrically erasable programmable read only memory, and on-chip bidirectional input/output lines;

ii) an integrated circuit, coupled to the microcomputer, to provide standard voltage levels for direct communications with an external host computer;

iii) a precision timing circuit to supply nonmaskable software interrupts to the microcomputer for a general timebase pulse and software real time clock;

iv) a random access memory, coupled to the microcomputer, for storing operator variables; and, v) a connector to provide a termination point for the on-chip bidirectional input/output lines;

an input/output module, connected to the central processing module, to support a plurality of input sensors and output devices, the input/output module comprising:

i) a regulator circuit, connected to the central processing module, to supply power to the input sensors, output devices, and central processing module;

ii) a watchdog timer circuit, connected tot e microcomputer, for generating a periodic signal causing the central processing module to automatically generate said output control signal in turn closing the production valve and resetting the microcomputer during controller failure;

iii) a production valve driver circuit to pulse open or close coils of the production valve;

iv) a latched input line, connected to a bidirectional input/output line, to detect momentary input sensor closures;

v) a sampled input line, connected to a bidirectional input/output line, to detect actual input sensor closures; and, vi) an analog input line, connected to a bidirectional input/output line, to provide an excitation voltage to the microcomputer sensed by a strain gage type pressure transducer; and, a communications circuit, connected to the on-chip communications interface, through which all dialogue with the central processing module is executed.

11. The modular controller of claim 10 wherein the communications circuit comprises means for selectively interfacing with a host computer, and means for selectively rejecting control commands directed at controllers not said modular controller based upon a security identification character.

12. The modular controller of claim 10 further comprising means for selectively connecting said communications circuit with an external communications device, and means for initializing the external communication device when connected.

13. In a gas and oil well having a casing, a tubing, a sales line, a plunger lift device positioned within said tubing, and a production valve intermediate of the tubing and sales line, an improved controller for regulating production of said well comprising:

a sales line pressure sensing means for generating a signal representative of pressure within said sales line;

a casing pressure sensing means for generating a signal representative of pressure within said casing;

a plunger sensing means for generating a signal representative of said plunger lift device adjacent a position in the tubing; and, control circuit means, in operative communication with said production valve, said sales line pressure sensing means, said casing pressure means, and said plunger sensing means, for operating said production valve to regulate flow to the sales line, said control circuit means including:

a microcontroller module for executing a predetermined algorithm, the microcontroller having a communication interface for selective communication of data between the microcontroller module and operatively associated external devices, a plurality of interface lines for communicating output signals generated by the microcontroller module and for communicating input signals to the microcontroller module, and a memory means for storing operating parameters and a plurality of status flags representative of operator variables and operator;

identification means for selectively identifying a first set of the external devices as recognized devices, the identification means comprising: storage means for storing a first identification code signal; reading means for selectively reading a device signal from at least one of said operatively associated external devices through said communication interface; and comparison means for comparing the first identification code signal with the device signal read to identify the at least one device as being among said first set upon an equivalence of the first identification code signal and the device signal; and communication port means, connected to said communication interface and selectively connectable with said external devices, for selective interactive communication between the microcontroller module and said recognized devices of the external devices.

14. The improved controller according to claim 13 further comprising:

means for storing the predetermined algorithm as a system program portion and a housekeeping program portion; and, means for downloading the predetermined algorithm form the at least one device through the communication port means, the system program including a function algorithm tailored for a predetermined controller application, and the housekeeping program portion including physical event and timer service routines.

15. An improved controller for use with a gas and oil well having a conduit, a sales line, a plunger lift device positioned within said conduit, and a production valve intermediate of the conduit and sales line, the controller comprising:

conduit pressure signal input means for receiving a conduit pressure signal representative of pressure within said conduit;

plunger arrival signal input means for receiving a plunger arrival signal representative of said plunger lift device adjacent a position in the conduit; and, control circuit means, in operative communication with said production valve, said conduit pressure signal input means, and said plunger arrival signal input means, for operating said production valve to regulate flow to the sales line, said control circuit means including:

i) microcontroller means for executing a predetermined algorithm, the microcontroller means having a communication interface for selective communication of data between the microcontroller means and operatively associated external devices, a plurality of interface lines for communicating output signals generated by the microcontroller module and for communicating input signals to the microcontroller module, and a memory means for storing operating parameters and a plurality of status flags representative of operator variables and operator options;

ii) identification means for selectively identifying a first set of the external devices as recognized devices comprising: a) storage means for storing a first identification code signal; b) reading means for selectively reading a device signal from at least one of said operatively associated external devices through said communication interface; and c) comparison means for comparing the first identification code signal with the device signal read to recognize the at least one device as being among said first set upon an equivalence of the first identification code signal and the device signal; and iii) communication port means, connected to said communication interface and selectively connectable with said external devices, for selective interactive communication between the microcontroller module and said recognized devices.

16. The improved controller according to claim 15 further comprising:

means for storing the predetermined algorithm as a system program portion and a housekeeping program portion; and, means for downloading the predetermined algorithm from said at least one recognized device through the communication port means, the system program including a function algorithm tailored for a predetermined controller application, and the housekeeping program portion including physical event and timer service routines.

17. The improved controller according to claim 16 further comprising means for modifying the operator variables and operator options by an operator through the communication port means and said at least one recognized device to affect performance of the control circuit means.

18. The improved controller according to claim 17 wherein the communication port means comprises a serial communication interface means for serial communication of said data between said microcontroller means and said operatively associated external devices.

19. The improved controller according to claim 18 wherein said storage means comprises means for storing the first identification code signal as a first identification character string; said reading means comprises means for reading the device signal as a device identification character string; and, said comparison means comprises means for comparing the first identification character string with the device identification character string.

* * * * *

UNITED STATES PATENT AND TRADEMARK OFFICE

CERTIFICATE OF CORRECTION

PATENT NO. : 5,132,904

DATED : July 21, 1992

INVENTOR(S) : Lawrence R. Lamp

It is certified that error appears in the above-identified patent and that said Letters Patent is hereby corrected as shown below:

Claim 1, column 28, line 20, delete "interfaces" and replace with --interface--.

Claim 10, column 29, line 65, delete "tot e" and replace with --to the--.

Claim 13, column 30, line 60, after "operator" insert --options--.

Claim 14, column 31, line 18, delete "form" and replace with --from--.

Signed and Sealed this

Twenty-eighth Day of September, 1993

Bruce Lehman

*Attest:*

BRUCE LEHMAN

*Attesting Officer*

*Commissioner of Patents and Trademarks*